US008950566B2

(12) United States Patent
Hallowell et al.

(10) Patent No.: US 8,950,566 B2
(45) **Date of Patent: *Feb. 10, 2015**

(54) APPARATUS, SYSTEM AND METHOD FOR COIN EXCHANGE

(75) Inventors: Curtis W. Hallowell, Palatine, IL (US); John R. Blake, St. Charles, IL (US); William J. Jones, Barrington, IL (US)

(73) Assignee: Cummins Allison Corp., Mount Prospect, IL (US)

( * ) Notice: Subject to any disclaimer, the term of this patent is extended or adjusted under 35 U.S.C. 154(b) by 401 days.

This patent is subject to a terminal disclaimer.

(21) Appl. No.: 12/346,758

(22) Filed: Dec. 30, 2008

(65) Prior Publication Data

US 2009/0236200 A1 Sep. 24, 2009

Related U.S. Application Data

(60) and a continuation-in-part of application No. 11/726,828, filed on Mar. 23, 2007, and a continuation-in-part of application No. 11/803,281, filed on May 14, 2007, now Pat. No. 7,949,582, which (Continued)

(51) Int. Cl.
*G07F 7/04* (2006.01)
*G07D 1/04* (2006.01)

(Continued)

(52) U.S. Cl.
CPC ..... *G07D 1/04* (2013.01); *G06Q 99/00* (2013.01); *G07D 9/008* (2013.01); *G07D 11/0087* (2013.01)
USPC ..... 194/206; 194/215; 194/217; 194/302; 453/2; 453/6; 453/12; 453/57

(58) Field of Classification Search
CPC ..... G07D 11/0081; G07D 11/0084; G07D 11/0018; G07D 7/00; G07D 7/12; G07D 7/201; G07D 7/04; G07D 5/005; G07D 5/10; G07D 3/128; G07D 3/02; G07D 3/04; G07D 3/00; G07D 3/10; G07D 3/06; G07D 3/16; G07D 9/008; G07D 9/065; G07D 9/00; G07D 9/04; G07D 1/00; G07D 3/14; G07D 11/0006; G07D 11/0009; G07D 11/0003; G07D 11/0096; G07D 11/0087; G07D 13/00; G07D 11/00; G07D 1/02; G07D 1/04; G07D 1/06; G07F 19/00; G07F 9/06; G07F 19/202; G07F 19/201; G07F 19/205; G07F 19/207; G07F 7/04; G07F 7/20; G07F 1/047; B65H 2701/1912; B65H 7/12; B65H 7/125; G06T 7/007; G06T 7/0028; F24F 3/00; A45C 1/02; A45C 1/08; B65G 51/04; G06K 9/00; G06Q 20/1085; G06Q 40/00; G06Q 20/042; B42D 9/04; B41J 3/28; B41J 11/50
USPC ..... 705/14.15, 14.25, 14.17, 42, 43; 194/206, 207; 209/534; 453/6, 10, 12, 453/13, 33–35, 49, 57; 382/135, 136; 902/8–21

See application file for complete search history.

(56) References Cited

U.S. PATENT DOCUMENTS 446,303 A 2/1891 Thompson
2,669,998 A 2/1954 Buchholz ..... 133/8

(Continued)

FOREIGN PATENT DOCUMENTS

DE 660 354 5/1938
DE 30 21 327 12/1981 ..... G07D 3/06

(Continued)

OTHER PUBLICATIONS

Translation of JP06142328.*

(Continued)

*Primary Examiner* — Jeffrey Shapiro
(74) *Attorney, Agent, or Firm* — Nixon Peabody LLP

(57) ABSTRACT

A method for exchanging coins, the method including the acts of receiving in a self-service coin exchange machine a plurality of coins, processing the plurality of coins to determine a total value of the plurality of coins, and dispensing currency to the patron from a currency dispenser, the currency having a value related to the total value.

35 Claims, 6 Drawing Sheets

Related U.S. Application Data is a continuation of application No. 10/084,856, filed on Feb. 27, 2002, now abandoned, which is a division of application No. 08/814,978, filed on Mar. 11, 1997, now Pat. No. 6,363,164, which is a continuation-in-part of application No. 08/664,262, filed on May 13, 1996, now Pat. No. 5,982,918, and a continuation-in-part of application No. 11/945,671, filed on Nov. 27, 2007, now abandoned, which is a division of application No. 10/393,867, filed on Mar. 20, 2003, now Pat. No. 7,349,566, which is a division of application No. 09/059,813, filed on Apr. 14, 1998, now Pat. No. 6,661,910.

(60) Provisional application No. 61/038,730, filed on Mar. 21, 2008, provisional application No. 60/031,604, filed on Nov. 27, 1996, provisional application No. 60/043,516, filed on Apr. 14, 1997, provisional application No. 60/053,606, filed on Jul. 22, 1997.

(51) Int. Cl.

| | |
|---|---|
| ***G06Q 99/00*** | (2006.01) |
| ***G07D 9/00*** | (2006.01) |
| ***G07D 11/00*** | (2006.01) |

(56) References Cited

U.S. PATENT DOCUMENTS

| | | | | |
|---|---|---|---|---|
| 2,750,949 | A | 6/1956 | Kulo et al. | 133/8 |
| 2,835,260 | A | 5/1958 | Buchholz | 133/8 |
| 2,865,561 | A | 12/1958 | Rosapepe | 232/7 |
| 2,936,684 | A | 5/1960 | Simjian | 95/11 |
| 3,104,314 | A | 9/1963 | Simjian | 235/619 |
| 3,132,654 | A | 5/1964 | Adams | 133/1 |
| 3,148,932 | A | 9/1964 | Simjian | 346/22 |
| 3,150,912 | A | 9/1964 | Simjian | 346/22 |
| 3,173,742 | A | 3/1965 | Simjian | 346/22 |
| 3,246,295 | A | 4/1966 | DeClaris et al. | 382/56 |
| 3,280,974 | A | 10/1966 | Riddle et al. | |
| 3,443,107 | A | 5/1969 | Modglin | 250/219 |
| 3,480,785 | A | 11/1969 | Aufderheide | 250/219 |
| 3,496,370 | A | 2/1970 | Haville et al. | 250/219 |
| 3,509,535 | A | 4/1970 | Berube | 340/149 |
| 3,612,835 | A | 10/1971 | Andrews et al. | |
| 3,618,765 | A | 11/1971 | Cooper et al. | 209/122 |
| 3,656,615 | A | 4/1972 | Ptacek | 209/73 |
| 3,679,314 | A | 7/1972 | Mustert | 356/71 |
| 3,705,384 | A | 12/1972 | Wahlberg | 705/5 |
| 3,715,031 | A | 2/1973 | Okkonen | 209/75 |
| 3,725,667 | A | 4/1973 | Schwartz | 250/219 DQ |
| 3,764,899 | A | 10/1973 | Peterson | 324/61 R |
| 3,778,595 | A | 12/1973 | Hatanaka et al. | 235/379 |
| 3,778,628 | A | 12/1973 | Novak et al. | 250/556 |
| 3,782,543 | A | 1/1974 | Martelli et al. | 209/75 |
| 3,798,603 | A | 3/1974 | Wahlberg | 340/149 |
| 3,800,078 | A | 3/1974 | Cochran et al. | 178/71 |
| 3,806,710 | A | 4/1974 | Shigemori et al. | 235/92 |
| 3,815,021 | A | 6/1974 | Kerr | 324/61 R |
| 3,842,281 | A | 10/1974 | Goodrich | 250/461 |
| 3,870,629 | A | 3/1975 | Carter et al. | |
| 3,906,449 | A | 9/1975 | Marchak | 340/149 R |
| 3,916,922 | A | 11/1975 | Prumm | 133/3 R |
| 3,930,582 | A | 1/1976 | Gartner et al. | 209/88 |
| 3,966,047 | A | 6/1976 | Steiner | 209/75 |
| 3,976,198 | A | 8/1976 | Carnes, Jr. et al. | |
| 3,998,237 | A | 12/1976 | Kressin | |
| 4,023,011 | A | 5/1977 | Nakajima et al. | |
| 4,041,456 | A | 8/1977 | Ott et al. | 382/135 |
| 4,059,122 | A | 11/1977 | Kinoshita | 133/3 D |
| 4,075,460 | A | 2/1978 | Gorgens | 235/420 |
| 4,096,991 | A | 6/1978 | Iguchi | 235/419 |
| 4,109,238 | A | 8/1978 | Creekmore | 340/149 |
| 4,114,804 | A | 9/1978 | Jones et al. | 235/476 |
| 4,147,430 | A | 4/1979 | Gorgone et al. | 356/51 |
| 4,150,740 | A | 4/1979 | Douno | 194/4 C |
| 4,166,945 | A | 9/1979 | Inoyama et al. | 235/379 |
| 4,172,462 | A | 10/1979 | Uchida et al. | 133/3 A |
| 4,179,685 | A | 12/1979 | O—Maley | |
| 4,187,463 | A | 2/1980 | Kivenson | 324/228 |
| 4,197,986 | A | 4/1980 | Nagata | 235/379 |
| 4,205,780 | A | 6/1980 | Burns et al. | 235/454 |
| 4,208,549 | A | 6/1980 | Polillo et al. | |
| 4,231,014 | A | 10/1980 | Ponzio | |
| 4,232,295 | A | 11/1980 | McConnell | |
| 4,237,378 | A | 12/1980 | Jones | 250/223 R |
| 4,249,552 | A | 2/1981 | Margolin et al. | 133/1 R |
| 4,250,806 | A | 2/1981 | Boyson et al. | 101/2 |
| 4,251,867 | A | 2/1981 | Uchida et al. | 364/408 |
| 4,255,651 | A | 3/1981 | Phillips | 235/92 |
| 4,264,808 | A | 4/1981 | Owens et al. | 235/379 |
| 4,266,121 | A | 5/1981 | Hirose | 235/381 |
| 4,275,874 | A | 6/1981 | DiBlasio | 271/4 |
| 4,277,774 | A | 7/1981 | Fujii et al. | |
| 4,283,708 | A | 8/1981 | Lee | |
| 4,286,703 | A | 9/1981 | Schuller et al. | 194/100 |
| 4,288,781 | A | 9/1981 | Sellner et al. | |
| 4,302,781 | A | 11/1981 | Ikeda et al. | 358/486 |
| 4,310,885 | A | 1/1982 | Azcua et al. | 364/405 |
| 4,311,914 | A | 1/1982 | Huber | 250/556 |
| 4,313,598 | A | 2/1982 | DiBlasio | 271/124 |
| 4,317,957 | A | 3/1982 | Sendrow | 705/71 |
| 4,321,672 | A | 3/1982 | Braun et al. | 364/408 |
| 4,334,619 | A | 6/1982 | Horino et al. | 209/551 |
| 4,337,864 | A | 7/1982 | McLean | 209/534 |
| 4,341,951 | A | 7/1982 | Benton | 705/41 |
| 4,348,656 | A | 9/1982 | Gorgone et al. | |
| 4,349,111 | A | 9/1982 | Shah et al. | 209/534 |
| 4,352,988 | A | 10/1982 | Ishida | 250/559 |
| 4,355,300 | A | 10/1982 | Weber | |
| 4,355,369 | A | 10/1982 | Garvin | 364/900 |
| 4,356,473 | A | 10/1982 | Freudenthal | |
| 4,360,034 | A | 11/1982 | Davila et al. | 133/3 |
| 4,380,316 | A | 4/1983 | Glinka et al. | 232/16 |
| 4,381,447 | A | 4/1983 | Horvath et al. | 250/223 |
| 4,383,540 | A | 5/1983 | DeMeyer et al. | 133/3 H |
| 4,386,432 | A | 5/1983 | Nakamura et al. | 382/7 |
| 4,396,902 | A | 8/1983 | Warthan et al. | 382/64 |
| 4,412,292 | A | 10/1983 | Sedam et al. | 364/479 |
| 4,416,299 | A | 11/1983 | Bergman | 133/1 R |
| 4,420,153 | A | 12/1983 | Winkler et al. | 271/304 |
| 4,434,359 | A | 2/1984 | Watanabe | 235/379 |
| 4,441,205 | A | 4/1984 | Berkin et al. | 382/8 |
| 4,442,541 | A | 4/1984 | Finkel et al. | 382/7 |
| 4,449,240 | A | 5/1984 | Yoshida | 382/15 |
| 4,454,414 | A | 6/1984 | Benton | 705/41 |
| 4,461,028 | A | 7/1984 | Okubo | 382/15 |
| 4,464,786 | A | 8/1984 | Nishito et al. | 382/7 |
| 4,464,787 | A | 8/1984 | Fish et al. | 382/7 |
| RE31,692 | E | 10/1984 | Tyburski et al. | 382/7 |
| 4,480,177 | A | 10/1984 | Allen | 235/379 |
| 4,487,306 | A | 12/1984 | Nao et al. | 194/4 |
| 4,490,846 | A | 12/1984 | Ishida et al. | 382/7 |
| 4,513,439 | A | 4/1985 | Gorgone et al. | 382/7 |
| 4,521,008 | A | 6/1985 | Granzow et al. | 271/3 |
| 4,523,087 | A | 6/1985 | Benton | 235/379 |
| 4,530,067 | A | 7/1985 | Dorr | 364/900 |
| 4,538,719 | A | 9/1985 | Gray et al. | 194/100 A |
| 4,539,702 | A | 9/1985 | Oka | 382/7 |
| 4,542,829 | A | 9/1985 | Emery et al. | 209/534 |
| 4,543,969 | A | 10/1985 | Rasmussen | 133/3 |
| 4,544,266 | A | 10/1985 | Antes | 356/71 |
| 4,547,896 | A | 10/1985 | Ohtombe et al. | 382/7 |
| 4,553,222 | A | 11/1985 | Kurland et al. | 364/900 |
| 4,553,846 | A | 11/1985 | Hilton et al. | 356/429 |
| 4,556,140 | A | 12/1985 | Okada | 194/4 |
| 4,558,224 | A | 12/1985 | Gober | |
| 4,558,711 | A | 12/1985 | Yoshiaki et al. | 133/3 F |
| 4,559,451 | A | 12/1985 | Curl | 250/560 |
| 4,563,771 | A | 1/1986 | Gorgone et al. | 382/7 |
| 4,567,370 | A | 1/1986 | Falls | |
| 4,569,421 | A | 2/1986 | Sandstedt | 186/39 |
| 4,582,172 | A | 4/1986 | Takeuchi et al. | 186/38 |

(56) References Cited

U.S. PATENT DOCUMENTS 4,584,529 A 4/1986 Aoyama ..... 324/261
4,587,412 A 5/1986 Apisdorf ..... 235/449
4,587,434 A 5/1986 Roes et al. ..... 250/556
4,590,606 A 5/1986 Rohrer ..... 382/7
4,592,090 A 5/1986 Curl et al. ..... 382/7
4,593,184 A 6/1986 Bryce
4,594,664 A 6/1986 Hashimoto ..... 364/405
4,602,332 A 7/1986 Hirose et al. ..... 364/408
D285,095 S 8/1986 Lundgren et al. ..... D18/3
4,605,926 A 8/1986 Onishi et al.
4,611,205 A 9/1986 Eglise
4,611,345 A 9/1986 Ohnishi et al. ..... 382/7
4,617,458 A 10/1986 Bryce ..... 235/449
4,620,559 A 11/1986 Childers et al. ..... 133/3 A
4,622,456 A 11/1986 Naruto et al. ..... 235/379
4,628,194 A 12/1986 Dobbins et al. ..... 235/379
4,641,239 A 2/1987 Takesako ..... 705/41
4,645,936 A 2/1987 Gorgone ..... 250/556
4,653,647 A 3/1987 Hashimoto ..... 209/534
4,658,289 A 4/1987 Nagano et al. ..... 358/75
4,676,343 A 6/1987 Humble et al. ..... 186/61
4,677,682 A 6/1987 Miyagawa et al. ..... 382/7
4,678,072 A 7/1987 Kobayashi et al. ..... 194/206
4,685,141 A 8/1987 Hoque et al. ..... 382/7
4,686,357 A 8/1987 Douno et al. ..... 235/379
4,694,963 A 9/1987 Takesako ..... 209/534
4,697,071 A 9/1987 Hiraoka et al. ..... 235/379
4,700,368 A 10/1987 Munn et al. ..... 377/8
4,706,577 A 11/1987 Jones ..... 109/59 T
4,716,456 A 12/1987 Hosaka ..... 358/75
4,733,308 A 3/1988 Nakamura et al. ..... 358/496
4,733,765 A 3/1988 Watanabe ..... 194/206
4,735,289 A 4/1988 Kenyon ..... 186/37
4,743,743 A 5/1988 Fukatsu ..... 235/379
4,743,974 A 5/1988 Lockwood ..... 358/285
4,748,679 A 5/1988 Gold et al. ..... 382/61
4,749,087 A 6/1988 Buttifant ..... 209/534
4,753,625 A 6/1988 Okada ..... 453/32
4,764,725 A 8/1988 Bryce ..... 324/234
4,764,976 A 8/1988 Kallin et al. ..... 382/65
4,766,548 A 8/1988 Cedrone et al.
4,775,353 A 10/1988 Childers et al. ..... 453/6
4,778,983 A 10/1988 Ushikubo ..... 235/381
4,782,328 A 11/1988 Denlinger ..... 340/365
4,784,274 A 11/1988 Mori et al. ..... 209/534
4,803,347 A 2/1989 Sugahara et al. ..... 235/379
4,804,830 A 2/1989 Miyagisima et al. ..... 235/379
4,806,709 A 2/1989 Evans ..... 178/19
4,811,004 A 3/1989 Person et al. ..... 340/712
4,817,176 A 3/1989 Marshall et al. ..... 382/43
4,821,332 A 4/1989 Durham ..... 382/7
4,823,393 A 4/1989 Kawakami ..... 382/7
4,825,246 A 4/1989 Fukuchi et al. ..... 355/4
4,827,531 A 5/1989 Milford ..... 382/7
4,833,307 A 5/1989 Gonzalez/Justiz ..... 235/375
4,833,312 A 5/1989 Minematsu et al. ..... 235/379
4,837,842 A 6/1989 Holt ..... 382/26
4,841,358 A 6/1989 Kammoto et al. ..... 358/75
4,844,369 A 7/1989 Kanayachi ..... 242/56 R
4,851,616 A 7/1989 Wales et al. ..... 178/18
4,877,230 A 10/1989 Winkler et al. ..... 271/3
4,880,096 A 11/1989 Kobayashi et al. ..... 194/206
4,881,268 A 11/1989 Uchida et al. ..... 382/7
4,883,158 A 11/1989 Kobayashi et al. ..... 194/217
4,883,181 A 11/1989 Yoshikawa ..... 209/534
4,884,212 A 11/1989 Stutsman ..... 700/237
4,888,812 A 12/1989 Dinan et al. ..... 382/7
4,903,953 A 2/1990 Winkler et al. ..... 271/4
4,905,839 A 3/1990 Yuge et al. ..... 209/534
4,905,840 A 3/1990 Yuge et al. ..... 209/534
4,908,516 A 3/1990 West ..... 250/556
4,921,463 A 5/1990 Primdahl et al. ..... 453/3
4,922,109 A 5/1990 Bercovitz et al. ..... 194/207
4,928,094 A 5/1990 Smith ..... 340/712
4,931,782 A 6/1990 Jackson ..... 340/706
4,947,441 A 8/1990 Hara et al. ..... 382/7
4,953,086 A * 8/1990 Fukatsu ..... 705/42
4,954,697 A 9/1990 Kokubun et al. ..... 235/381
4,970,655 A 11/1990 Winn et al. ..... 364/479
4,973,851 A 11/1990 Lee ..... 250/556
4,980,543 A 12/1990 Hara et al. ..... 209/534
4,988,849 A 1/1991 Sasaki et al. ..... 235/379
4,992,860 A 2/1991 Hamaguchi et al. ..... 358/75
4,995,848 A 2/1991 Goh ..... 453/3
4,996,604 A 2/1991 Ogawa et al. ..... 358/486
5,010,238 A 4/1991 Kadono et al. ..... 235/379
5,010,782 A 4/1991 Asano et al.
5,023,782 A 6/1991 Lutz et al. ..... 364/405
5,025,139 A 6/1991 Halliburton, Jr. ..... 235/379
5,027,415 A 6/1991 Hara et al. ..... 382/7
5,039,848 A 8/1991 Stoken ..... 235/381
5,040,226 A 8/1991 Elischer et al. ..... 382/7
5,047,871 A 9/1991 Meyer et al. ..... 358/486
5,054,621 A 10/1991 Murphy et al. ..... 209/534
5,055,657 A 10/1991 Miller et al. ..... 235/381
5,055,834 A 10/1991 Chiba ..... 340/825
5,063,599 A 11/1991 Concannon et al. ..... 382/7
5,064,999 A 11/1991 Okamoto et al. ..... 235/379
5,068,519 A 11/1991 Bryce ..... 235/449
5,076,441 A 12/1991 Gerlier ..... 209/534
5,080,633 A 1/1992 Ristvedt et al. ..... 435/6
5,091,713 A 2/1992 Horne et al. ..... 340/541
5,091,961 A 2/1992 Baus, Jr. ..... 382/7
5,105,601 A 4/1992 Horiguchi et al. ..... 53/465
5,114,381 A 5/1992 Ueda et al. ..... 453/57
5,120,944 A 6/1992 Kern et al. ..... 235/379
5,120,945 A 6/1992 Nishibe et al. ..... 235/379
5,122,754 A 6/1992 Gotaas ..... 324/676
5,134,663 A 7/1992 Kozlowski ..... 382/7
5,135,115 A 8/1992 Miller et al. ..... 209/564
5,140,517 A 8/1992 Nagata et al. ..... 364/408
5,144,115 A 9/1992 Yoshida ..... 235/379
5,146,067 A 9/1992 Sloan et al. ..... 235/381
5,146,512 A 9/1992 Weideman et al. ..... 382/30
5,151,607 A 9/1992 Crane ..... 250/556
5,154,272 A 10/1992 Nishiumi et al. ..... 194/318
5,159,548 A 10/1992 Caslavka ..... 364/408
5,163,672 A 11/1992 Mennie ..... 271/187
5,163,868 A 11/1992 Adams et al. ..... 453/11
5,167,313 A 12/1992 Dobbins et al. ..... 194/317
5,175,416 A 12/1992 Mansvelt et al.
5,179,517 A 1/1993 Sarbin et al. ..... 463/25
5,183,142 A 2/1993 Katchinian et al. ..... 194/206
5,184,115 A 2/1993 Black et al. ..... 340/708
5,184,709 A 2/1993 Nishiumi et al. ..... 194/318
5,186,334 A 2/1993 Fukudome et al. ..... 209/534
5,187,750 A 2/1993 Behera ..... 382/7
5,193,121 A 3/1993 Elischer et al. ..... 382/7
5,198,976 A 3/1993 Form et al. ..... 364/410
5,199,543 A 4/1993 Kamagami et al. ..... 194/207
5,201,395 A 4/1993 Takizawa et al. ..... 194/206
5,207,788 A 5/1993 Geib et al. ..... 271/122
5,231,381 A 7/1993 Duwaer ..... 340/712
5,237,158 A 8/1993 Kern et al. ..... 235/379
5,239,593 A 8/1993 Wittner et al. ..... 382/14
5,243,174 A 9/1993 Veeneman et al. ..... 235/381
5,251,738 A 10/1993 Dabrowski ..... 194/206
5,252,811 A 10/1993 Henochowicz et al. ..... 235/379
5,253,167 A 10/1993 Yoshida et al. ..... 364/408
5,261,518 A 11/1993 Bryce ..... 194/206
5,265,008 A 11/1993 Benton et al. ..... 364/408
5,279,403 A 1/1994 Harbaugh et al. ..... 194/207
5,282,127 A 1/1994 Mii
5,286,954 A 2/1994 Sato et al. ..... 235/379
5,291,003 A 3/1994 Avnet et al. ..... 235/381
5,293,981 A 3/1994 Abe et al. ..... 194/347
5,295,196 A 3/1994 Raterman et al. ..... 382/135
5,297,030 A 3/1994 Vassigh et al. ..... 364/405
5,299,977 A 4/1994 Mazur et al. ..... 453/10
5,302,811 A * 4/1994 Fukatsu ..... 235/380
5,304,813 A 4/1994 DeMan ..... 250/556
5,308,992 A 5/1994 Crane et al. ..... 250/556
5,309,515 A 5/1994 Troung et al. ..... 382/7
5,317,140 A 5/1994 Dunthorn ..... 250/221

(56) References Cited

U.S. PATENT DOCUMENTS 5,321,238 A 6/1994 Kamata et al. 235/379
5,335,292 A 8/1994 Lovelady et al. 382/17
5,341,408 A 8/1994 Melcher et al. 377/8
5,342,165 A 8/1994 Graef et al.
5,363,949 A 11/1994 Matsubayashi 194/206
5,367,577 A 11/1994 Gotaas 382/7
5,368,147 A 11/1994 Menke et al. 194/206
5,371,345 A 12/1994 LeStrange et al. 235/380
5,371,798 A 12/1994 McWhortor 380/51
5,373,550 A 12/1994 Campbell et al. 379/100
5,374,814 A 12/1994 Kako et al. 235/379
5,379,344 A 1/1995 Larson et al. 380/23
5,381,019 A 1/1995 Sato 250/556
5,390,776 A 2/1995 Thompson 194/346
5,394,969 A 3/1995 Harbaugh 194/206
5,399,874 A 3/1995 Gonsalves et al. 250/556
5,402,895 A 4/1995 Mikkelsen et al. 209/534
5,417,316 A 5/1995 Harbaugh 194/206
5,418,458 A 5/1995 Jeffers 324/235
5,419,424 A 5/1995 Harbaugh 194/206
5,421,443 A 6/1995 Hatamachie et al. 914/206
5,430,664 A 7/1995 Cargill et al. 364/550
5,434,427 A 7/1995 Crane et al. 250/556
5,437,357 A 8/1995 Ota et al. 194/206
5,438,184 A 8/1995 Roberts et al. 235/380
5,440,108 A 8/1995 Tran et al. 235/381
5,444,793 A 8/1995 Kelland 382/138
5,444,794 A 8/1995 Uhland, Sr. 382/137
5,450,938 A 9/1995 Rademacher 194/206
5,453,601 A 9/1995 Rosen 235/379
5,459,304 A 10/1995 Eisenmann 235/380
5,465,301 A 11/1995 Jotcham et al. 380/54
5,465,821 A 11/1995 Akioka 194/207
5,467,405 A 11/1995 Raterman et al. 382/135
5,467,406 A 11/1995 Graves et al. 382/135
5,468,971 A 11/1995 Ebstein et al. 250/556
5,470,079 A 11/1995 LeStrange et al. 273/138
5,476,169 A 12/1995 Takarada et al. 194/207
5,481,377 A 1/1996 Udagawa et al. 358/501
5,486,067 A 1/1996 Huynh et al.
5,488,671 A 1/1996 Kern 382/138
5,500,514 A 3/1996 Veeneman et al. 235/381
5,504,822 A 4/1996 Holt 382/218
5,506,691 A 4/1996 Bednar et al. 358/402
5,507,379 A 4/1996 Mazur et al. 194/318
D369,984 S 5/1996 Larsen D10/97
5,523,575 A 6/1996 Machida et al.
5,530,772 A 6/1996 Storey 382/135
5,537,486 A 7/1996 Stratigos et al. 382/137
5,544,043 A 8/1996 Miki et al. 364/406
5,544,086 A 8/1996 Davis et al. 705/68
5,545,885 A 8/1996 Jagielinski 235/449
5,553,320 A 9/1996 Matsuura et al. 235/379
5,559,887 A 9/1996 Davis et al. 380/24
5,564,546 A 10/1996 Molbak et al. 194/216
5,586,036 A 12/1996 Pintsov 364/464
5,592,377 A 1/1997 Lipkin 395/242
5,600,732 A 2/1997 Ott et al. 382/112
5,602,933 A 2/1997 Blackwell et al. 382/116
5,602,936 A 2/1997 Green et al. 382/140
5,607,040 A 3/1997 Mathurin, Sr. 194/207
5,615,280 A 3/1997 Izawa et al. 382/135
5,620,079 A * 4/1997 Molbak 194/217
5,623,547 A 4/1997 Jones et al. 705/68
5,625,562 A 4/1997 Veeneman et al.
5,633,949 A 5/1997 Graves et al. 382/135
5,637,845 A 6/1997 Kolls 235/381
5,640,463 A 6/1997 Csulits 382/135
5,641,050 A 6/1997 Smith et al. 194/210
5,650,604 A * 7/1997 Marcous et al. 235/379
5,650,605 A 7/1997 Morioka et al. 273/153
5,652,421 A 7/1997 Veeneman et al. 235/381
5,652,802 A 7/1997 Graves et al. 382/135
5,657,846 A 8/1997 Schwartz 194/206
5,665,952 A 9/1997 Ziarno 235/380
5,678,046 A 10/1997 Cahill et al. 395/616
5,680,472 A 10/1997 Conant 382/135
5,687,963 A 11/1997 Mennie 271/119
5,692,067 A 11/1997 Raterman et al. 382/135
5,704,491 A 1/1998 Graves 209/534
5,719,948 A 2/1998 Liang 382/112
5,724,438 A 3/1998 Graves 382/135
5,727,667 A 3/1998 Nye 194/207
5,729,623 A 3/1998 Omatu et al. 382/155
5,746,299 A 5/1998 Molbak et al. 194/200
5,751,840 A 5/1998 Raterman et al. 382/135
5,751,842 A 5/1998 Riach et al. 382/137
5,754,673 A 5/1998 Brooks et al. 382/112
5,761,089 A 6/1998 Mcinerny 364/550
5,774,874 A 6/1998 Veeneman et al. 705/27
5,781,654 A 7/1998 Carney 382/137
5,790,693 A 8/1998 Graves et al. 382/135
5,790,697 A 8/1998 Munro et al. 382/135
5,799,767 A 9/1998 Molbak 194/217
5,806,650 A 9/1998 Mennie et al. 194/206
5,813,510 A 9/1998 Rademacher 194/206
5,815,592 A 9/1998 Mennie et al. 382/135
5,822,448 A 10/1998 Graves et al. 382/135
5,830,054 A 11/1998 Petri 453/5
5,832,104 A 11/1998 Graves et al. 382/135
5,832,463 A 11/1998 Funk 705/35
5,842,188 A 11/1998 Ramsey et al. 705/68
5,842,916 A 12/1998 Gerrity et al. 453/57
5,850,076 A 12/1998 Morioka et al. 235/379
5,852,811 A 12/1998 Atkins 705/36
5,854,581 A 12/1998 Mori et al. 235/379
5,867,589 A 2/1999 Graves et al. 382/135
5,868,236 A * 2/1999 Rademacher 194/217
5,870,487 A 2/1999 Graves et al. 382/135
5,875,259 A 2/1999 Mennie et al. 382/135
5,880,444 A 3/1999 Shibata et al. 235/379
5,892,211 A 4/1999 Davis et al. 235/380
5,905,810 A 5/1999 Jones et al. 382/135
5,909,502 A 6/1999 Mazur 382/135
5,909,503 A 6/1999 Graves et al. 382/135
5,909,793 A 6/1999 Beach et al. 194/210
5,909,794 A 6/1999 Molbak et al. 194/216
5,912,982 A 6/1999 Munro et al. 382/135
5,918,748 A 7/1999 Clark et al. 209/534
5,926,550 A 7/1999 Davis 380/25
5,938,044 A 8/1999 Weggesser 209/534
5,940,623 A 8/1999 Watts et al. 395/712
5,940,844 A 8/1999 Cahill et al. 707/526
5,943,655 A 8/1999 Jacobson 705/30
5,944,163 A * 8/1999 Keith et al. 194/206
5,944,600 A 8/1999 Zimmermann 453/10
5,947,255 A 9/1999 Shimada et al. 194/207
5,957,262 A 9/1999 Molbak et al. 194/200
5,960,103 A 9/1999 Graves et al. 382/135
5,966,456 A 10/1999 Jones et al. 382/135
5,982,918 A 11/1999 Mennie et al. 382/135
5,988,348 A 11/1999 Martin et al. 194/317
5,991,749 A * 11/1999 Morrill, Jr. 705/44
5,992,601 A 11/1999 Mennie et al. 194/207
5,995,949 A 11/1999 Morioka et al. 705/43
6,012,565 A 1/2000 Mazur 194/207
6,017,270 A 1/2000 Ristvedt et al. 453/5
6,021,883 A * 2/2000 Casanova et al. 194/217
6,023,684 A 2/2000 Pearson 705/35
6,026,175 A 2/2000 Munro et al. 382/135
6,028,951 A 2/2000 Raterman et al. 382/135
D422,016 S 3/2000 Forslund D18/3
6,032,859 A 3/2000 Muehlberger et al.
6,038,553 A 3/2000 Hyde, Jr. 705/45
6,039,645 A 3/2000 Mazur 453/10
6,047,807 A 4/2000 Molbak 194/217
6,047,808 A 4/2000 Neubarth et al. 194/317
6,056,104 A 5/2000 Neubarth et al. 194/317
6,068,194 A 5/2000 Mazur 235/492
6,072,896 A 6/2000 Graves et al. 382/135
6,073,744 A 6/2000 Raterman et al. 194/207
6,074,334 A 6/2000 Mennie et al. 493/438
6,080,056 A 6/2000 Karlsson 453/3
D427,623 S 7/2000 Kuwada et al. D18/3

(56) References Cited

U.S. PATENT DOCUMENTS 6,082,519 A 7/2000 Martin et al. ..... 194/350
6,086,471 A 7/2000 Zimmermann ..... 453/3
6,095,313 A 8/2000 Molbak et al. ..... 194/344
6,116,402 A 9/2000 Beach et al. ..... 194/216
6,128,402 A 10/2000 Jones et al. ..... 382/135
6,145,738 A 11/2000 Stinson et al. ..... 235/379
6,220,419 B1 4/2001 Mennie ..... 194/207
6,230,928 B1 5/2001 Hanna et al. ..... 221/13
6,237,565 B1 5/2001 Engelgau
6,237,739 B1 5/2001 Mazur et al. ..... 194/207
6,241,069 B1 6/2001 Mazur et al. ..... 194/207
6,256,407 B1 7/2001 Mennie et al. ..... 382/135
6,278,795 B1 8/2001 Anderson et al. ..... 382/135
6,283,366 B1 9/2001 Hills et al. ..... 235/379
6,308,887 B1 10/2001 Korman et al. ..... 235/379
6,311,819 B1 11/2001 Stromme et al. ..... 194/207
6,318,536 B1 * 11/2001 Korman et al. ..... 194/217
6,318,537 B1 11/2001 Jones et al. ..... 914/346
6,351,551 B1 2/2002 Munro et al. ..... 382/135
6,354,491 B2 3/2002 Nichols et al. ..... 235/379
6,363,164 B1 3/2002 Jones et al. ..... 382/135
6,371,303 B1 4/2002 Klein et al. ..... 209/534
6,378,683 B2 4/2002 Mennie ..... 194/207
6,381,354 B1 4/2002 Mennie et al. ..... 382/135
6,398,000 B1 6/2002 Jenrick et al. ..... 194/200
6,438,230 B1 8/2002 Moore ..... 380/42
6,459,806 B1 10/2002 Raterman et al. ..... 382/135
6,460,705 B1 10/2002 Hallowell ..... 209/534
6,473,519 B1 10/2002 Pidhirny et al. ..... 382/140
6,474,548 B1 11/2002 Montross et al. ..... 235/379
6,486,768 B1 * 11/2002 French et al. ..... 340/5.92
6,493,461 B1 12/2002 Mennie et al. ..... 382/135
6,539,104 B1 3/2003 Raterman et al. ..... 382/135
6,554,185 B1 4/2003 Montross et al. ..... 235/379
6,560,355 B2 5/2003 Graves et al. ..... 382/135
6,588,569 B1 7/2003 Jenrick et al. ..... 194/206
6,601,687 B1 8/2003 Jenrick et al. ..... 194/206
6,603,872 B2 8/2003 Jones et al. ..... 382/135
6,621,919 B2 9/2003 Mennie et al. ..... 382/135
6,628,816 B2 9/2003 Mennie et al. ..... 382/135
6,636,624 B2 10/2003 Raterman et al. ..... 382/135
6,647,136 B2 11/2003 Jones et al. ..... 382/137
6,650,767 B2 11/2003 Jones et al. ..... 382/135
6,654,486 B2 11/2003 Jones et al. ..... 382/135
6,661,910 B2 12/2003 Jones et al. ..... 382/135
6,665,431 B2 12/2003 Jones et al. ..... 382/135
6,678,401 B2 1/2004 Jones et al. ..... 382/135
6,678,402 B2 1/2004 Jones et al. ..... 382/135
6,705,470 B2 3/2004 Klein et al. ..... 209/534
6,721,442 B1 4/2004 Mennie et al. ..... 382/135
6,724,926 B2 4/2004 Jones et al. ..... 382/135
6,724,927 B2 4/2004 Jones et al. ..... 382/135
6,731,785 B1 5/2004 Mennie et al. ..... 382/135
6,731,786 B2 5/2004 Jones et al. ..... 382/135
6,748,101 B1 6/2004 Jones et al. ..... 382/135
6,758,316 B2 7/2004 Molbak ..... 194/200
6,778,693 B2 8/2004 Jones et al. ..... 382/135
6,783,452 B2 8/2004 Hino et al. ..... 453/3
6,786,398 B1 9/2004 Stinson et al. ..... 235/379
6,798,899 B2 9/2004 Mennie et al. ..... 382/135
6,810,137 B2 10/2004 Jones et al. ..... 382/135
6,843,418 B2 1/2005 Jones et al. ..... 235/462.01
6,860,375 B2 3/2005 Hallowell et al. ..... 194/207
6,866,134 B2 3/2005 Stromme et al. ..... 194/207
6,868,954 B2 3/2005 Stromme et al. ..... 194/207
6,880,692 B1 4/2005 Mazur et al. ..... 194/207
6,913,130 B1 7/2005 Mazur et al. ..... 194/207
6,913,260 B2 7/2005 Maier et al. ..... 271/265.04
6,915,893 B2 7/2005 Mennie et al.
6,929,109 B1 8/2005 Klein et al. ..... 194/206
6,945,457 B1 * 9/2005 Barcelou ..... 235/380
6,955,253 B1 10/2005 Mazur et al. ..... 194/207
6,957,733 B2 10/2005 Mazur et al.
6,959,800 B1 11/2005 Mazur et al. ..... 194/207
6,962,247 B2 11/2005 Maier et al. ..... 194/207
6,980,684 B1 12/2005 Munro et al. ..... 382/135
6,991,530 B2 1/2006 Hino et al. ..... 453/3
6,994,200 B2 2/2006 Jenrick et al. ..... 194/206
6,996,263 B2 2/2006 Jones et al.
7,000,828 B2 2/2006 Jones et al.
7,004,831 B2 2/2006 Hino et al.
7,016,767 B2 3/2006 Jones et al. ..... 700/224
7,028,827 B1 4/2006 Molbak et al.
7,082,216 B2 7/2006 Jones et al. ..... 382/137
7,092,560 B2 8/2006 Jones et al. ..... 382/135
7,103,206 B2 9/2006 Graves et al.
7,103,438 B2 9/2006 Hallowell et al. ..... 700/116
7,113,929 B1 9/2006 Beach et al. ..... 705/65
7,146,245 B2 12/2006 Jones et al. ..... 700/224
7,149,336 B2 12/2006 Jones et al. ..... 382/135
7,158,662 B2 1/2007 Chiles ..... 382/135
7,171,032 B2 1/2007 Jones et al. ..... 382/135
7,187,795 B2 3/2007 Jones et al.
7,191,657 B2 3/2007 Maier et al. ..... 73/587
7,197,173 B2 3/2007 Jones et al. ..... 382/135
7,200,255 B2 4/2007 Jones et al. ..... 382/135
7,201,320 B2 4/2007 Csulits et al. ..... 235/462.01
7,232,024 B2 6/2007 Mazur et al. ..... 194/207
7,248,731 B2 7/2007 Raterman et al. ..... 382/135
7,256,874 B2 8/2007 Csulits et al. ..... 356/71
7,278,527 B2 * 10/2007 Daout et al. ..... 194/206
7,349,566 B2 3/2008 Jones et al.
7,580,859 B2 8/2009 Economy
2001/0006557 A1 7/2001 Mennie et al. ..... 382/135
2001/0015311 A1 8/2001 Mennie ..... 194/207
2001/0019624 A1 9/2001 Raterman et al. ..... 382/135
2001/0035603 A1 11/2001 Graves et al. ..... 271/265.01
2002/0001393 A1 1/2002 Jones et al. ..... 382/100
2002/0013904 A1 * 1/2002 Gardner ..... 713/184
2002/0020603 A1 2/2002 Jones et al. ..... 194/346
2002/0056605 A1 5/2002 Mazur et al. ..... 194/207
2002/0085245 A1 7/2002 Mennie et al. ..... 358/498
2002/0085745 A1 7/2002 Jones et al. ..... 382/135
2002/0103757 A1 8/2002 Jones et al. ..... 705/45
2002/0104785 A1 8/2002 Klein et al. ..... 209/534
2002/0107801 A1 8/2002 Jones et al. ..... 705/45
2002/0118871 A1 8/2002 Jones et al. ..... 382/137
2002/0122580 A1 9/2002 Jones et al. ..... 382/137
2002/0126885 A1 9/2002 Mennie et al. ..... 382/135
2002/0126886 A1 9/2002 Jones et al. ..... 382/135
2002/0131630 A1 9/2002 Jones et al. ..... 382/137
2002/0136442 A1 9/2002 Jones et al. ..... 382/135
2002/0145035 A1 10/2002 Jones ..... 235/379
2002/0154804 A1 10/2002 Jones et al. ..... 382/135
2002/0154805 A1 10/2002 Jones et al. ..... 382/135
2002/0154806 A1 10/2002 Jones et al. ..... 382/135
2002/0154807 A1 10/2002 Jones et al. ..... 382/135
2002/0154808 A1 10/2002 Jones et al. ..... 382/135
2002/0179401 A1 * 12/2002 Knox et al. ..... 194/217
2002/0186876 A1 12/2002 Jones et al. ..... 382/135
2003/0006277 A1 * 1/2003 Maskatiya et al. ..... 235/379
2003/0009420 A1 1/2003 Jones ..... 705/39
2003/0015395 A1 1/2003 Hallowell et al. ..... 194/206
2003/0015396 A1 1/2003 Mennie ..... 194/206
2003/0062242 A1 4/2003 Hallowell et al. ..... 194/302
2003/0078864 A1 * 4/2003 Hardesty et al. ..... 705/35
2003/0081824 A1 5/2003 Mennie et al. ..... 382/135
2003/0108233 A1 6/2003 Raterman et al. ..... 382/135
2003/0121752 A1 7/2003 Stromme et al. ..... 194/207
2003/0121753 A1 7/2003 Stromme et al. ..... 194/207
2003/0127299 A1 7/2003 Jones et al. ..... 194/217
2003/0132281 A1 7/2003 Jones et al. ..... 235/379
2003/0139994 A1 7/2003 Jones ..... 705/36
2003/0168308 A1 9/2003 Maier et al. ..... 194/207
2003/0174874 A1 9/2003 Raterman et al. ..... 382/135
2003/0182217 A1 9/2003 Chiles ..... 705/35
2003/0198373 A1 10/2003 Raterman et al. ..... 382/135
2003/0202690 A1 10/2003 Jones et al. ..... 382/139
2004/0003980 A1 1/2004 Hallowell et al. ..... 194/206
2004/0016621 A1 1/2004 Jenrick et al. ..... 194/206
2004/0016797 A1 1/2004 Jones et al. ..... 235/379
2004/0028266 A1 2/2004 Jones et al. ..... 382/135
2004/0083149 A1 4/2004 Jones ..... 705/35
2004/0111370 A1 * 6/2004 Saylors et al. ..... 705/40

(56) References Cited

U.S. PATENT DOCUMENTS

| | | | | |
|---|---|---|---|---|
| 2004/0149538 | A1 | 8/2004 | Sakowski | 194/207 |
| 2004/0153408 | A1 | 8/2004 | Jones et al. | 705/43 |
| 2004/0154964 | A1 | 8/2004 | Jones | 209/534 |
| 2004/0173432 | A1 | 9/2004 | Jones | 194/216 |
| 2004/0188221 | A1 | 9/2004 | Carter | 194/215 |
| 2004/0251110 | A1 | 12/2004 | Jenrick et al. | 194/207 |
| 2005/0029168 | A1 | 2/2005 | Jones et al. | 209/534 |
| 2005/0035034 | A1 | 2/2005 | Long et al. | 209/534 |
| 2005/0040225 | A1 | 2/2005 | Csulits et al. | 235/379 |
| 2005/0047642 | A1* | 3/2005 | Jones et al. | 382/137 |
| 2005/0060055 | A1 | 3/2005 | Hallowell et al. | 700/95 |
| 2005/0060059 | A1 | 3/2005 | Klein et al. | 700/213 |
| 2005/0060061 | A1 | 3/2005 | Jones | 700/226 |
| 2005/0077142 | A1 | 4/2005 | Tam et al. | 194/217 |
| 2005/0086271 | A1 | 4/2005 | Jones et al. | 707/200 |
| 2005/0087422 | A1 | 4/2005 | Maier et al. | 194/207 |
| 2005/0108165 | A1 | 5/2005 | Jones et al. | 705/43 |
| 2005/0117791 | A2 | 6/2005 | Raterman et al. | 382/135 |
| 2005/0117792 | A2 | 6/2005 | Graves et al. | 382/135 |
| 2005/0121507 | A1* | 6/2005 | Brown et al. | 235/379 |
| 2005/0150738 | A1 | 7/2005 | Hallowell et al. | 194/206 |
| 2005/0163361 | A1 | 7/2005 | Jones et al. | 382/135 |
| 2005/0163362 | A1 | 7/2005 | Jones et al. | 382/137 |
| 2005/0169511 | A1 | 8/2005 | Jones | 382/135 |
| 2005/0183928 | A1 | 8/2005 | Jones et al. | 194/207 |
| 2005/0207634 | A1 | 9/2005 | Jones et al. | 382/135 |
| 2005/0213803 | A1 | 9/2005 | Mennie et al. | 382/135 |
| 2005/0241909 | A1 | 11/2005 | Mazur et al. | 194/207 |
| 2005/0249394 | A1 | 11/2005 | Jones et al. | 382/135 |
| 2005/0256792 | A1 | 11/2005 | Shimizu et al. | 705/35 |
| 2005/0265591 | A1 | 12/2005 | Jones et al. | 382/135 |
| 2005/0276458 | A1 | 12/2005 | Jones et al. | 382/135 |
| 2005/0278239 | A1 | 12/2005 | Jones et al. | 705/35 |
| 2006/0010071 | A1 | 1/2006 | Jones et al. | 705/42 |
| 2006/0054455 | A1 | 3/2006 | Kuykendall et al. | 194/217 |
| 2006/0054457 | A1 | 3/2006 | Long et al. | 194/347 |
| 2006/0064379 | A1* | 3/2006 | Doran et al. | 705/42 |
| 2006/0078186 | A1 | 4/2006 | Freeman et al. | 382/135 |
| 2006/0149415 | A1 | 7/2006 | Richards | 700/236 |
| 2006/0182330 | A1 | 8/2006 | Chiles | 382/135 |
| 2006/0195567 | A1 | 8/2006 | Mody et al. | 709/224 |
| 2006/0205481 | A1 | 9/2006 | Dominelli | 463/25 |
| 2006/0207856 | A1 | 9/2006 | Dean et al. | 193/302 |
| 2006/0210137 | A1 | 9/2006 | Raterman et al. | 382/135 |
| 2006/0219516 | A1* | 10/2006 | Saltsov et al. | 194/207 |
| 2006/0274929 | A1 | 12/2006 | Jones et al. | 382/135 |
| 2006/0283685 | A1 | 12/2006 | Cousin | 194/217 |
| 2007/0069007 | A1* | 3/2007 | Molbak | 235/379 |
| 2007/0071302 | A1 | 3/2007 | Jones et al. | 382/135 |
| 2007/0076939 | A1 | 4/2007 | Jones et al. | 382/135 |
| 2007/0078560 | A1 | 4/2007 | Jones et al. | 700/224 |
| 2007/0095630 | A1 | 5/2007 | Mennie et al. | 194/206 |
| 2007/0112674 | A1 | 5/2007 | Jones et al. | 705/45 |
| 2007/0118477 | A1* | 5/2007 | Graves et al. | 705/44 |
| 2007/0122023 | A1 | 5/2007 | Jenrick et al. | 382/135 |
| 2007/0125840 | A1* | 6/2007 | Law et al. | 235/379 |
| 2007/0168283 | A1* | 7/2007 | Alvarez et al. | 705/43 |
| 2007/0172107 | A1 | 7/2007 | Jones et al. | 382/137 |
| 2007/0221470 | A1 | 9/2007 | Mennie et al. | 194/216 |
| 2007/0237381 | A1 | 10/2007 | Mennie et al. | 382/135 |
| 2009/0063331 | A1* | 3/2009 | Rodin | 705/39 |
| 2009/0192938 | A1* | 7/2009 | Amos | 705/43 |

FOREIGN PATENT DOCUMENTS

| | | | |
|---|---|---|---|
| EP | 0 109 743 | 5/1984 | G07D 1/00 |
| EP | 0 351 217 | 1/1990 | G07F 9/04 |
| EP | 0 583 526 | 2/1994 | G06K 7/00 |
| EP | 0 583 723 | 2/1994 | G06K 7/00 |
| EP | 0 613 107 | 8/1994 | G07F 19/00 |
| EP | 0 633 552 | 1/1995 | G07C 5/00 |
| EP | 0 667 973 | 1/1997 | G07D 3/14 |
| EP | 0 926 634 | 6/1999 | G07D 3/14 |
| EP | 1 209 639 | 5/2002 | G07F 19/00 |
| FR | 2042254 | 2/1971 | G07B 11/00 |
| GB | 2 035 642 | 6/1980 | |
| GB | 2 038 063 | 7/1980 | G07D 7/00 |
| GB | 2 175 427 | 11/1986 | G07F 17/42 |
| GB | 2 190 996 | 12/1987 | G06K 5/00 |
| GB | 2 198 274 | 6/1988 | G07D 3/00 |
| GB | 2 223 872 | 4/1990 | G07F 9/08 |
| JP | 49/58899 | 6/1974 | |
| JP | 50/158348 | 12/1975 | A01J 3/18 |
| JP | 52/014495 | 2/1977 | G07F 5/10 |
| JP | 52/71300 | 6/1977 | G07F 8/22 |
| JP | 56/40992 | 4/1981 | G07F 5/18 |
| JP | 57/117080 | 7/1982 | G07D 3/16 |
| JP | 59/79392 | 8/1984 | |
| JP | 62/134168 | 8/1987 | G07B 1/00 |
| JP | 62/221773 | 9/1987 | |
| JP | 62/166562 | 10/1987 | G07B 1/00 |
| JP | 64/067698 | 3/1989 | G07F 7/08 |
| JP | 01/118995 | 5/1989 | G07D 1/00 |
| JP | 1/307891 | 12/1989 | |
| JP | 02/050793 | 2/1990 | G07D 9/00 |
| JP | 02/252096 | 10/1990 | |
| JP | 03/012776 | 1/1991 | G06F 15/30 |
| JP | 3/63795 | 3/1991 | |
| JP | 3/92994 | 4/1991 | |
| JP | 03/156673 | 7/1991 | |
| JP | 04/085695 | 3/1992 | G07F 11/72 |
| JP | 41/75993 | 6/1992 | |
| JP | 05/274527 | 10/1993 | G07D 9/00 |
| JP | 06/035946 | 2/1994 | |
| JP | 61/03285 | 4/1994 | G06F 15/21 |
| JP | 06142328 | * 12/1995 | G06F 19/00 |
| JP | 2002/117439 | 4/2002 | G07D 9/00 |
| JP | 2003/242287 | 8/2003 | G07B 1/00 |
| SE | 44 244 | 9/1988 | |
| WO | WO 85/00909 | 2/1985 | G07D 5/02 |
| WO | WO 90/07165 | 6/1990 | G07D 7/00 |
| WO | WO 93/09621 | 5/1993 | |
| WO | WO 93/23824 | 11/1993 | G06K 9/00 |
| WO | WO 94/06101 | 3/1994 | |
| WO | WO 95/24691 | 3/1995 | G06K 9/00 |
| WO | WO 96/36933 | 11/1996 | G06K 9/00 |
| WO | WO 97/43734 | 11/1997 | G06K 9/00 |
| WO | WO 98/12662 | 3/1998 | G06K 9/00 |
| WO | WO 98/13785 | 4/1998 | G06K 9/46 |
| WO | WO 98/24041 | 6/1998 | G06Q 20/00 |
| WO | WO 98/24067 | 6/1998 | G07D 3/14 |
| WO | WO 98/40839 | 9/1998 | G06K 9/00 |
| WO | WO 98/47100 | 10/1998 | G06K 9/78 |
| WO | WO 98/48383 | 10/1998 | G07D 1/00 |
| WO | WO 98/48384 | 10/1998 | G07D 1/00 |
| WO | WO 98/48385 | 10/1998 | G07D 1/00 |
| WO | WO 98/50892 | 11/1998 | G07D 7/00 |
| WO | WO 98/51082 | 11/1998 | H04N 7/18 |
| WO | WO 98/59323 | 12/1998 | G07D 3/00 |
| WO | WO 99/00776 | 1/1999 | G07F 9/06 |
| WO | WO 99/14668 | 3/1999 | G06F 9/445 |
| WO | WO 99/23601 | 5/1999 | G06K 9/00 |
| WO | WO 99/33030 | 7/1999 | G07D 3/00 |
| WO | WO 99/41695 | 8/1999 | G06K 5/00 |
| WO | WO 99/48040 | 9/1999 | G06K 9/00 |
| WO | WO 01/08108 | 2/2001 | G06K 7/00 |
| WO | WO 01/59685 | 8/2001 | G06K 9/00 |
| WO | WO 01/59723 | 8/2001 | G07F 7/04 |
| WO | WO 03/005312 | 1/2003 | G07F 19/00 |
| WO | WO 03/029913 | 4/2003 | G06K 7/00 |
| WO | WO 03/030113 | 4/2003 | G07F 7/04 |
| WO | WO 03/052700 | 6/2003 | G07D 11/00 |
| WO | WO 03/067532 | 8/2003 | G07F 7/04 |
| WO | WO 2004/010367 | 1/2004 | G06K 5/00 |
| WO | WO 2004/027717 | 4/2004 | G07D 11/00 |
| WO | WO 2004/038631 | 5/2004 | G07D 11/00 |
| WO | WO 2004/109464 | 12/2004 | G06F 19/00 |
| WO | WO 2005/017842 | 2/2005 | G07D 11/00 |
| WO | WO 2005/028348 | 3/2005 | B65H 1/00 |
| WO | WO 2005/029240 | 3/2005 | G06F 7/00 |
| WO | WO 2005/036445 | 4/2005 | G06F 19/00 |

(56) References Cited

FOREIGN PATENT DOCUMENTS

| | | | |
|---|---|---|---|
| WO | WO 2006/076289 | 7/2006 | ..... G07D 11/00 |
| WO | WO 2006/076634 | 7/2006 | ..... G06Q 90/00 |
| WO | WO 2007/035420 | 3/2007 | ..... G07F 7/00 |

OTHER PUBLICATIONS

Amiel Industries: AI-1500 'Pulsar' High Performance Sorting and Bagging Machine, 13 pages (date unknown).
AUI: Coinverter—"No More Lines . . . Self-Serve Cash-Out," by Cassius Elston, 1995 World Games Congress/Exposition Converter, 1 page (dated prior to 1995).
Brandt: System 930 Electric Counter/Sorter, 1 page (date unknown).
Brandt: 95 Series Coin Sorter Counter, 2 pages (1982).
Brandt: Mach 7 High-Speed Coin Sorter/Counter, 2 pages (1992).
Brandt: Model 1205 Coin Sorter Counter, 2 pages (1986).
Brandt: Model 1400 Coin Sorter/Counter, 2 pages (date unknown).
Brandt: Model 817 Automated Coin and Currency Ordering System, 2 pages (1983).
Brandt: Model 8904 Upfeed,—High Speed 4-Denomination Currency Dispenser, 2 pages (1989).
Brandt: Model 920/925 Counter, 2 pages (1982).
Brandt: Model 940-6 High Speed Sorter/Counter, 2 pages (date unknown).
Brandt: Model 952 Coin Sorter/Counter, 2 pages (date unknown).
Brandt: Model 954 Coin Sorter/Counter, 2 pages (date unknown).
Brandt: Model 957 Coin Sorter/Counter, 2 pages (date unknown).
Brandt: Model 958 Coin Sorter/Counter, 5 pages (© 1982).
Brandt: Model 960 High-Speed Coin Sorter & Counter, 2 pages (1984).
Brandt: Model 970 Coin Sorter and Counter, 2 pages (1983).
Brandt: System 945 High Speed Sorter, 2 pages (date unknown).
Brandt; Model 966 Microsort™ Coin Sorter and Counter, 4 pages, (1979).
Case ICC Limited: CDS Automated Receipt Giving Cash Deposit System, 3 pages (date unknown).
Cash, Martin: Newspaper Article "Bank Blends New Technology With Service," Winnipeg Free Press, 1 page (Sep. 4, 1992).
Childers Corporation: Computerized Sorter/Counter, "To coin an old adage, time is money . . . ,"0 3 pages (1981).
CTCoin: CDS602 Cash Deposit System, 1 page (date unknown).
Cummins: Jetsort Automated Money Processing System Vendors Love Jetsort 1page (date unknown).
Cununins: JetSort Model 1760 Coin Sorter Counter 1page (date unknown).
Cummins: JetSort® Models 1770 and 3000, Communication Package specification and operating instructions, 10 pages (date unknown).
Cummins: JetSort® Model 1701 With Jetstops Coinsorter Operating Instructions Manual (© 1984), 16 pages.
Cummins: JetSort Model CA700-01 Coin Sorter Counter Operating Instructions (© 1982), 14 pages.
Cummins: Jetsort Model 3000 Series Options Talking Jetsort 3000 1page (date unknown).
Cummins: JetSort® Model CA-750 Coin Sorter/Counter and CA-4050 JetCount currency counter, "Money Processing Made Easy," 2 pages (date unknown).
Cummins: The Universal Solution to All Coin and Currency Processing Needs, 1 page (date unknown).
Cummins: Jetsort Time for a Change—Be a Smashing Success 1 page, (date unknown).
Cummins: Jetsort Time for a Change—JetSort® vs Brandt X, 1 page, (date unknown).
Cummins: Jetsort, Time for a Change—No Coins Sorted After 3:00 or on Saturday, 1 page (date unknown).
Cummins: Jetsort, What do all these Banks have in Common, 3 pages (date unknown).
Cummins: JetSort® 700-01, Cummins Automated Money Systems (AMS) Case Study—First State Bank of Oregon, "JetSort® Gives Bank Coin Service Edge," 2 pages (date unknown).
Cummins: JetSort® 701, Cummins Automated Money Systems (AMS) Case Study—Convenco Vending, "High Speed Coin Sorter increases [] processing power at Convenco Vending," 1 page (date unknown).
Cummins: Jetsort Model 3200, Enhanced Elecrtronics for Jetsort 3200, 1page, (date unknown).
Cummins: JetSort® High Speed Coin Sorter &Counter, "CTOCS Ready" , 2 pages (date unknown).
Cummins: JetSort Model 3000, Sorts Counts 3000 Mixed Coins Per Min, 1page, (date unknown).
Cummins: JetSort® Model 1770, "JetSort® Speed and Accuracy, Now with Communications!", 1 page (date unknown).
Cummins: JetSort® 700-01/CA-118 Coin Wrapper, Cummins Automated Money Systems (AMS) Case Study—University State Bank, "Cummins Money Processing System Boosts Teller Service at University State Bank," 2 pages (date unknown).
Cummins: Jetsort Model CA130XL Case Study Coin Sorter Counter Keeps Pace With Fith Third Bank, 2pages (date unknown).
Cummins: Jetsort One Moving Part Simplicity Vendors Are Validators Changing Your Coin/Currency 3pages (date unknown).
Cummins: JetSort Model Series V, High Speed Coin Sorter Counter, 2pages (date unknown).
Cummins: JetSort Models 701 and 750, "State-of-the-art coin processing comes of age," 2 pages (Feb. 1984).
Cummins: Jetsort Cash Information and Settlement Systems 4pages, (date unknown).
Cummins: Jetsort Model CA 750 JetSort Coin Processor, 1page (date unknown).
Cummins: Jetsort Model 2000 Series JetSort High speed Coin Sorters, 2pages (date unknown).
Cummins: Jetsort Model 3000 Series High Speed Coin Counter 2 page, (date unknown).
Cummins: JetSort® High Speed Sorter/Counter Kits I & J—Operating Instructions 12 pages.
De La Rue: CDS 500 Cash Deponier System, 6 pages (date unknown) (German).
De La Rue: CDS 5700 and CDS 5800 Cash Deponier System, 7 pages (date unknown) (German) and translation.
Declaration of Douglas Mennie (From prosecution history of U.S. Appl. 10/198,872).
Diebold: Merchant MicroBranch, "Merchant MicroBranch Combines ATM After-Hour Depository Rolled-Coin Dispenser," Bank Technology News, 1 page (Nov. 1997).
Fa. GBS-Geldbearbeitungssysteme: GBS9401SB Technical Specification, 24 page (date unknown).
Frisco Bay: Commercial Kiosk, 4 pages (date unknown).
Glory: AMT Automated Merchant Teller, 4 pages (date unknown).
Glory: CRS-8000 Cash Redemption System, 2 pages (1996).
Hamilton: Hamilton's Express Banking Center, in Less Space Than a Branch Manager's Desk, 4 pages (date unknown).
ISII Electronic: ISII 12005/500 Coin Counter (with translation), 4 pages (date unknown).
ISH Electronic: ISH 12005/501 Self-Service Unit (with translation), 4 pages (date unknown).
Namsys, Inc.: Namsys Express, Making currency management . . . more profitable, 2 pages (date unknown).
NGZ Geldzahlmaschinengesellschaft: NGZ 2100 Automated Coin Depository, 4 pages (date unknown).
Perconta: Contomat Coin Settlement Machine for Customer Self Service, 2 pages (date unknown).
Prema GmbH: Prema 405 (RE) Self Service Coin Deposit Facility, 2 pages (date unknown).
Reis Eurosystems: CRS 6501/Crs 6510 Cash Receipt Systems, 3 pages (date unknown).
Reis Eurosystems: CRS 6520/ CRS 6525 Standard-Class Coin Deposit Systems, 1 page (date unknown).
Reis Eurosystems: CS 3510 Disc-Sorter, 1 page (date unknown).
Royal Bank: Hemeon, Jade, "Royal's Burlington drive-in bank provides customers 24-hour tellers," The Toronto Star, 1 page (Aug. 21, 1991).
Royal Bank: Leitch, Carolyn, "High-Tech Bank Counts Coins," The Globe and Mail, 2 pages (Sept. 19, 1991).

(56) References Cited

OTHER PUBLICATIONS

Royal Bank: Oxby, Murray, "Royal Bank Opens 'Super Branch,'" The Gazette Montreal, 2 pages (Sept. 14, 1991).
Royal Bank: SuperBranch, 2 pages (Feb. 1992).
Scan Coin: CDS 600 & CDS 640 Cash Deposit System—Technical Manual, 45 pages (date unknown).
Scan Coin: CDS 600 User's Manual, 14 pages (date unknown).
Scan Coin: CDS Cash Deposit System, 6 pages (date unknown).
Scan Coin: CDS Coin Deposit System—Technical Referens Manual, 47 pages (1989).
Scan Coin: CDS MK 1 Coin Deposit System—Technical Manual, 32 pages (1991).
Scan Coin: International Report, 49 pages (Apr. 1987).
Scan Coin: Money Processing Systems, 8 pages (date unknown).
Scan Coin: SC 102 Value Counter Technical Manual, 28 pages (date unknown).
Scan Coin: World, 2 pages (Feb. 1988).
UK Search Report claims 1/12, 25/31 and 46/59.
UK Search Report claims 13/16.
UK Search Report claims 16A/18.
UK Search Report claims 19/24, 32/38 and 60/64.
UK Search Report claims 39/45 and 65/84.
U.S. Appl. No. 10/084,856 Advisory Action May 9, 2008.
U.S. Appl. No. 10/084,856 Amendment After Final Apr. 30, 2008.
U.S. Appl. No. 10/084,856 Amendment Request Reconsideration, Oct. 30, 2007.
U.S. Appl. No. 10/084,856 Amendment Submitted with CPA RCE, Jun. 4, 2010.
U.S. Appl. No. 10/084,856 Appeal Brief Filed Aug. 19, 2008.
U.S. Appl. No. 10/084,856 Appeal Filed Affidavit, Sep. 10, 2008.
U.S. Appl. No. 10/084,856 BPAI Decision Examiner Affirmed Dec. 28, 2009.
U.S. Appl. No. 10/084,856 Decision on Reconsideration Denied Apr. 29, 2010.
U.S. Appl. No. 10/084,856 Examiners Answer to Appeal Brief Nov. 21, 2008.
U.S. Appl. No. 10/084,856 Final Rejection, Dec. 31, 2007.
U.S. Appl. No. 10/084,856 Final Rejection Jul. 31, 2007.
U.S. Appl. No. 10/084,856 Pre Brief Appeal Conference Decision, Jun. 19, 2008.
U.S. Appl. No. 10/084,856 Pre Brief Conference Request May 15, 2008.
U.S. Appl. No. 10/084,856 Preliminary Amendment Apr. 11, 2002.
U.S. Appl. No. 10/084,856 Preliminary Amendment, Oct. 23, 2003.
U.S. Appl. No. 10/084,856 Preliminary Amendment, Feb. 27, 2002.
U.S. Appl. No. 10/084,856 Reply Brief Filed, Jan. 15, 2009.
U.S. Appl. No. 10/084,856 Reply Brief Noted, Feb. 12, 2009.
U.S. Appl. No. 10/084,856 Request for Continued Examination, Jun. 4, 2010.
U.S. Appl. No. 10/084,856 Request for Hearing BPAI Decision, Mar. 1, 2010.
U.S. Appl. No. 10/084,856 Requirement for Restrictions Apr. 5, 2007.
U.S. Appl. No. 10/084,856 Response to Election Restriction, Apr. 23, 2007.
U.S. Appl. No. 10/198,872 Advisory Action, Jul. 5, 2006.
U.S. Appl. No. 10/198,872 Amendment Requesting Reconsideration, mailed Jun. 13, 2008.
U.S. Appl. No. 10/198,872 Amendment Requesting Reconsideration, mailed Nov. 20, 2007.
U.S. Appl. No. 10/198,872 Amendment Response Jan. 9, 2007.
U.S. Appl. No. 10/198,872 Amendment Response Jun. 29, 2006.
U.S. Appl. No. 10/198,872 Appeal Brief Filed, Mar. 1, 2010.
U.S. Appl. No. 10/198,872 Examiners Interview Aug. 1, 2007.
U.S. Appl. No. 10/198,872 Appeal Brief Filed, Jun. 15, 2009.
U.S. Appl. No. 10/198,872 Final Office Action Jun. 5, 2007.
U.S. Appl. No. 10/198,872 Final Rejection, Nov. 13, 2008.
U.S. Appl. No. 10/198,872 Office Action dated Mar. 31, 2005.
U.S. Appl. No. 10/198,872 Office Action Mailed Dec. 16, 2004.
U.S. Appl. No. 10/198,872 Office Action Mailed Jul. 29, 2004.
U.S. Appl. No. 10/198,872 Office Action Mailed Oct. 20, 2005.
U.S. Appl. No. 10/198,872 Office Action Mailed Sep. 15, 2006.
U.S. Appl. No. 10/198,872 Office Action Mar. 10, 2006.
U.S. Appl. No. 10/198,872 Reply Brief Filed, Dec. 7, 2009.
U.S. Appl. No. 10/198,872 Reply Brief Noted, Jan. 8, 2010.
U.S. Appl. No. 10/198,872 Response to Office Action, Mar. 11, 2005.
U.S. Appl. No. 10/198,872 Response to Office Action, Dec. 22, 2005.
U.S. Appl. No. 10/198,872 Response to Office Action, Aug. 8, 2007.
U.S. Appl. No. 10/198,872 Response to Office Action, Oct. 25, 2004.
U.S. Appl. No. 10/393,867 Notice of Allowance Oct. 19, 2007.
U.S. Appl. No. 10/393,867 Notice of Allowance Sep. 18, 2007.
U.S. Appl. No. 10/393,867 Office Action Mailed Apr. 20, 2007.
U.S. Appl. No. 10/393,867 Office Action Jan. 25, 2007.
U.S. Appl. No. 10/393,867 Response to Office Action Sep. 20, 2006.
U.S. Appl. No. 10/393,867 Office Action Mailed Sep. 20, 2006.
U.S. Appl. No. 10/393,867 Preliminary Amendment Mailed Oct. 16, 2007.
U.S. Appl. No. 10/393,867 Amendment Response After Final Dated Jan. 25, 2007.
U.S. Appl. No. 10/393,867 Final Office Action Mailed Jan. 25, 2007.
U.S. Appl. No. 11/434,092 Amendment After Final Office Action Nov. 23, 2009.
U.S. Appl. No. 11/434,092 Amendment After Notice of Allowance Mar. 8, 2010.
U.S. Appl. No. 11/434,092 Amendment Request Non Final Rejection Jun. 19, 2009.
U.S. Appl. No. 11/434,092 Amendment Request Non Final Rejection Nov. 20, 2008.
U.S. Appl. No. 11/434,092 Final Rejection Action Oct. 6, 2009.
U.S. Appl. No. 11/434,092 Non Final Rejection Mar. 19, 2009.
U.S. Appl. No. 11/434,092 Non Final Rejection Aug. 21, 2008.
U.S. Appl. No. 11/434,092 Notice of Allowance Fees Mar. 22, 2010.
U.S. Appl. No. 11/434,092 Notice of Allowance Fees May 27, 2010.
U.S. Appl. No. 11/434,092 Notice of Allowance Jan. 4, 2010.
U.S. Appl. No. 11/434,092 Request for Continued Examination Feb. 9, 2010.
U.S. Appl. No. 11/434,092 Request for Continued Examination May 14, 2010.
U.S. Appl. No. 11/726,828 Pre/Exam Formalities Notice May 1, 2007.
U.S. Appl. No. 11/726,828 Amendment Reconsideration After Non/Final Sep. 2, 2009.
U.S. Appl. No. 11/726,828 Amendment Reconsideration After Non/Final Mar. 24, 2010.
U.S. Appl. No. 11/726,828 Application Response to Pre Exam Formalities, Jun. 29, 2007.
U.S. Appl. No. 11/726,828 Non Final Rejection Apr. 2, 2009.
U.S. Appl. No. 11/726,828 Final Rejection Jun. 16, 2010.
U.S. Appl. No. 11/726,828 Non Final Rejection Dec. 8, 2009.
U.S. Appl. No. 11/726,828 Response to Election Restriction Filed Feb. 25, 2009.
U.S. Appl. No. 11/726,828 Notice of Appeal Filed Sep. 16, 2010.
U.S. Appl. No. 11/803,281 Advisory Action, Aug. 12, 2009.
U.S. Appl. No. 11/803,281 Affidavit/Dec Exhibit After Notice of Appeal, Nov. 5, 2009.
U.S. Appl. No. 11/803,281 Appeal Brief Filed, Nov. 5, 2009.
U.S. Appl. No. 11/803,281 Applicant Argument Remarks Made in Amendment, Feb. 12, 2009.
U.S. Appl. No. 11/803,281 Applicant Arguments Remarks Made in Amendment Jan. 20, 2009 9pages.
U.S. Appl. No. 11/803,281 Applicant Arguments Remarks Made in Amendment May 14, 2007 1 page.
U.S. Appl. No. 11/803,281 Application Arguments Remarks Made in Amendment, Jul. 24, 2009.
U.S. Appl. No. 11/803,281 Notice of Appeal Aug. 13, 2009.
U.S. Appl. No. 11/803,281 Final Rejection Apr. 23, 2009.
U.S. Appl. No. 11/803,281 Notice to Applicant Regarding Non Compliant, Feb. 2, 2009.
U.S. Appl. No. 11/803,281 Preliminary Amendment, May 14, 2007.
U.S. Appl. No. 11/803,281 Non/Final Rejection, Oct. 17, 2008.
U.S. Appl. No. 11/803,365 Amendment Reconsideration After Non/Final, Jan. 21, 2009.

(56) References Cited

OTHER PUBLICATIONS

U.S. Appl. No. 11/803,365 Amendment Reconsideration After Non/Final, Jul. 14, 2009.
U.S. Appl. No. 11/803,365 Applicant Response to Pre/Exam Formalities, Aug. 17, 2007.
U.S. Appl. No. 11/803,365 Appeal Brief Filed Apr. 8, 2010.
U.S. Appl. No. 11/803,365 Appeal Docketing Notice Sep. 3, 2010.
U.S. Appl. No. 11/803,365 Examiners Answer to Appeal Brief Jul. 6, 2010.
U.S. Appl. No. 11/803,365 Final Rejection, Nov. 9, 2009.
U.S. Appl. No. 11/803,365 Non/Final Rejection, Apr. 14, 2009.
U.S. Appl. No. 11/803,365 Non/Final Rejection, Oct. 20, 2008.
U.S. Appl. No. 11/803,365 Notice of Appeal Filed, Feb. 8, 2010.
U.S. Appl. No. 11/803,365 Pre Exam Formalities Notice Jun. 12, 2007.
U.S. Appl. No. 11/803,365 Preliminary Amendment Aug. 17, 2007.
U.S. Appl. No. 11/803,365 Preliminary Amendment Applicant Arguments May 14, 2007.
U.S. Appl. No. 11/803,365 Reply Brief Filed Jul. 23, 2010.
U.S. Appl. No. 11/803,365 Reply Brief Noted Aug. 20, 2010.
U.S. Appl. No. 11/803,366 Advisory Action Aug. 10, 2009.
U.S. Appl. No. 11/803,366 Appeal Docketing Notice, Jul. 22, 2010.
U.S. Appl. No. 11/803,366 Reply Brief Filed, Apr. 20, 2010.
U.S. Appl. No. 11/803,366 Reply Brief Noted, Jul. 7, 2010.
U.S. Appl. No. 11/803,366 Affidavit Dec/Exhibit After Notice of Appeal, Oct. 8, 2009.
U.S. Appl. No. 11/803,366 Amendment After Final Jul. 20, 2009.
U.S. Appl. No. 11/803,366 Amendment Request Reconsideration After Non Final Rejection, Jan. 23, 2009.
U.S. Appl. No. 11/803,366 Appeal Brief Field Nov. 16, 2009.
U.S. Appl. No. 11/803,366 Appeal Brief Filed Oct. 8, 2009.
U.S. Appl. No. 11/803,366 Final Rejection Apr. 20, 2009.
U.S. Appl. No. 11/803,366 Non/Final Rejection Sep. 23, 2008.
U.S. Appl. No. 11/803,366 Notice of Appeal Filed Aug. 11, 2009.
U.S. Appl. No. 11/803,366 Preliminary Amendment May 14, 2007.
U.S. Appl. No. 11/803,366 Examiners Answer to Appeal Brief, Mar. 2, 2010.
U.S. Appl. No. 11/803,381 Amendment Reconsideration After Non/Final Rejection, Jan. 23, 2009.
U.S. Appl. No. 11/803,381 Amendment Reconsideration After/Non Final Rejection, Jan. 27, 2010.
U.S. Appl. No. 11/803,381 Amendment Request Reconsideration After Non final Mailed Jul. 21, 2010.
U.S. Appl. No. 11/803,381 Amendment Submitted Entered With Filing of CPA/RCE, Jun. 30, 2009.
U.S. Appl. No. 11/803,381 Final Rejection, Mar. 30, 2009.
U.S. Appl. No. 11/803,381 Non/Final Rejection, Apr. 23, 2010.
U.S. Appl. No. 11/803,381 Non/Final Rejection, Aug. 12, 2009.
U.S. Appl. No. 11/803,381 Non/Final Rejection, Sep. 24, 2008.
U.S. Appl. No. 11/803,381 Request for Continued Examination Amendment Submitted Jun. 30, 2009.
U.S. Appl. No. 11/803,381 Response to Pre Exam Formalities Notice Aug. 17, 2007.

* cited by examiner

APPARATUS, SYSTEM AND METHOD FOR COIN EXCHANGE

CROSS-REFERENCE

This application claims the benefit of priority from U.S. Provisional Patent Application Ser. No. 61/038,730 filed on Mar. 21, 2008, entitled "Apparatus, System and Method For Coin Redemption". This application further claims priority to, and is a continuation in part of, co-pending U.S. patent application Ser. No. 11/726,828 filed on Mar. 23, 2007, entitled "Systems, Apparatus, and Methods For Currency Processing Control and Redemption". This application further claims the benefit of priority from, and is a continuation in part of, co-pending U.S. patent application Ser. No. 11/803,281, filed on May 14, 2007 now U.S. Pat. No. 7,949,582, entitled "Automatic Document Processing System Using Full Image Scanning," which is a continuation of U.S. patent application Ser. No. 10/084,856, filed on Feb. 27, 2002 now abandoned, entitled "Automatic Funds Processing System," which is a divisional of U.S. patent application Ser. No. 08/814,978, filed on Mar. 11, 1997, entitled "Automatic Document Processing System Using Full Image Scanning" (now U.S. Pat. No. 6,363,164); which is a continuation in part of U.S. patent application Ser. No. 08/664,262, filed on May 13, 1996, entitled "Automatic Funds Processing System" (now U.S. Pat. No. 5,982,918), and claims the benefit of priority of U.S. Patent Application No. 60/031,604, filed on Nov. 27, 1996, entitled "Automatic Funds Processing System". This application further claims the benefit of priority to, and is a continuation in part of co-pending U.S. patent application Ser. No. 11/945,671, filed on Nov. 27, 2007 now abandoned, entitled "Image Processing Network," which is a divisional of U.S. patent application Ser. No. 10/393,867 (now U.S. Pat. No. 7,349,566) filed on Mar. 20, 2003, entitled "Image Processing Network," which is a divisional of U.S. patent application Ser. No. 09/059,813, filed Apr. 14, 1998 now U.S. Pat. No. 6,661,910, entitled "Network for Transporting and Processing Images in Real Time," which claims the benefit of U.S. Provisional Patent Application Ser. No. 60/043,516, filed Apr. 14, 1997, and U.S. Provisional Application No. 60/053,606, filed Jul. 22, 1997, all of the above applications of which are incorporated herein by reference in their entirety, with the exception of U.S. patent application Ser. No. 11/945,671 and U.S. Provisional Patent Application Ser. No. 61/038,730 which are not incorporated herein by reference, and the benefit of priority is claimed to all of the above applications.

FIELD OF ENDEAVOR

The present invention relates generally to the field of bulk coin handling systems and, more particularly, to exemplary apparatuses, systems, and methods for bulk coin exchange.

BACKGROUND

Currency processing machines generally have the ability to receive bulk currency (e.g., currency bills and/or coins) from a user of the machine. Coin processing modules, for example, are commonly used as coin redemption machines wherein, after the deposited coins are counted and totaled, a receipt is issued indicating the value of the deposited coins. The user may exchange this receipt for the amount of deposited coins in the form of currency bills or, optionally, for an amount of the deposited coins less a commission charged for use of the coin redemption machine.

Coin redemption machines are used in banking environments (in patron accessible areas and in employee-only areas), business environments (e.g., armored transport services, telephone companies, etc.) and retail environments, such as grocery stores. In operation, a user inputs a batch of coins of mixed denominations into a hopper of the coin redemption machine. The machine discriminates items that are not valid coins, determines the value of the valid deposited coins and outputs a receipt indicative of the determined amount. In some embodiments, the receipt also indicates a second, lesser amount, which reflects a commission charged for use of the machine. The user exchanges the receipt for paper currency for the value of the deposited coins less the commission. In a banking environment, a user may exchange the receipt at a teller's window, whereas, in a retail environment, the user can exchange the receipt at a cashier's station or a patron-service station. In one example, the coin redemption machine disclosed by Molbak in U.S. Pat. No. 6,976,570, receives a number of unsorted coins, sorts the coins, counts the total value of the valid coins, and outputs a voucher related to the total amount (i.e., less a commission charge for the use of the machine). The user then takes this voucher to a cashier or clerk for redemption, following the verification of the authenticity of the voucher by the cashier or clerk.

One disadvantage associated with conventional coin redemption machines is the potential for fraud which exists with current receipt-type systems or voucher-based systems. For example, a receipt or voucher can be duplicated (i.e., counterfeited) and then exchanged more than once resulting in a loss for that particular store. Additionally, receipts or vouchers may be altered, so as to fraudulently increase an apparent value of the receipt in an attempt to obtain more money from the receipt that its true value. Accordingly, as one example, U.S. Pat. No. 6,349,972 to Geiger et al. discloses a coin redemption machine printed voucher comprising various devices to deter, reduce, or eliminate unauthorized duplication or counterfeiting of such voucher, including special inks, papers, indicia, and/or perforations. These security devices, and many others (e.g., holograms, optically variable devices, watermarks, fluorescent fibers, taggants, threads, barcodes, batch and date codes, micro-perforations, etc.), have been long-known in the negotiable instrument field and have been applied to negotiable instruments in a long-standing struggle to stem losses attributable to counterfeiting and stay ahead of counterfeiters.

Additional disadvantages associated with the conventional coin redemption machines include, but are not limited to, additional time and steps associated with the redemption process, inconvenience to the bearer of the receipt or the voucher, unfamiliarity with the receipt or voucher security features by the clerk or cashier, and human error.

SUMMARY OF THE DISCLOSURE

The aspects of the present concepts disclosed herein are generally directed to coin exchange machines configured to provide security measures to guard against the unauthorized access and/or use, and to protect against counterfeiting or forging of vouchers or negotiable instruments issued therefrom.

In some aspects of the present concepts, a method for exchanging coins is provided comprising the acts of receiving in a self-service coin exchange machine a plurality of coins, processing the plurality of coins to determine a total value of the plurality of coins, and dispensing bills from the currency dispensing module having an amount relating to the total value.

Another aspect of the present concepts includes a method for exchanging coins at a stand-alone self-service coin exchange machine comprising the acts of receiving in a stand-alone self-service coin exchange machine a plurality of coins, processing the plurality of coins to determine a total value of the plurality of coins, and substantially immediately dispensing bills from the currency dispensing module having a value relating to the total value.

In another aspect of the present concepts, a method for exchanging coins at a stand-alone self-service coin exchange machine includes the acts of receiving in a stand-alone self-service coin exchange machine a plurality of coins input by a user, processing the plurality of coins to determine a total value of the plurality of coins, providing to the user of the stand-alone self-service coin exchange machine an option to dispense bills from the currency dispensing module in bills or coins having a value relating to the total value, and providing to the user of the stand-alone self-service coin exchange machine an option to output a value relating to the total value in a form other than bills or coins.

Another method in accord with the present concepts includes a method for exchanging coins at a self-service coin exchange machine comprising the acts of receiving in a self-service coin exchange machine a plurality of coins, processing the plurality of coins to determine a total value of the plurality of coins, dispensing currency from the currency dispensing module having a value relating to the total value, dispensing a stored value media from a stored value media dispenser, the stored value media having a value relating to the total value, or dispensing both currency from the currency dispensing module and dispensing a stored value media from the stored value media dispenser, the combination of the value of the currency and the stored value media having a cumulative value relating to the total value, and communicating transaction related data from the self-service coin exchange machine to a local computer, a remote computer, or both a local computer and a remote computer.

Still another method in accord with the present concepts includes a method for exchanging coins at a self-service coin exchange machine, the method comprising receiving a plurality of coins in the self-service coin processing module, processing the coins to determine a total value of the input coins, determining from the total value an exchange amount, dispensing currency from the currency dispensing device having a first portion of the exchange amount, and wirelessly transferring a value of a remainder of the exchange amount to a portable electronic device identified by a user.

A self-service apparatus for exchanging currency for coins in accord with other aspects of the present concepts includes a coin input region configured to receive a batch of coins from a user, a coin discriminating device configured to determine a validity of each coin in the batch of coins and to determine a total value the batch of coins, at least one coin receptacle configured to receive the valid coins from the coin discriminator, a currency dispensing device configured to output currency to the user in an amount relating to the total value, and a communication device configured to transmit information from the currency dispensing device to a local computer and/or a remote computer. The information is related to a status of the currency dispensing device or transaction data for the currency dispensing device.

A method for exchanging coins at a stand-alone self-service coin exchange machine in accord with other aspects of the present concepts includes the acts of receiving in a stand-alone self-service coin exchange machine a plurality of coins, processing the plurality of coins to determine a total value of the plurality of coins, dispensing bills from the currency dispensing module having a first value relating to the total value, and dispensing a restricted use ticket from a ticket dispenser associated with the self-service coin exchange machine, the restricted use ticket having a second value relating to the total value. The sum of the first value and the second value is less than or equal to the total value.

A self-service device for exchanging currency, tickets, or currency and tickets for coins in accord with some aspects of the present concepts includes a coin input region configured to receive a batch of coins from a user, a coin discriminating device configured to determine a validity of each coin in the batch of coins and to determine a total value the batch of coins, at least one coin receptacle configured to receive the valid coins from the coin discriminator, a currency dispensing device configured to output currency to the user in an amount relating to the total value, a ticket dispensing device configured to dispense a restricted use ticket having a second value relating to the total value, and a communication device configured to transmit information from the self-service apparatus to a local computer, to a remote computer, to a transaction terminal, or to any combination thereof, wherein the information is related to a status of the self-service device, a status of the currency dispensing device, a status of the ticket dispensing device, or transaction data for the self-service device. The sum of the first value and the second value is less than or equal to the total value.

Still other aspects of the present concepts includes a device for permitting a retail store patron to convert loose mixed coins into an alternative form of funds which are generally acceptable and negotiable outside said retail store without requiring the patron to conduct a transaction at a cashier station within said retail store. The device comprises a hopper located remotely from cashier stations in a retail store, the hopper being configured to receive loose mixed coins from a store patron, a coin counter for determining a total value of the loose mixed coins received in the hopper, and a funds dispenser operatively associated with the coin counter for substantially immediately delivering alternative funds directly to the patron without requiring the involvement of a store employee, the alternative funds being dispensed in an amount related to the total value. The alternative funds are in a form generally acceptable and negotiable within the store if the patron chooses to conduct a transaction at a cashier station within the store, and outside the store if the patron chooses not to conduct a transaction at a cashier station within the store.

Another method in accord with some aspects of the present concepts provides a method for exchanging loose coins of a plurality of currency types at a self-service coin exchange machine comprising the acts of receiving in the self-service coin exchange machine loose coins of a plurality of currency types, processing the plurality of coins to determine a number of and a denomination of a first plurality of coins of a first currency type and to determine a number of and a denomination of a second plurality of coins of a second currency type, determining a value of the first plurality of coins of the first currency type, determining a value of the second plurality of coins of the second currency type, determining a total value of the input loose coins, and dispensing bills from a currency dispensing module associated with the self-service coin exchange machine, the dispensed bills having a value relating to the total value.

Another method in accord with some aspects of the present concepts provides a method for exchanging coins comprising the acts of receiving in a self-service coin exchange machine a plurality of coins, processing the plurality of coins to determine a total value of the plurality of coins, receiving an input from a patron indicating one of a preferred status or non-preferred status, assessing, responsive to the user input, a transaction fee associated with the input patron status, the transaction fee being higher for the non-preferred status than for the preferred status, and dispensing bills from the currency dispensing module having an amount relating to the total value, less the transaction fee associated with the patron's status.

A system for exchanging coins at a self-service coin exchange machine in accord with yet other aspects of the present concepts includes one or more self-service coin exchange machine(s) disposed in a public area, the self-service coin exchange machine(s) comprising a coin input region configured to receive a plurality of substantially simultaneously input loose coins, a coin processing device configured to determine a total value of the input coins and to discharge the coins to one or more coin receptacles, a currency dispenser configured to dispense currency for a value related to the total value, and a first communication device configured to transmit transaction related data or self-service coin exchange machine data and a computer associated with a second communication device and being configured to receive via the second communication device the transaction related data or self-service coin exchange machine data transmitted by the self-service coin exchange machine.

The above summary of the present invention is not intended to represent each embodiment, or every aspect, of the present invention. Additional features and benefits of the present invention will become apparent from the detailed description, figures, and claims set forth below.

BRIEF DESCRIPTION OF THE DRAWINGS

Other objects and advantages of the invention will become apparent upon reading the following detailed description in conjunction with the drawings.

Figure 1:
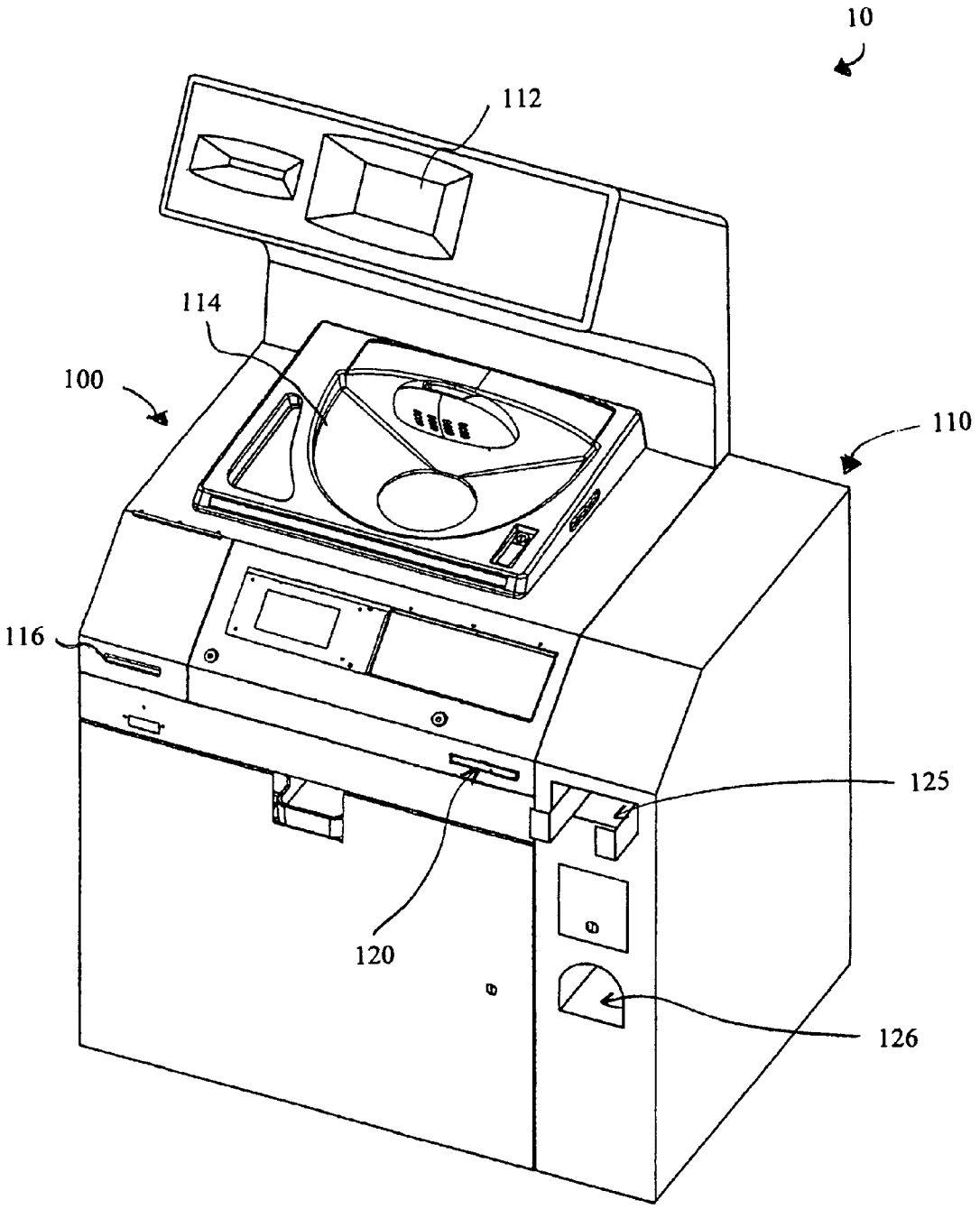
FIG. 1 is a perspective view of a coin exchange machine in accord with at least some aspects of the present concepts.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE ILLUSTRATED EMBODIMENTS

FIG. 1 shows one example of a coin exchange machine 10 in accord with at least one example of an aspect of the present concepts, the self-service coin exchange machine 10 comprising a coin processing module 100 and a currency dispensing module 110.

In the embodiment of the self-service coin exchange machine 10 shown in FIG. 1, the self-service coin exchange machine 10 includes a touch screen 12 and/or other user interface(s) to receive inputs from a user and to display information and prompts or queries to the user. While the touch screen 12 is a presently preferred mode to enter data from the user of the self-service coin exchange machine 10, the self-service coin exchange machine may additionally comprise a keypad, a keyboard, a microphone, and/or one or more buttons to receive user inputs. The user may be permitted to make inputs at any time to select various options before or after processing of the currency. For example, following processing of a batch of coins, the user may be prompted to confirm that the transaction is complete or to confirm that additional coins are to be included with the previously input batch. A card reader is also advantageously, but optionally, provided to enable the self-service coin exchange machine 10 to read data borne by a magnetic strip of a patron's credit card, bank card, ATM card, debit card, or retail card (such as Target, or Jewel, etc.), and/or to read data borne by a card based data storage medium (e.g., optical card, smart card, etc.).

As noted above, the self-service coin exchange machine 10 includes a coin processing module 100, which comprises a coin input area 114 configured to receive a batch of coins of a single denomination or mixed denominations from a user for processing such as sorting, discriminating, and/or counting. Once processed, the value of the batch of coins may be determined and the value converted to another medium, as described herein.

The coin processing module 100 may comprise, for example, those disclosed in U.S. Pat. Nos. 7,188,720 B2, 6,996,263 B2, 6,896,118 B2, 6,892,871 B2, 6,810,137 B2, 6,755,730 B2, 6,748,101 B1, 6,731,786 B2, 6,724,926 B2, 6,678,401 B2, 6,637,576 B1, 6,603,872 B2, 6,579,165 B2, 6,318,537 B1, 6,171,182 B1, 6,068,194, 6,039,645, 6,021,883, 5,997,395, 5,982,918, 5,943,655, 5,905,810, 5,743,373, 5,630,494, 5,564,974, and 5,542,880, each of which is assigned to the present assignee and each of which is incorporated herein by reference in its entirety. Alternatively, the coin processing module 110 may comprise a gravity rail sorter, such as that disclosed by Molbak in U.S. Pat. No. 6,976,570, which is incorporated herein by reference in its entirety, powered rail sorter, a multi-disc or disc-to-disc sorter, or other type of bulk coin processing mechanism or system. In accord with aspects of the present concepts such as that represented in FIG. 1, the coin processing module 100 is functionally associated with a currency dispensing module 110 and outputs thereto a signal relating to the total amount of the deposited valid coins. In general, in the disc-type systems disclosed above, the batch of coins input by a user into the coin input area 114, which may comprise a coin tray or coin receptacle area (e.g., a funnel) or other area adapted to receive input coins, is conveyed to a hopper, which deposits the coins into a central region of a rotating, resilient pad. As a disc bearing the resilient pad is rotated at a high speed by a stub shaft and electric motor (not shown), coins deposited on the resilient pad slide outwardly over the surface of the pad due to centrifugal force (i.e., they are subjected to sufficient centrifugal force to overcome their static friction with the upper surface of the resilient pad) and a stationary sorting head disposed adjacent and opposite to the resilient pad guides coins of specific denominations, via contours (e.g., walls, grooves, rails, etc.) formed therein, to designated exit stations, where they are each discharged through an exit slot specific to the denomination of the coin.

One or more coin sensors may be utilized, either within the stationary sorting head and/or outside of the stationary sorting head, to count and/or discriminate the coins. In other words, the coin processing module 100 optionally includes sensors configured to permit coin discrimination and the sorting out of any counterfeit coins, foreign coins, and/or non-desired denominations. Coin discrimination is disclosed, for example, in references including, but not limited to, U.S. Pat. Nos. 6,892,871, 6,755,730, 6,609,604, 6,171,182, 6,042,470, 5,865,673, and 4,543,969, each of which is hereby incorporated by reference in its entirety.

In the example of FIG. 1, the coin processing module 100 coin input area 114 is of a "gravity-feed" type that is generally funnel-shaped to direct coins to a coin processing area within the coin processing module. Alternatively, the coin input area 114 could utilize a pivoting coin tray such as, but not limited to, that shown in U.S. Pat. No. 4,964,495 or U.S. Pat. No. 6,976,570, which are each incorporated herein by reference in their entirety. Such pivoting coin trays permit movement of the tray from a first position, where the coin tray is substantially horizontal, to a second position, wherein the coin tray is inclined so as to cause the coins to slide downwardly under the force of gravity into the coin processing module 100. Alternatively, any other input device employing any alternative means of conveyance may be utilized in accord with the present concepts including, but not limited to a conveyance system (e.g., conveyor belt(s), a rotating disc, or a plurality of counter-rotating discs, etc.).

The self-service coin exchange machine 10 optionally includes a paper dispensing slot 16 and/or other dispensing slots or ports for providing a user with a receipt of a transaction performed at the self-service coin exchange machine. The self-service coin exchange machine 10 may give the user the option of receiving a printed receipt or may automatically provide a printed receipt. A receipt may advantageously be provided in accord with each of the aspects of the present concepts and embodiments described herein.

Further, one or more actuators or actuated devices may be utilized, either within the stationary sorting head and/or outside of the stationary sorting head, to control the movement of the coins within the coin processing module or outside of the coin processing module. For example, in some embodiments, coin counting sensors are disposed in each of the coin exit channels of the sorting head or are disposed just outside the periphery of the sorting head. As coins move past each counting sensor, the controller receives a signal from the counting sensor for the particular denomination of the passing coin and adds one to the counter for that particular denomination within the controller. The controller, in turn, maintains a counter for each coin denomination, monitors the output of coin discrimination sensor(s), and compares information received from the discrimination sensor to master information stored in a memory including information obtained from known genuine coins. If the received information does not favorably compare to master information stored in the memory, the controller sends a signal to the actuator(s) causing the segregation of the invalid coins from the valid coins.

Coins discharged from the coin processing module 100 are discharged into one or more coin receptacles such as, but not limited to, a coin bin, coin bag, coin cassette, rolled coin tube packages, etcetera. The coin receptacle(s) are configured to either receive a single denomination of coin (e.g., quarters only) or to receive any combination of mixed denominations of coins (e.g., quarters and dimes in a mixed bag).

The self-service coin exchange machine 10 is configurable to direct a specific denomination or denominations to various coin bag positions on the sorting machine depending upon the needs of the purchaser or lessor. For example, a purchaser or lessor in the vending field might only process nickels, dimes, and quarters. In this case, to fully utilize the bagging capacity of the machines, the purchaser or lessor could select nickels to be sent to coin bags #1 and #2, dimes to coin bag #3, and quarters to coin bags #4, #5, and #6. For an application in which a large volume of pennies could be expected, the purchaser or lessor could select pennies to be sent to coin bags #1, #2, #3 and #4 with all other coins being directed to coin bags #5 and #6. For a self-service application, since pennies and quarters make up roughly about 80% of the total volume of coins processed, one suitable machine configuration would direct pennies to coin bags #1, #2, #3 and #4 and quarters to bags #5 and #6, with other denominations (dimes and nickels) being directed to the remaining bag positions (e.g., coin bags #7 and #8) either mixed or unmixed. One problem with current fixed bag position sorting machines is that, once a bag (or bags) for a particular denomination is full, the machine stops, requiring the attendant to change out at least that coin bag. This could happen during a patron transaction, requiring immediate attention by an attendant. In accord with at least some aspects of the present concepts, the self-service coin exchange machine 10 comprises a programmable sorter configured to permit one bag position to be selected as an "overflow" that would accept coins from denominations that have reached their bag limit at their sorted bag position. With this configuration, coins of selected denominations would be directed to the "overflow" once their bag limit has been reached. The overflow bag would contain mixed denomination coins that would need to be sorted during a post sorting operation. This configuration would maximize the time between bag changes, allow patron transactions to finish without the need to stop the machine for a bag change, and minimize to the extent possible the need for post sorting operations. It is to be noted that a given self-service coin exchange machine 10 may include more or less coin bags than noted in the above examples, which are merely illustrative.

The self-service coin exchange machine 10 may also be programmed to maintain a history of transactions wherein the mix of coins and amounts of coins deposited in the machine is trended to, for example, permit estimation of the average, and $1\sigma$, $2\sigma$, and $3\sigma$ values of standard deviation for coin deposits, such that the self-service coin exchange machine 10 may estimate before a transaction is conducted whether or not the coin bags (or coin bin or other receptacle(s)) have sufficient capacity to accept another transaction. For example, to ensure that a patrons transaction will not be interrupted, a purchaser or lessor of the self-service coin exchange machine 10 may opt to instruct the self-service coin exchange machine to perform a requested transaction only if the coin bags have sufficient capacity to accept two, three, four, or five $3\sigma$ coin deposits (e.g., providing multiples of large historic coin transactions). So configured, the self-service coin exchange machine 10 would advantageously take itself out of service if the coin bags or other receptacles do not have sufficient capacity to safely accept coin deposits exceeding a predetermined threshold, preferably prominently displaying the out of service condition on the machine display and transmitting a signal (e.g., email, fax, text message, etc.) a recipient computer or electronic device designated by the purchaser, lessor, POS terminal, manufacturer, or designated third party informing such recipient of the self-service coin exchange machine 10 condition. Obviously, the predetermined threshold may be set lower (i.e., at any level desired) so as to provide greater forewarning and permit more flexibility in response prior to the self-service coin exchange machine 10 being placed in an operability compromised state.

The coin receptacles preferably, but not necessarily, include an RFID tag that may be passive, active, or semipassive, or other tracking device (e.g., electronic tracking device, GPS transmitter, bar code, etc.), singly or in combination, to enable tracking of these receptacles by armored carriers, stores or banks. Larger receptacles, such as bins, may advantageously include a GPS transmitter to independently transmit location information to a tracking databases and, optionally, a security monitoring service. The self service coin exchange machine 10 may advantageously be configured to write transaction related information, particularly a total value of processed coins input into the receptacle since insertion of the empty receptacle into the self-service coin exchange machine, directly to the integrated circuit of such an RFID. Thus, when an armored carrier arrives at the self-service coin exchange machine 10, the armored carrier would scan the RFID tag, bar code, or other identifying information or device for each receptacle using an appropriately configured scanning device and this information would be transmitted by the scanning device or an associated transmission device to one or more remote databases (e.g., a tracking system, an accounting system, etc.). Where the receptacle includes an RFID upon which the receptacle value information was written by a coin exchange machine 10 transmitter, using appropriate security protocols, the armored carrier central vault would be able to not only identify and track a physical location of the receptacle, but would also be able to automatically determine the value of coins in the receptacle. In the carrier central vault, employees can then balance specifically to each identified receptacle to ensure that each receptacle includes the correct amount. Later, when the receptacles are to be returned empty to the same self service coin exchange machine 10, or to another self service coin exchange machine, the receptacle is checked-in, such as by an RFID scan, or the like, as a bin leaves the central vault and/or possession of the armored carrier (i.e., insertion of the receptacle back into the machine at a self service coin exchange machine 10). In other aspects, value information may be coded onto a ticket dispensed by the self-service coin exchange machine 10 into the receptacle when the receptacle is full or upon an input command from an authorized user (e.g., an armored carrier employee).

In a presently preferred embodiment, the currency dispensing module 110 comprises a multi-cassette dispenser configured to dispense a plurality of denominations including $1 bills, $5 bills, $10 bills, and $20 bills, although a single-denomination dispenser, a single-cassette or a multi-cassette, could still be utilized in accord with the present concepts. Thus, the currency dispensing module 110 could comprise a single-cassette dispenser configured to dispense only $1 bills or only $5 bills, a multi-cassette dispenser configured to dispense $1 bills, $5 bills, and $10 bills, or any other type of configuration adapted to dispense one or more denominations of bills, in any combination, to a currency dispensing receptacle 125 for retrieval by the patron. The currency dispensing module 110 may comprise any OEM currency dispenser. Of course, although the examples herein relate to examples utilizing United States currency, the same concepts apply to currency of any country. For example, the currency dispensing module 110 may comprise one or more Fujitsu F53, F56, F400, or F510e multi-cassette media dispensers 127, or combinations thereof. The Fujitsu F53 and F56, for example, feature six cassettes 127 that can hold up to a total of 3,000 bills (500 bills/cassette) in a compact configuration. Using these or other currency dispensing modules 110, multiple cassettes 127 may be devoted to the bill cassettes that are most heavily utilized, so that the utilization factor for each cassette is generally equalized over time to minimize machine down time or unavailability. For example, in a six cassette 127 currency dispensing module 110, two cassettes could be loaded to dispense $1 bills, two cassettes loaded to dispense $5 bills, one cassette loaded to dispense $10 bills, and one cassette loaded to dispense $20 bills. In another example, a six cassette 127 currency dispensing module 110 could comprise three cassettes loaded to dispense $1 bills, one cassette loaded to dispense $5 bills, and two cassettes loaded to dispense $20 bills. Any number of currency dispensing modules 110 and/or cassettes 127 therein may be provided and the example of a single currency dispensing module comprising six currency cassettes 127 is by no means limiting (e.g., one, two, three, four cassettes or more, such as twelve cassettes, may be provided or multiple currency dispensing modules may be ganged together in association with a single coin processing module 100).

Thus, the self-service coin exchange machine may be adapted, via the selection of appropriate modules, to suit its intended purpose, application, or environment and historic or expected usage. Likewise, any currency or combination of currencies may be dispensed. Thus, for example, the currency dispensing module 110 may have, in one embodiment, only one single denomination currency dispenser having only $1 bills. In another example, a single self-service coin exchange machine 10 may comprise a first currency dispensing module 110*a* configured to dispense currency of a first currency type (e.g., U.S. Currency) and a second currency dispensing module 110*b* configured to dispense currency of a second currency type (e.g., Euro). In still another example, a single self-service coin exchange machine 10 may comprise a currency dispensing module 110 comprising a first set of cassettes 127 configured to dispense currency of a first currency type (e.g., U.S. Currency) and a second set of cassettes 127 configured to dispense currency of a second currency type (e.g., Euro). Likewise, a single self-service coin exchange machine 10 may comprise two currency dispensing modules 110*a*-100*b*, with a first currency dispensing module 110*a* comprising currency cassettes 127 or the like configured to dispense currency of a first currency type (e.g., U.S. Currency), a second currency dispensing module 110*b* comprising currency cassettes 127 or the like configured to dispense currency of a second currency type (e.g., Euro).

Coin redemption machines typically count coins and deposit them into a bulk coin containers or bags, or mechanically sort and count coins and deposit each coin into a designated container or bag for each denomination. Machines of these configuration types are typically country specific, configured for the country's coin set either mechanically or electronically. These machines are limited to accepting only coins for the particular country for which they are configured. To avoid a situation in which a patron using a coin redemption machine residing on the border between two countries, such as the Canadian/US border, would attempt to deposit both USA and Canadian coins in the machine, resulting in a high number of rejected coins of either USA or Canadian (depending upon the configuration of the machine), the coin processing module 100 in accord with at least some aspects of the present concepts is configured to accept coins from two (or more) countries simultaneously by incorporating multiple off sort exits for the stationary sorting head noted above. Specifically, one or more universal exit slots can be provided to accept any size coin and voice coils, reject pins, diverters, or the like are provided downstream of the universal exit slot to divert the discharged coin to an appropriate coin receptacle (e.g., a bin or bag adapted to received mixed currency of a single currency type, such as U.S. Currency). For example, A U.S. configured self-service coin exchange machine 10 is configured to count, off sort, and bag pennies in exit #1, nickels in exit #2, dimes in exit #3, Quarters in exit #4, Half Dollars in exit #5, and Dollars in exit #6. If this self-service coin exchange machine 10 was located in upstate New York on the Canadian border, the $7^{th}$ exit could be configured to count and off sort and receive all 6 Canadian denominations in the same bag. The patron would receive a transaction record reflecting the total value of the coins counted for both the U.S. coins and the Canadian coins. As another example, a self-service coin exchange machine 10 is configured to count and sort the 8 Euro denominations out 8 universal exits and into 8 corresponding bags using mechanical sorting such as, but not limited to, voice coin, pin, or other diverter(s), and to count and sort 8 UK denominations but to off-sort the 8 UK denominations to a single exit into a mixed denomination bag or container. The patron would receive a transaction record reflecting the total coin counted for both the Euro coins and the UK coins.

Machines with this functionality could advantageously be deployed in International Airports, hotels, rail stations, or currency exchanges, to permit patrons to exchange coins of one currency type, or even plural currency types, for cash in a desired currency type (e.g., Euro coins and UK coins exchanged for Euro notes, Euro coins exchanged for U.S. Dollars, etc.) since direct exchanges of coins to currency in these venues typically do not exist. For example, one or more self-service coin exchange machines 10, each comprising one or more currency dispensers 110, is/are disposed in the Frankfurt airport in Germany to pay out a specific country's currency in exchange for the coins deposited (from one or more different currency types). Thus, as a convenience to it's patrons as well as a potential profit center, the airport could provide the capability to patrons to quickly convert a value of a patron's coins from one currency (e.g., Euro) to notes/bills, coins, and/or other media as described herein in another currency (e.g., U.S. Currency) based on the prevailing exchange rate, minus any optional commission or transaction fee. Optionally, a self-service coin exchange machine 10 is disposed next to the exchange window of a currency exchange and is configured to accept and sort coins a local currency type (e.g., Euro) and optionally one or more additional currency type(s), with such one or more additional currency type(s) (e.g., UK coins and Turkish coins) being sorted out to respective mixed coin containers in the self-service coin exchange machine. A patron would deposit any combination of the coins accepted by the machine (e.g., Euro, UK, Turkish) and receive a transaction record indicating the value of each country's coin total counted. The patron would turn in or display the transaction record for the currency exchange to pay out the value in any country's currency selected by the patron. Still further, the self-service coin exchange machine 10 may be disposed in the currency exchange booth or office for use by employees, rather than patrons. The employee would deposit the patrons coins and receive the transaction record. The employee would then pay out the to value to the patron, minus any optional processing fees, in any country's currency selected by the patron.

Since the self-service coin exchange machine 10 can be user configured to accept, count, sort, and bag any country's coin set into any bag position on the machine, the coin redemption sorter design can be "universal". For example, a machine can be constructed with 16 bag positions and 10 universal exit slots. Four of the ten exits are equipped with dual bags to increase the capacity of the self-service coin exchange machine for a particular denomination or mixed coin configuration. A patron could sort the six standard U.S. coins in this self-service coin exchange machine, sending pennies in the first three positions, into 6 sorted bags, quarters to the next three exits into another 6 sorted bags, nickels to the $7^{th}$ exit into 2 sorted bags, dimes to the $8^{th}$ position into 2 sorted bags, half dollars and dollars to the $9^{th}$ position into 1 mixed bag, and the complete Canadian coin set to the $10^{th}$ position into one mixed bag. Virtually any combination of denomination and exit configuration, or country's coin set and exit configuration, can be owner/lessor-programmed or pre-programmed by the manufacturer. Accordingly, one self-service coin exchange machine model can service the needs of multiple countries or varying configurations or sorting and bagging, thus reducing manufacturing and inventory costs.

As noted above, a self-service coin exchange machine 10 in accord with at least some aspects of the present concepts could include a bill dispensing module to dispense currency bills, from one or more currency bill storage units (e.g., currency cassettes 127), in an amount relating to a total value of the deposited coins, or in the amount of the deposited coins less a fee. For example, a deposit of $67.53 in coins into such self-service coin exchange machine 10 results in currency bills dispensed to the patron in an amount corresponding to the total amount of coins minus a transaction fee that would round the exchange amount to the next nearest integer value in accord with predetermined rules, such as rounding up or down and/or ensuring that the exchange amount falls within a certain range of acceptable values based on the total amount of coins counted (e.g., net $62.00, $63.00, $64.00, $65.00, $66.00, or $67.00 in bills to the patron). Thus, a base percentage, such as 5% could be applied to the total amount of the deposited coins as a base fee (yielding $64.15) and the remainder of $0.15 truncated to result in $64.00 dispensed to the patron for a 5.2% transaction fee.

However, as described below, it is presently preferred, but by no means necessary, to associate with the self-service coin exchange machine 10 a loose coin or rolled coin dispensing module 111 adapted to provide exact change to a patron. In accord with at least some aspects of the present concepts, the currency dispensing module 110 includes one or more coin dispensing module(s) 111 configured to dispense rolled coins and/or loose coins. For example, the coin dispensing module 111 may comprises at least one Suzo Cube Hopper MK2# or Suzo Evolution Hopper, which are single denomination hoppers configured to discharge a single denomination. Thus, the coin dispensing module 111 may advantageously comprise a Suzo Cube Hopper MK2# for each denomination to be dispensed therefrom (e.g., one for pennies, one for dimes, one for nickels, one for quarters). In still other aspects, the coin dispensing module 111 comprises a rolled coin dispenser, such as that manufactured by Omron Transaction Systems, Inc., configured to dispense rolled coins ($10 roll of quarters, $5 half-roll of quarters, $5 roll of dimes, $2.50 half-roll of dimes, etc.).

To prevent misuse or confusion, the self-service coin exchange machine 10 is optionally configured to selectively enable the coin processing module 100 for operation only following appropriate inputs by a patron through the user interface. Following the enabling of the coin processing module 100, the patron is only then permitted to input coins into the coin processing module for processing. This control may be effected, for example, by selectively locking and unlocking, using an electromagnetic lock or latch, a hood 105 disposed to occlude the coin processing module 100 coin input region. In the example depicted in FIG. 1, the hood 105 may, accordingly, optionally be prevented from rotating upwardly until such time as a patron initiates a transaction at the self-service coin exchange machine 10 and indicates a desire to use the coin processing module 100.

Particularly where the currency dispensing module 110 is not configured to or is not able to dispense cash in smaller denominations (e.g., $1 or $5 bills) and is not configured to or is not able to dispense loose or rolled coins, the currency dispensing module is advantageously configured to provide a user with an option of receiving a portion of the total amount of the valid coins that is less than the smallest denomination dispensed by the currency dispensing module, herein designated as the remainder, in a form other than cash (or coin). Thus, for a patron input of $58.43 in coins into a self-service coin exchange machine 10 comprising a typical ATM as a currency dispensing module 110, such currency dispensing module only being configured to dispense $10 or $20 bills, the currency dispensing module may only output $50 in cash to the patron (e.g., 2-$20 bills and 1-$10 bill), leaving a remainder of $8.43.

To account for any remainder, large or small, the currency dispensing module 110 is advantageously, but not necessarily, configured to provide a patron with one or more options for exchange of the remainder. Options for exchange may be presented to the patron before the transaction or after the transaction. For example, even though the self-service coin exchange machine 10 may be configured to output the exact value of the processed coins back to the patron in bills and coins, via a bill dispensing module and coin dispending module of the currency dispensing module, a patron may desire to receive a portion of the exchange amount in another media, in another form, or at another location. Such options for exchange may naturally also apply to more than just the remainder and may be available to the entire value of the processed coins.

For example, where the self-service coin exchange machine 10 is connected to a network (e.g., an ATM network/ATM system backbone, a bank teller network, a store network, a point of sale (POS) network, a third party accounting system, etc.), as opposed to being provided in a stand-alone configuration, the self-service coin exchange machine 10 is adapted to permit the patron to deposit the remainder into a designated account (e.g., a bank account, a store account, etc.), such as by requesting that the patron input a code or insert a bank card, magnetic stripe card (e.g., stored-value card), or other account-information bearing media (e.g., smart card, biometric input, near field transmission from a portable electronic device, etc.). Once the required identification and routing information has been obtained by the self-service coin exchange machine 10, the self-service coin exchange machine prompts the user to designate which portion of the monies due the patron are to be transferred to the designated account(s) or, alternatively, to a card or a device specified by the patron. For example, the device could be networked and connected to a store's or bank's accounting system and the patron permitted to apply the remainder or the entire amount of the transaction, if desired, to the patron's account at the store or bank. As one example, a patron processes $100 in mixed coins at a networked self-service coin exchange machine 10 in a bank and selects, from a plurality of available options, for $50 cash back in currency and for deposit of the remainder of $50 (assuming no transaction imposed fees) in the patron's bank account. In another example, a patron processes $100 in mixed coins at a networked self-service coin exchange machine 10 at a store and selects, from a plurality of available options, for $50 cash back in currency and for deposit of the remainder of $50 (assuming no transaction imposed fees) in a pre-approved patron account at the store for a later use.

Owing to the networked arrangement, the self-service coin exchange machine 10 may, whatever the location, provide alternative forms of splitting the dispensed value between a variety of forms, in any combination, including, but not limited to, currency, loose coin, rolled coin, a coupon, a ticket, a voucher, a stored value card, a prepaid card, a smart card, an optical card, other value storing mediums, an electronic transfer to a patron account, an electronic transfer to a third party account (e.g., a creditor of the patron), an electronic transfer to a portable electronic device. For example, one option for transfer of all of or a portion of the total value due a patron (e.g., a remainder following disbursement to the patron of a portion of the total value in currency) includes electronic transmission (e.g., near field communication) of such desired amount to a patron's portable electronic storage device (e.g., a cellular phone, electronic purse, electronic wallet, electronic cash, fob, etc).

In at least some aspects, a stored value media dispensing module 120 is configured to dispense to the patron a stored value media such as, but not limited to, a magnetic stripe card (e.g., a value card, a pre-paid card, a store card, etc.), magnetic strip ticket, or a smart card bearing on the card's storage medium a value associated therewith by the patron including an entire value of the processed coins or a portion of the value of the processed coins. In at least some aspects, networked self-service coin exchange machines 10 dispense a stored value media only after registering and activating the stored value media with an issuing entity or approved third party. The stored value media is optionally encoded to be exchangeable only in the retail environment in which the self-service coin exchange machine 10 is disposed or associated (e.g., a Home Depot specific card if the self-service coin exchange machine is disposed in a Home Depot or is otherwise associated with Home Depot, a Jewel stored value card if the self-service coin exchange machine is disposed in a Jewel or is otherwise associated with Jewel, etc.).

In at least some configurations, the patron is advantageously permitted to select a stored value media from one of a plurality of different available types or associations of stored value media. To facilitate the use of a single, generic stored value media to which may be applied any number of separate associations with one or more stores or accounts, the network, in at least some aspects, includes banks of account numbers set aside for assignment to a stored value media. For example, in some aspects, a "blank" stored value media contains a unique identification number and the database tracks the stored value media by such identification number. A patron desiring to associate the stored value media to be dispensed to Store X, or even plural stores (e.g., Store X and Store Y), having made such selections through the self-service coin exchange machine 10 user interface, would be issued a stored value media having a unique identification number associated in the network to the store(s) designated by the patron. Thus, the individual stored value media need not necessarily have pre-stored or pre-formatted thereon specific account information or specific store names and such information may be written to and/or printed on such stored value media, if at all, upon issuance. Of course, the issued stored value media may be comprise pre-stored or pre-formatted thereon to concretely associate the stored value media to a specific store or issuing source (e.g., bank) and all account information needed to permit activation of the account by transfer of the account information to the store, issuing authority, or third party managing card issuance for such store or issuing authority.

Similarly, as to the dispensing of gift certificates or vouchers to be used at a specific store or bank or affiliated retailer, in at least some aspects of the present concepts, the unique identification number of the gift certificate or voucher is pre-associated with a zero value until such time as the gift certificate or voucher is activated within the self-service coin exchange machine 10 network or activated within the network or database of the store, issuing authority, or third party managing gift certificate or voucher issuance for such store or issuing authority. Upon activation of a gift certificate or voucher in a verified transaction, the value designated by the patron is stored by the self-service coin exchange machine 10 network or the network or database of the store, issuing authority, or managing third party in association with the unique identification number of the gift certificate or voucher. Following issuance, the patron may then be provided with the registration information and the opportunity to associate personal identifying information thereto so that, should the gift certificate or voucher be lost, the patron may, upon verification of the identifying information previously associated with the unique identification number of the gift certificate or voucher, obtain a replacement gift certificate or voucher if the unique identification number of the gift certificate or voucher may be cancelled prior to exchange thereof.

In still other aspects of the present concepts, in lieu of a stored value media dispensing module 120 that may be integrated with the self-service coin exchange machine 10, a stored value media kiosk may be provided separately thereto. In some aspects of the present concepts, the stored value media kiosk would be separate from the self-service coin exchange machine 10, but may be adjacent to the self service coin exchange machine. In such aspects, the stored value media kiosk is disposed in a location in a store other than the location in which the self-service coin exchange machine 10 is disposed. The stored value media kiosk comprises, in essence, a vending device configured to dispense one or more stored value cards, preferably a plurality of different stored value cards. For example, in one configuration, the stored value media kiosk is configured to dispense about thirty different stored value cards by different merchants. In such aspects, the self service coin exchange machine 10 would be able to transmit to the stored value media kiosk via a hardwired or wireless connection transaction related data that uniquely associates the value of transaction to the patron, such as through a patron ID number, a patron claim number, a transaction number.

The stored value media kiosk, in some aspects, is a stand alone kiosk configured to dispense a plurality of stored value cards or other items having a stored value thereon or having a value associated therewith. In one aspect, for example, a stored value media kiosk comprises a card dispenser configured to dispense any one or more of 30-40 different stored value cards having a value directly stored thereon or having information encoded therein associated with an account that is associated with a value. As one example of the use of a coin exchange machine 10 in combination with a separate stored value media kiosk, a patron processes all their coins and, based on the determined total value of the processed coins, receives a credit of $100.00. The self-service coin exchange machine 10 then issues a claim ticket with a unique ID number to the patron. The patron may then use this claim ticket, such as by scanning the claim ticket at the stored value media kiosk or inserting the claim ticket into the stored value media kiosk, to purchase a stored value card therefrom. Alternately, the patron might receive a value to a specified account (e.g., ATM card account, credit card account, etc.) or store card (such as Target or Jewel) which could be used towards the purchase of a value card from the kiosk. In another alternative, the patron could use an ATM card, credit card, biometric input (e.g., fingerprint, vein scan, etc.), or other personal electronic device to create a unique ID associating the patron to the value of the transaction. The association of the patron to the value of the transaction (e.g., the credit of $100.00 in the above example), whether through a unique ID generated by the self-service coin exchange machine 10 or by a unique ID generated responsive to an input or inputs by the patron, could be electronically transmitted to a network or to the stored value media kiosk, or encoded into or printed onto the claim ticket. The patron could then walk over to the stored value media kiosk and select the card or cards they wish to purchase and insert the claim ticket and/or provide other input of the unique ID generated in association with the patron's transaction.

In the above-described embodiment, the stored value media kiosk dispenses cards having a value stored thereon or stored in association therewith. Alternatively, the stored value media kiosk could dispense cards having no value stored thereon and/or having no value stored in association therewith. The patron could, at any time, approach a stored value media kiosk and select one or more stored value cards to be dispensed. A patron could then go to a store POS terminal and present the desired value card(s) together with the claim ticket or other item uniquely associated with the coin exchange transaction, whether a store card, ATM card, biometric input, or the like, in order to purchase the value cards at that time. If the patron presents a claim ticket, for example, the employee at the point of sale terminal or at the service desk, as applicable, would manually enter the PIN number or scan the PIN number. An authorized match would then appear on a POS display relative to the claim ticket number (or other item uniquely associated with the coin exchange transaction), and would display the total amount of the coin exchange transaction. Value cards and/or other merchandise could then be purchased for up to the total amount of credit available against the claim ticket or other item uniquely associated with the coin exchange transaction. For example, the employee at the point of sale terminal or service desk could swipe or scan the patron's store card (e.g., a "Safeway" card) to thereby enter the patron's patron number and then the appropriate credit available from the coin exchange transaction will be displayed on an associated POS or service desk display to enable the patron to purchase the stored value card(s). Alternatively, the employee at the point of sale terminal or service desk could swipe or scan the patron's ATM card or other card to thereby retrieve from a memory the patron's credit available from the coin exchange transaction and to display this information on an associated POS or service desk display to thereby enable the patron to purchase the stored value card(s).

In accord with various aspects of the present concepts, the coin processing module 100, the currency dispensing module 110, the stored value media dispensing module 120, or the document processing module 130 controls the processes described herein (e.g., the remaining ones of the aforementioned modules being a "slave" module thereto). Thus, in accord with other aspects of the present concepts, the currency dispensing module 110 controls the processes described herein and the coin processing module 100, the stored value media dispensing module 120, and the document processing module 130 are effectively slave modules to the currency dispensing module. In still other aspects, signals from any of the coin processing module 100, the currency dispensing module 110, stored value media dispensing module 120, and/or the document processing module 130 are transmitted to an external local or remote processor, such as a secure local network or wide area network, for processing.

Thus, the actual processing functions may be performed by any of the component parts of the self-service coin exchange machine 10 singly or in combination and/or may be performed elsewhere.

As one example of a configuration in accord with at least some aspects of the present concepts, the currency dispensing module 110 comprises an ATM. Thus, the self-service coin exchange machine 10 may comprise, in some aspects, a coin processing module 100 as a side car attachment to an existing ATM, which is used to perform as a currency dispensing module 110 and to provide the primary user interface for the transaction. In such configuration, the coin sorting module would become a slave of the ATM unit and the patron would use the ATM user interfaces (e.g., key pad, touch screen, keyboard, etc.) to conduct the coin processing transaction on the associated coin processing module 100.

Following completion of the coin processing of the coins using the coin processing module 100, the controller that controls the coin processing module, wherever resident, outputs a signal to the currency dispensing module 110 (e.g., an ATM in the present example) and/or other value output device, such as a stored value media dispensing module 120, relating to the total value of the processed coins to thereby cause the currency dispensing module to dispense at least a portion of an exchange amount in currency, such as bills or a combination of bills and loose coins or rolled coins. The output signal to the stored value media dispensing module 120, likewise, causes the association of a specified portion of the exchange amount to a designated stored value media, which is dispensed to a user or held by a user. For example, the dispensing of the stored value media comprises, in various aspects, the dispensing of a ticket, pre-paid card, or stored value card.

The association of the specified portion of the exchange amount likewise comprises associating the specified portion of the exchange amount to not only a stored value media issued by the self-service coin exchange machine 10, but alternatively to a stored value media inserted by the patron into the self-service coin exchange machine. The association of the specified portion of the exchange amount comprises, in some aspects, forming in a remote database an association between the stored value media and the specified portion of the exchange amount. The association of the specified portion of the exchange amount comprises, in other aspects, writing on the stored value media itself a value corresponding to specified portion of the exchange amount. In still other aspects, such association comprises transferring of the specified portion of the exchange amount to a local or personal electronic device (e.g., a cellular phone, electronic purse, electronic wallet, electronic cash, or the like) or a remote electronic device (e.g., a patron account). In one exemplary transaction in accord with at least one embodiment of the disclosed coin exchange machine 10, the patron introduces a mixed batch of coins into the coin processing module 100 and, seconds later, receives from the currency dispensing module 110 a corresponding amount of bills and loose change, optionally less a transaction fee. In other types of transactions, a patron may use the self-service coin exchange machine 10 user interface desire to input commands to split the value between cash dispensed by the currency dispensing module 110 and an electronic transfer to the patron's personal electronic device and/or to an account (e.g., bank account) designated by the patron.

Figure 2:
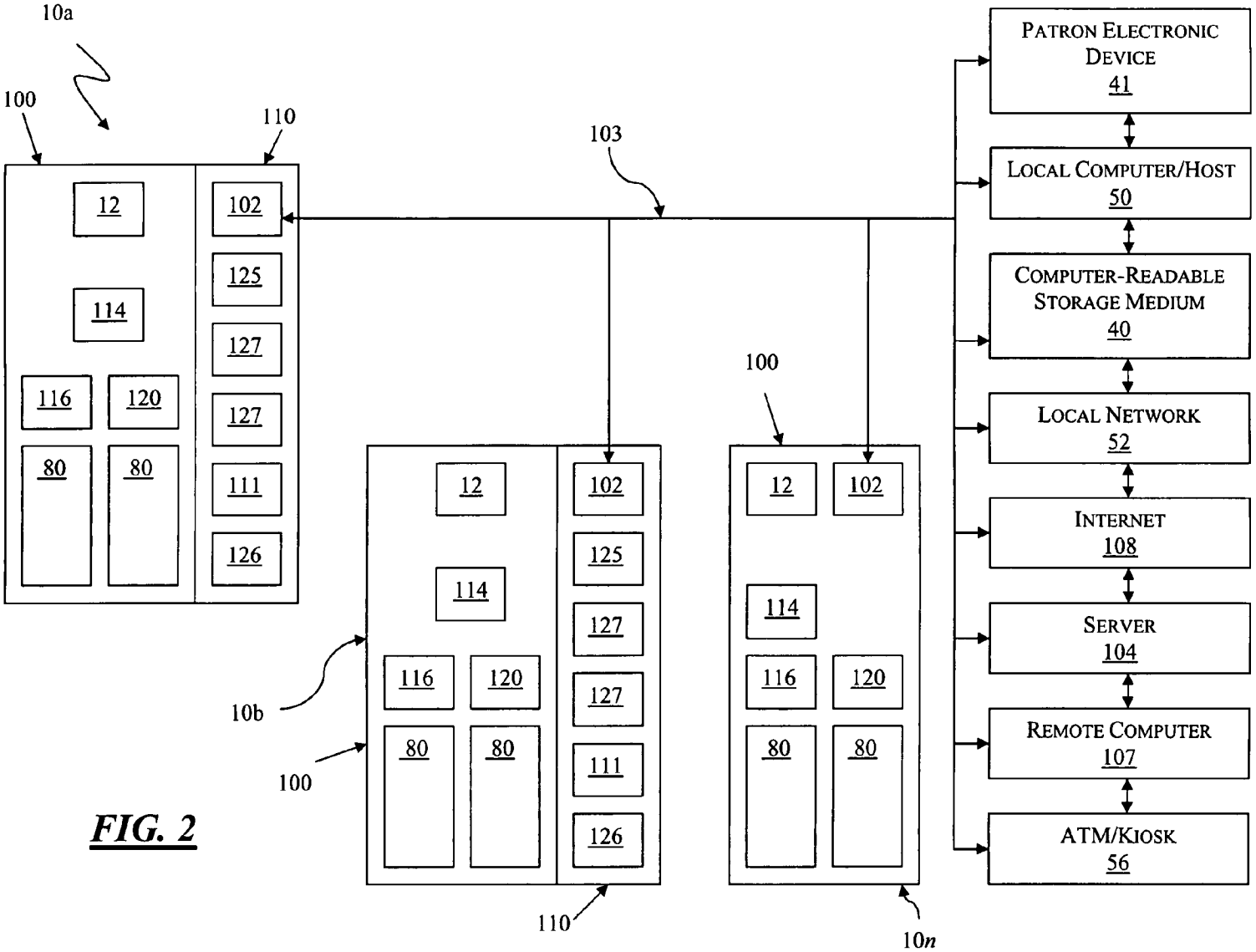
FIG. 2 schematically illustrates a plurality of self-service coin exchange machines in communication with a network or other local and remote devices in accord with at least some aspects of the present concepts.

FIG. 2, for example, shows a representation of a plurality of self-service coin exchange machines 10*a*, 10*b* . . . 10*n*, wherein n may be any number, communicatively coupled through a communication device 102 (e.g., a serial port, parallel port, USB port, ECP port, IEEE 1394 port, broadband device, Ethernet port, wireless device (e.g., Bluetooth, WLAN, IrDA, RF, IR, ZigBee, Wireless USB, and IEEE 802.11), modem, land line (POTS) cellular phone, and/or other communication device as appropriate to the type of communication needed) and associated communication pathway 103 to any one or more of a local computer/host system 50, a computer-readable storage medium 40 (e.g., a flash memory device, a hard drive, a solid-state memory device, a magnetic memory card, a magnetic disk, an optical disk, memory chip, memory card, USB flash drive, etc.), a patron electronic device (e.g., a PDA, a cellular phone, an electronic purse/wallet, smart card, etc.), a local network 52, the Internet 108, a server 104, a remote computer 107, and/or an ATM/kiosk 56. To facilitate different types of communication, the self-service coin exchange machines 10*a*, 10*b* . . . 10*n* advantageously include a plurality of different communication devices 102 such as any one or more of a serial port, parallel port, USB port, ECP port, IEEE 1394 port, broadband device, Ethernet port, wireless device, modem, land line (POTS) cellular phone, RF device, IR device, in any combination. As shown, the self-service coin exchange machine 10*n* does not include a currency dispensing module and instead comprises a stored value media dispensing module 120 and a communication device 102 configured to communicate via communication link 103 with any one or more of the nodes shown in FIG. 2.

Further, the plurality of self-service coin exchange machines 10*a*-10*n* may be linked directly to one or more other self-service coin exchange machines. As one example, a host system 50 communicates with each self-service coin exchange machine 10*a*-10 *n* for tracking the various transactions occurring therein. Additionally, the self-service coin exchange machines 10*a*-10*n* are advantageously configured to send signals to the host system 50 to communicate system information, such as, but not limited to, signals indicating that one or more coin receptacles 80 of the coin processing module 100 are full or past a predetermined limit, one or more cassettes 127 or denominations of the currency dispensing module 110 are empty or past a predetermined limit, one or more coin dispensing modules 111 are empty or past a predetermined limit, a stock of stored value media in the stored value media dispensing module 120 falls below a predetermined threshold, a trended characteristic of a self-service coin exchange machine component or system has exceeded a threshold operating condition, or a fault condition (e.g., a coin jam, dispenser error, etc.) has occurred.

The self-service coin exchange machine 10 disclosed herein is particularly beneficial in retail applications and in banking or financial institution applications and provide needed self-service direct exchange capability providing the patron with the capability of directly receiving an exchange amount without any intermediary. In retail applications, unlike conventional voucher dispensing machines which require an employee to validate the exchange transaction and introducing the potential for fraud, the patron is immediately provided with cash or cash and coin exchange and/or with a plurality of exchange options including, but not limited to, cash or cash and coin. In view of at least some aspects of the present disclosure, additional optional exchange options may include disbursements including other media or electronic transfers. In a like manner, introduction of the presently disclosed self-service coin processing machine 10 into banking or financial institutions provides relief to bank tellers that would otherwise be required to, for conventional voucher dispensing machines, independently validate coin processing transactions by assessing the validity of a submitted voucher.

The self-service coin exchange machine 10 advantageously but optionally comprises, in at least some aspects, a document accepting module 130 configured to accept documents including, for example, currency bills, tickets, checks, or other security paper or bearer paper. In different aspects, the document accepting module 130 is configured to accept such documents either one at a time or in bulk. Exemplary references disclosing currency and document discrimination or authentication include, but are not limited to, U.S. Pat. No. 3,280,974 (magnetic flux), U.S. Pat. No. 3,870,629 (patterns of grid lines), U.S. Pat. No. 5,151,607 (security thread), U.S. Pat. No. 4,617,458 (magnetizable material), U.S. Pat. No. 4,593,184 (magnetic fields), U.S. Pat. No. 4,356,473 (denomination scans); U.S. Pat. No. 4,381,447 (density), U.S. Pat. Nos. 4,490,846 or 4,992,860 (color), 4,255,651 (length and thickness), U.S. Pat. No. 4,179,685 (reflectance and transmission); U.S. Pat. No. 5,122,754 (watermark, security thread); U.S. Pat. No. 3,764,899 (thickness), U.S. Pat. No. 3,815,021 (dielectric properties), U.S. Pat. Nos. 5,704,491, 5,790,693, 5,960,103, 6,351,551, 6,724,927, 6,778,693, and 7,016,767, 7,149,336, 7,191,657, 7,197,173, 7,200,255, and 7,201,320, each of which is assigned to the present assignee and is hereby incorporated by reference in its entirety. Other features and characteristics of the currency media may also be used, without limitation, to perform a discrimination function appropriate to such media.

The document accepting module 130 may further be associated with an imaging module configured to image and/or scan the documents input into the document accepting module 130. When imaging bulk documents, the document accepting module 130 or other controller, wherever resident (local or remote), advantageously stores transaction information in association with each imaged document. The transaction information may comprise any transaction information including, but not limited to, machine, time, date, location, patron identifying information, total value of transaction, documents relating to transaction, etcetera. After or concurrent with imaging of the document(s), the images are preferably, but not necessarily, transmitted to a remote storage medium through a hardwired or wireless communication link, such as through a network connection. The imaged documents are optionally securely stored in the document accepting module 130 or related device, such as the currency dispensing module 110, coin processing module 110, or the like, wherever such memory devices are resident. In configurations wherein the self-service coin exchange machine 10 is disposed in a bank or a store, such bank or store could, for example, begin immediately processing the image (e.g., an imaged check) once the image was transferred to a designated software platform or person in the bank or store.

Document imaging also permits, for example, capture of the serial number of currency deposited. As noted above, where the self-service coin exchange machine 10 is networked, such information is advantageously transmitted to a remote database. The captured serial number is also advantageously associated with some form of patron identification, such as an inserted patron card bearing information containing identity-related information or information that can be used to later determine identity, such as an account number of an identified financial institution that may later be tied to an individual. This tagging of deposited currency to a particular patron identifier, or even a particular machine, location, and/or time, has the potential to assist in subsequent investigations involving, for example, theft or fraud. In configurations where no patron identification is required, patron information data may be externally associated, for example, with external devices such as remote cameras. Thus, currency serial numbers for a given transaction can be associated with a particular machine and time and may be stored in association with an image taken from a local (e.g., machine resident) or remote camera.

Thus, in accord with at least some aspects of the present concepts, one or more image scanners, bar code scanner(s), and/or other forms of scanner(s) can be optionally utilized in combination with the self-service coin exchange machine 10. The scanner(s) would be able to read, for example, store coupons or script issued by the stores or check MICR data. In one aspect, the scanner(s) would be able to accept coupons issued by Safeway towards the purchase of goods at the store and issue a universal coupon or stored value card providing a compilation of the coupon identification codes and amounts, thereby enabling the patron to present a single coupon or card for scanning at the point of sale for application to the purchase of like goods. In some aspects, a separate coupon account may be opened for the patron by the self-service coin exchange machine 10 or separately at a service desk or even on-line. The patron can then scan the coupons at a self-service coin exchange machine 10 or other designated location and the coupon information would be uploaded into the patron's coupon account. Whenever a coupon is set to expire, the coupon data may be automatically removed from the patron's coupon account. When a patron presents the coupon card at a POS terminal in conjunction with a transaction, any product codes corresponding to product codes listed in the patron's coupon account would automatically trigger the applicable discount to be applied to the patron's transaction balance and the data associated with that coupon would be voided from the patron's coupon account. It is to be noted that the patron coupon account and patron coupon card are concepts that may be utilized independently of any self-service coin exchange machine 10.

As noted above, the self-service coin exchange machine 10 may be advantageously equipped with a check scanning module. The patron would then be permitted to write a check for up to a certain predetermined amount, the predetermined amount possibly being a variable amount based on the patron's credit history, past history with the store, account balance in the store network, status, provision of reserve credit information against which potential disputes could be resolved, etc. This service might be provided only to pre-approved or participating patrons. In some aspects, the patron would begin by swiping or inserting their store card (e.g., Costco), bank card, credit card, or other card having unique identification characteristics to identify themselves. The patron could then present a check payable to the store (e.g., Costco) and the check would be scanned by the check scanning module and validated. The patron would then receive payment in a medium or mediums including, but not limited to, currency, coupons, script to be used at the store, stored value cards, and/or a store value card for use uniquely at the store in which the self-service coin exchange machine 10 is disposed or at participating merchants (e.g., Starbucks, McDonald's, etc.).

Although described above in relation to communicatively linked or linkable coin exchange machines 10 connected to or configured to be connectable with an external network, computer, controller, system, service, terminal, node, communication device, such as a cellular telephone or paging device, or other electronic device, such as a PDA or data storage device, coin exchange machines 10 in accord with the present concepts may also comprise stand-alone machines (e.g., a machine not connected to an external network, computer, controller, system, service, or communication device). Thus, a coin exchange machine 10 in accord with some aspects of the present concepts may simply accept coin in, and optionally bills or documents (e.g., bills, checks, etc.), and dispense to a patron an amount of bills, bills and coins, or other combination of media, in an amount related to the total amount of processed coins.

Transaction related data, in lieu of being transferred to a remote site, a site different from the one in which the self-service coin exchange machine 10 is situated or in addition to being transferred to a remote site, may be stored in a local memory device either disposed in the self-service coin exchange machine itself or in a local device communicatively coupled to the self-service coin exchange machine. The local memory device would accessible to authorized employees of the store, bank, or establishment within which the self-service coin exchange machine 10 is disposed.

In at least some aspects, the self-service coin exchange machine 10 communicates transaction data and/or servicing requirements or problems to local and/or remote persons or computers by way of, for example, text messaging, facsimile communication, electronic mail, and/or paging devices. Likewise, the currency dispensing module 110, stored value media dispensing module 120, and/or the document processing module 130, may utilize the communication interface of the self-service coin exchange machine 10 or may comprise a separate communication interface, the communication interface being configured to permit the currency dispensing module 110, stored value media dispensing module 120, and/or the document processing module 130 to communicate with other connected local and/or remote computers. For example, the currency dispensing module 110 could communicate to a local and/or remote computer transaction data and/or servicing requirements or problems such as, but not limited to, a jam of a currency dispenser, low currency of a particular denomination, low currency of one or more denominations, low receipt paper, unlocking of access door to currency dispensing module, opening of access door to currency dispensing module, movement of or mispositioning of multi-cassette dispenser or single-denomination dispenser, abnormal current draw or voltage requirement of electrical component, abnormal range of movement of moving part, or component out of tolerance. Thus, the currency dispensing module 110 could comprise or utilize a communication device (hardwired or wireless) to transmit information from the currency dispensing module to a local and/or remote computer and/or person to convey to such local and/or remote computer and/or person a status of the currency dispensing module. Similarly, the stored value media dispensing module 120 and/or the document processing module 130 could comprise or utilize a communication device (hardwired or wireless) to transmit information from the stored value media dispensing module 120 and/or the document processing module 130 to a local and/or remote computer and/or person to convey to such local and/or remote computer and/or person a status of the stored value media dispensing module 120 and/or the document processing module 130, respectively.

Alternatively or in addition to the noted communication(s), lights on or above the self-service coin exchange machine 10, currency dispensing module 110, stored value media dispensing module 120, and/or the document processing module 130, messages on the corresponding display(s), and/or audible signals may be utilized to inform the authorized employees of the store, bank, or establishment within which the self-service coin exchange machine 10 is disposed of any servicing requirements or problems.

In a stand alone coin exchange machine 10 configuration, wherein the self-service coin exchange machine 10 is not electronically monitored, security features may yet be implemented to enhance security of the machine and discourage attempts at fraud. In one such optional aspect, each patron desiring to use the self-service coin exchange machine 10 must first be registered to use the machine.

Registration may be accomplished in any manner, such as by issuing the patron a store patron card (e.g., a "Jewel card"), a bank card (e.g., a debit or credit card), or a personal identification number (PIN). The self-service coin exchange machine 10 is, in some aspects, configured to recognize one or more of such types of cards or registration sources, such as a encrypted or non-encrypted information stored on or coded in such cards relating to the patron's identify and/or account number with the store or bank. Concurrent with each transaction performed at the self-service coin exchange machine 10, an electronic and/or printed audit trail would be generated and maintained for each transaction. Thus, if there was a dispute over the results of a transaction, if there were a suspicion of fraud, authorized employees of the store or bank could go back to the audit trail and relate the deposited coins to a specific patron or user. In alternative registration schemes, a patron lacking a pre-approved bank card or store card could go to a service desk in a store or a teller window of a bank, or the like, or even another kiosk, to register to use the stand alone coin exchange machine 10. Following registration, which would include entry of information including, but not limited to, a name, a valid address, a phone number, or the like, the patron would then be issued a card or device bearing such registration information.

The registration process would preferably, but not necessarily, include independent verification of the entered information, such as by a store employee or teller comparing the entered information to a government issued identification card (e.g., a driver's license). Alternately, the patron could be issued a unique encrypted card, ticket, or code by an employee, teller, or kiosk for use on the stand alone coin exchange machine 10 for an unlimited number of transactions, a predetermined number of transactions (i.e., one or more transactions), or until such card, ticket, or code is manually disabled by an employee, teller, or disabled in response to a disabling event (e.g., misuse of the card of coin exchange machine 10 by a patron). For example, a bank or store could disable a patron's card via a supervisor mode in the stand alone coin exchange machine 10. The supervisor use the display and/or other user interface(s) to locate the authorized card/ID listing and manually disable cards/IDs which were to be discontinued. After the specific patron cards/IDs were so disabled, the stand alone coin exchange machine 10 would no longer permit a patron entering such patron card/ID to utilize the self-service coin exchange machine.

In the stand alone configuration, remote verification of the data would not be possible in real-time. Therefore, the self-service coin exchange machine 10 would be limited to merely performing a check of the registration information to ensure that it met certain predefined parameters and such system could not independently verify that the patron presenting the registration information is, in fact, the person associated with the registration source.

Although the aforementioned self-service coin exchange machine 10 ably serves as a stand alone machine, the self-service coin exchange machine is, as noted above, also advantageously utilized on a network, such as a local area network (LAN), wide area network (WAN), Internetwork (i.e., interconnected networks use the Internet Protocol, such as a Intranet, Extranet, or Internet). Certain functions or transactions, such as those noted below, may also utilize near field communications and personal access networks (PANs). Further to the patron-centric benefits of electronic transmission of transaction data to a patron account, noted above, the networking of the self-service coin exchange machine 10 provides other attendant benefits to the owner, operator, or beneficiary of the self-service coin exchange machine. As one such benefit, networking permits real-time tracking of, and even authorization of, transactions executed or attempted to be executed on the self-service coin exchange machine. For example, a patron desiring to use the self-service coin exchange machine 10 could swipe their card for the store or bank through an associated card reader in the self-service coin exchange machine or could enter a pre-approved PIN or access number. The self-service coin exchange machine 10 then, prior to permitted the transaction to proceed, accesses the network to confirm that the data on the card, PIN, access code, registered biometric characteristic input, or the like, is for an active and authorized patron. The network would then provide authorization to the self-service coin exchange machine 10 to proceed with the transaction. Likewise, without authorization, the self-service coin exchange machine 10 would be unable to begin the transaction and would inform the patron of the problem or inform the patron that assistance was required.

As one example of a network to which the self-service coin exchange machine 10 could be connected, a large retail group such as Safeway may have their own proprietary network between all of their stores throughout the United States. If a patron has a Safeway Store card containing a patron account number, the retail group (or sub-portion thereof such as an individual store or regional entity) can utilize one or more self-service coin exchange machine(s) 10 in numerous promotional ways. For example, a patron might earn Safeway points each time they utilize the self-service coin exchange machine 10. The patron begins coin exchange transaction by swiping their Safeway card through a card reader or inserting their Safeway card in a card reader. The patron may then accumulate Safeway points, such as a fixed amount of points for each transaction or a variable amount of points related to a total value of the processed coins, such as a fixed point value per dollar deposited into the self-service coin exchange machine. For example, a deposit of $100 into the self-service coin exchange machine 10 could provide the patron with 100 points utilizable toward the purchase of goods, or discounts, at Safeway at a current or future date. In other words, the total benefit provided to the patron would exceed the $100 deposited. After the patron collects enough points the patron may be able to purchase a certain amount of goods and/or may receive certain discounts on goods or other incentives. Further, as one option, once a certain threshold of points or other tracking units has been achieved, further transactions at any of the networked coin exchange machines 10 may be waived. Similarly, in at least some aspects of the present concepts, if a patron is a store club member or otherwise possesses a preferred status at a store, the store may optionally elect to redeem the entire gross amount of the coins processed, opting to waive any transaction fee or commission for coin transactions performed by patrons who are store card members.

Networking of the self-service coin exchange machines 10 confers additional advantages to the patrons using the self-service coin exchange machines. For example, the network hosting the self-service coin exchange machines 10 may optionally include an account server(s) or service(s), or the like, that enables patrons to maintain an account in association with the network and/or store or chain to permit the patron to retain coin deposit balances in the self-service coin exchange machine network for redemption or withdrawal at a time of the patron's choosing. As noted above, the network need not be affiliated with a particular store or chain and may be run by a third party independent of the store in which the self-service coin exchange machine 10 is housed. In at least some aspects, a patron is uniquely associated with an account in the self-service coin exchange machine network, store network, or other associated network, such as by a store card (or other cards such as ATM card, etc.), biometric input, or other identifying information. For example, where the network is associated with a store, the store may allow the patron to retain balances for coin deposited at their patron account number within the store. Thus, in that example, a patron depositing coins having a redemption value of $100 at Safeway Store #1 in the morning could opt to credit the $100 redemption value into a coin exchange machine to the identified patron's store account for later use by the patron. Several days later, the patron is at the same Safeway store, or at another Safeway store or at another participating store or business and, at that time, presents their store card at the point of sale checkout counter, service desk, or redemption kiosk. The point of sale checkout counter may be staffed or self-service. At that time, the patron instructs the self-service point of sale terminal, or requests the store employee at the staffed point of sale terminal or service desk, to draw on the $100 credit associated with the patron's store account toward the purchase of merchandise. In another example, following processing of the coins at the self-service coin exchange machine 10, the patron is permitted to allocate a portion of the deposited coin value, minus any applicable optional transaction fee, for immediate disbursement in currency from the currency dispensing module 110 and a remainder of such deposited coin value is retained in the store account in association with the patron. Thus, in the above example, the patron depositing coins yielding a $100 redemption value could opt to receive $60 in cash at the time of the coin exchange transaction and leave the balance of $40 on their store account for later use.

Still further, a plurality of self-service coin exchange machines 10 may be linked together in a network independent of any participating store, bank, or business in which the self-service coin exchange machines may be disposed. Thus, hundreds or thousands of self-service coin exchange machines 10 may be disposed in dozens of different stores (e.g., Safeway, Costco, Target, etc.). The patron performing the transaction may opt to uniquely associated their deposited amount with a account number, such as by identification through a patron's card bearing unique identifying information, biometric input, or the like. Thus, a patron depositing coins yielding a $100 redemption value at Safeway Store #1 in the morning could opt to associate the $100 redemption value into a coin exchange machine to the patron, such as by inserting or swiping a card bearing information uniquely identifying the patron (e.g., a bank card, store card, etc.) or by inputting biometric data (e.g., finger scan), for later use by the patron. Several days later, the patron is at the same Safeway store, or at another Safeway store or at another store or business (e.g., Costco, Target, etc.) having a networked self-service coin exchange machine 10 and, at that time, presents their store card at the point of sale checkout counter, service desk, or redemption kiosk. The patron instructs the self-service point of sale terminal, or requests the store employee at the staffed point of sale terminal or service desk, to draw on the $100 credit associated with the patron's store account toward the purchase of merchandise. Likewise, the patron processing coins at a store's self-service coin exchange machine 10 may opt to receive a portion of the redemption value of their coins, less any applicable transaction fee, and reserve a portion of the redemption value in the account of the networked self-service coin exchange machines for later use. The patron in the above example having a $100 redemption value may then, for example, take $75 in cash at the time of the transaction and leave the balance of $25 on the account of the networked self-service coin exchange machines.

Another benefit to networking of the self-service coin exchange machine 10 is that the owner, operator, or beneficiary of the self-service coin exchange machine 10 may set limitations on transactions. For example, a store or a bank might automatically authorize pay outs of up to a predetermined pay out amount, such as $150, at any self-service coin exchange machine 10 location in the network, but might require any pay out greater than $150 to be attended to by a supervisor who would independently verify that the transaction is valid prior to approving a pay out larger than the predetermined amount. Although stand-alone coin exchange machines 10 may also be set to provide this same function, on an individual basis, the providing of the network enables the owner, operator, or beneficiary of the self-service coin exchange machine 10 to change this limit on a day-to-day basis, upon the occurrence of predetermined conditions, or at will. For example, an owner, operator, or beneficiary of the self-service coin exchange machine 10, such as a bank or financial institution, may vary the predetermined maximum unattended pay out amount upwardly and/or downwardly over time (e.g., from $150, to $200, back to $150), or may vary the predetermined pay out amount in accord with the time of the day (e.g., day vs. night) on a schedule, entirely at its discretion. As another example, the predetermined pay out amount could be tied directly to the patron. In other words, a patron having good balances at a bank or a patron having a good record of past transactions at a store and/or on the self-service coin exchange machine 10 may be allowed to deposit as much as $500 in coin and receive immediate pay out through the currency dispensing module 110, whereas a patron lacking a sufficient record of past transactions at a store and/or with the self-service coin exchange machine might be limited to a predetermined pay out amount of $100. The predetermined pay out amount could also be set to vary from one coin exchange machine 10 location to the next based upon demographics and security considerations.

As noted above, a plurality of self-service coin exchange machines 10 may be connected together in a network. The network may be managed by a company (e.g., Safeway) in whose stores the plurality of self-service coin exchange machines 10 are disposed or may be managed by a third party hired by the company or managed by a third party independent of such company. For example, such independent third party can lease the self-service coin exchange machines 10 to one or more companies and both manage the network of self-service coin exchange machines and perform service calls on the self-service coin exchange machines to fix the machines, maintain the machines, or to load and/or reload the machines.

The network encompassing a group of self-service coin exchange machines 10 may advantageously be accessible directly through POS terminals at participating retail locations. In other words, each of the participating retail locations would share the same network and would have access to the same account information on their shared network. The POS terminals would permit such participating retail locations to directly access identified patron's accounts on the network and draw down against the value balance towards the purchase of merchandise or services at that participating retail location. The patron may be identified uniquely to an account in the shared network by, for example, a value card (magnetic stripe card, smart card, optical card, etc.) dispensed by, or coded by, a self-service coin exchange machine 10. The participating retail locations need not themselves even utilize self-service coin exchange machines 10, although they certainly could do so. Instead, the availability of the shared network to a plurality of participating retail locations benefits both the owner/lessor of the self-service coin exchange machines 10, by encouraging its use, and the participating retail locations, by providing still additional forms of currency transfer by which patrons can conduct business. A POS could, for example, have a payment key or touch key on a touch screen dedicated to a transaction conducted on the shared network wherein activation of the key prompts the cashier or employee to input the patron's unique identification or to have the patron input his or her unique identification (e.g., biometric input, card swipe, etc.). The POS sends this identifying information to query the shared network for a match and, should a match be found, the transaction is reconciled against the identified account. To illustrate one example, a self-service coin exchange machine 10 disposed in a Costco is associated with a shared network managed by some party or entity (e.g., Costco, a company leasing out self-service coin exchange machines, an agent of Costco, a third party, etc.) such network being accessible by participating merchants (e.g., Starbucks, McDonalds, Apple Music Store, Borders, Exxon, etc.). The value of the coin exchange transaction conducted at the self-service coin exchange machine 10 would be associated with or stored on a value card dispensed from a card dispenser of the self-service coin exchange machine 10. At a later time the patron would visit a participating merchant location (e.g., Starbucks) and, in association with a transaction at that participating merchant location, present their value card. The cashier would designate to the POS terminal, by appropriate input, that the transaction involved the shared network and then the patron's value card would be swiped through the POS terminal of the participating merchant location. The POS terminal would access the shared network and query the shared network to determine if the amount of credit available to the patron in the patron's account is sufficient to cover the amount of the transaction in question. If the amount of credit available to the patron in the patron's account is sufficient to cover the amount of the transaction in question, authorization for the transaction would be transmitted by the shared network to the participating merchant location and the patron's account would be debited by the amount of the transaction.

Regarding the dispensing of value cards from a self-service coin exchange machine 10 dispenser, certain third parties (e.g., Blackhawk Network, InComm, GiftClixx, etc.) established by Safeway Inc. in 2001) integrate merchant's value cards and offer a plurality of branded retail gift cards (e.g., Barnes & Noble, iTunes, Starbucks, American Express, MasterCard, Visa, etc.). The value card issuers pay a commission for the cards that are sold on their behalf. Therefore, the self-service coin exchange machine 10 may be advantageously integrated into the Blackhawk Network accounting system through a communication interface. Then, following processing of coins and/or cash deposited in the self-service coin exchange machine 10 and application of any applicable transaction fees to determine a value for the transaction, such value is transmitted to the Blackhawk Network accounting system, the value is associated with a value card selected by the patron, and the selected value card is dispensed to the patron. In another configuration, if the self-service coin exchange machine 10 is not configured to dispense value cards, the value of the transaction (or portion thereof designated by the patron) may be alternatively directed to a patron account accessible at a POS terminal or printed out in a restricted use ticket bearing a bar code encoded with data comprising the value that the patron desires to allocate to a value card. The patron would then retrieve a blank (no value)

branded value card from a Gift Card Mall™ or the like to take to a POS terminal in the retail location for activation. In connection with an activation of the branded value card at a POS terminal, the patron's account may be accessed by the cashier or employee, through appropriate input identifying the patron to the patron's account (e.g., magnetic card swipe, biometric input, etc.), and the amount to be applied to the branded value card transferred to the Blackhawk Network (or similar entity, as appropriate). Alternatively, where a restricted use ticket bearing a bar code encoded with value data is provided to the patron by the self-service coin exchange machine 10, the patron may present this restricted use ticket to the cashier or employee at a POS terminal in conjunction with the activation of the branded value card, at which time both the branded value card and the restricted use ticket are scanned and the value associated with the restricted use ticket is transmitted.

In another scenario, the patron is identified uniquely to an account in the shared network by, for example, a PIN number, a debit card, credit cards, store cards, biometric characteristic, etcetera. Before, during, or after the processing of the coins by the self-service coin exchange machine 10, the patron inputs a PIN number, a debit card, credit card, store card, biometric characteristic, or the like, with an instruction to allocate at least a portion of the total value of the processed coins to an account associated or to be associated with an account or to an existing account associated with the same identifying information. In this regard, a patron may have an existing account on the shared network, the account being associated to the patron by the patron's Costco Member Card or, more particularly, to the track 1 data thereon, the track 2 data thereon, some combination of the track 1 and track 2 data, or an encrypted version of the track 1 data and/or track 2 data. When the patron later presents his or her Costco Member Card at another location, such as a Starbucks, the cashier or employee at Starbucks can designate at the POS terminal that the transaction is to utilize the shared network. The scanned card data is then compared by the shared network to corresponding identifying information in the shared network to identify a match with an existing account and, should a match be found, reconcile the transaction against the identified account by debiting the account in the amount of the transaction and authorizing the transaction. Thus, as noted above, a plurality of participating merchants are able to go a central record and draw down against the value balance towards the purchase of merchandise or services at that location.

A company utilizing a plurality of self-service coin exchange machines 10 may also, of course, maintain a closed network accessible only within the company and/or to authorized users (e.g., LAN, WAN, intranet, extranet, etc.). For example, Costco can maintain a network for a legion of self-service coin exchange machines 10 and share data across all of their store locations throughout the entire network or across designated geographic areas. Further, the connected self-service coin exchange machines 10 can not only perform coin transactions or open or add value to a Costco patron's account, but can also perform other transactions and transmit appropriate data across the network. As above, a patron conducting a coin exchange transaction in which the patron desires that a portion of the total value of the processed coins would identify himself or herself to the self-service coin exchange machine 10, such as by inputting or swiping their Costco card, bank card, credit card, or driver's license (e.g., where provided with a magnetic strip), or by placing an electronic fob in proximity to a corresponding sensor, inputting a biometric input, or the like. At a later date, the patron enters the same store, or another store within the company network, and provides an identifying input to the self-service coin exchange machine 10, service desk, or point of sale terminal to thereby access the patron's account in the network and utilize those funds toward a transaction at the store. In another example, a week later the patron may enter the same store or a second store at another location, approach the self-service coin exchange machine 10, service desk, or point of sale terminal to thereby access the patron's account, and instruct the machine or employee, as appropriate, to pay out the balance or a portion of the balance, in cash. Thus, the patron is provided significant flexibility as to when they are able to withdraw their funds from their account.

In other aspects, a self-service coin exchange machine 10 is configurable to accept payment by patrons to utilities, governmental entity (e.g., tax authority, licensing authority, etc.), lenders (e.g., monthly payment for an auto loan, payment on a credit card balance, etc.), or identified third party (e.g., a wire transfer to an identified account anywhere in the world). The appropriate utilities, governmental entities, lenders, etc. would advantageously be networked to the self-service coin exchange machine in order to perform this function, but alternatively be accessible via a hardwired or wireless communication link. The payment may occur via a coin exchange transaction wherein a patron elects to effect such funds transfer (e.g., to pay a utility bill) by depositing coin and/or currency into the self-service coin exchange machine 10 and by identifying the appropriate account or patron ID. For example, where the self-service coin exchange machine 10 is configured to accept payments for a local electric utility, a touch key is provided on the touch screen display and the patron can select the option of payment to the local electric utility, at which point the patron would be prompted to enter, and preferably verify following entry, the utility ID number for the patron. The patron would preferably then be asked to confirm the particulars of the transaction and then proceed to authorize the transfer of funds. As one example, where a patron's utility bill is $90.00 and the patron's deposit is $100.00, the patron could allocate $90 toward the utility bill. Alternately, if the patron's deposit of coins totals only $50.00, the patron could deposit additional funds to cover the difference. The deposit of additional funds could be from a variety of sources including, but not limited to, a deposit of cash into a bill acceptor, a deposit of funds from a stored value card, insertion of a check into a scanning module, or the like. As discussed herein, deposited checks may be stored in a separate check cassette.

In still additional aspects of the present concepts, the self-service coin exchange machine 10 is configured to generate a money order for at least a portion of the amount of coin/currency deposited by the patron and to transmit information relating to the money order to a local computer and/or remote computer.

Further, as noted above, owing to the networked arrangement, the self-service coin exchange machine 10 may, whatever the location, provide alternative forms of splitting the dispensed value between a variety of forms including electronic transfers to a patron account and electronic transfers to a third party account (e.g., a creditor of the patron). Because the self-service coin exchange machine 10 is, in some aspects, connected to a network, patrons, particularly bank patrons, can utilize the self-service coin exchange machine 10 to pay bills. For example the patron may deposit $150 in coin and use this full balance to pay bills directly (payment to third party creditor) or indirectly (maintaining sufficient balance in bank account to cover automatic withdrawals from account from authorized third party creditor). Alternately, patrons may receive some portion of the deposited amount in cash and may use the remainder to pay a bill for a creditor, deposit money to an account (e.g., a store account, bank account, etc.), or to donate to an intended beneficiary such as, but not limited to, payment of a utility bill (e.g., electric, water, etc.), parking tickets, purchase of money order, payment on a bank loan, pay down a credit card balance, a municipal garbage bill, or such as a donation to a designated charity.

Where a donation to one or more charities is an option available to a patron, the sponsoring store may reduce the service fee or waive the service fee entirely when a donation is made to charity. Thus, the patron could split the value of exchanged coins between a deposit at a bank, a donation to charity, and currency return to the patron. The patron could also designate some of the value of the exchanged coins toward acquiring a stored value card or crediting a part of the value of the deposited coins to the patron's store account number.

In some networked coin exchange machine 10 configurations, the network may optionally be used to selectively enable the self-service coin exchange machine to work with only approved portable data storage devices (e.g., magnetic strip cards, smart card, fob, smart cards, cell phone, electronic wallet/purse, implanted/subdural microchip, etc.). Thus, patrons could take their cell phone to a designated place or person in the store or bank or other location and register their cell phone, or other portable data storage device, for use with the self-service coin exchange machine 10. Once the cell phone ID has been registered in the network, a receiver on the self-service coin exchange machine 10 would then be enabled to recognize that cell phone and correspondingly authorize transmission of value to that cell phone. Preferably, due to the prevalence of electronic devices, the self-service coin exchange machine 10 user interface would prominently prompt the patron to confirm the recipient location of the target electronic device. For example, the display could display the cell phone number of the device to which the value is to be transferred following a confirmatory input by the patron. In another example, a picture of the patron may be taken at the time that the portable data storage device is registered in the system and the patron's picture stored in association with the identified and registered portable data storage device. Thus, when the self-service coin exchange machine 10 user interface displays to the patron the target registered portable data storage device, the patron can see his or her picture next the identified device to provide additional assurance that the patron is transferring the value to his or her own data storage device. In still other aspects, the portable data storage device may itself be cross-referenced to a patron's checking account(s), saving account(s), or other databases or accounts, such as a patron's ID number at a store or store account.

Once the identity of and registration of the portable data storage device is confirmed by the self-service coin exchange machine 10, the patron can deposit transfer value thereto or, alternatively, select from any of the above-described options including, but not limited to, receiving some or all of the value of the processed coins back in cash, make payments on utility bills, transfer money to a checking or savings account, receiving a value-bearing card, receiving a card associated with a value, etcetera. For example, a patron having processed $100 in coins could input a request to the self-service coin exchange machine 10 to transmit the value of the coins received into a registered cell phone, electronic wallet, microchip, or other type of portable data storage device using any appropriate transmission medium (e.g., near field communication, carrier waves, etc.). Once the total value of the processed coins, or value relating thereto (e.g., the total value minus any transaction fee or other fee), has been dispensed to the patron or transferred to a designated destination, such as described above, the transaction is closed out and a receipt optionally issued.

Alternatively, in lieu of the above-noted registration of the patron's portable data storage device with a designated employee or at a designated location in the store, bank or other location in which the self-service coin exchange machine 10 is disposed, a stand-along embodiment of the self-service coin exchange machine may be optionally configured to independently perform registration of a patron's portable data storage device and store such information locally on a memory device associated with the self-service coin exchange machine. Thus, a patron may register a cell phone configured as an electronic wallet directly with the self-service coin exchange machine 10 following establishment of communication between the cell phone and the self-service coin exchange machine through a wireless or hard-wired communication path. Once registered, the patron could use the registered cell phone as a destination device for electronic transfer of funds processed by the self-service coin exchange machine.

In at least some aspects of the above concepts, a patron desiring to allocate funds to a registered portable data storage device may be required to indicate such desire to the self-service coin exchange machine 10 at a beginning of the transaction, such as prior to coin processing.

Still additional aspects of the present concepts, particularly for networked coin exchange machines 10, but applicable nonetheless to stand alone coin exchange machines, include options for setting transaction fees. Utilization of a network to set fees permits the owner or operator of a plurality of coin exchange machines 10 to set fees for a plurality of coin exchange machines at the same time and reduces the time and labor that would otherwise be required to individually load such settings at each coin exchange machine. In at least some aspects of fee arrangements in accord with at least some aspects of the present concepts, the bank, store, owner, operator, or other person or entity controlling the self-service coin exchange machine 10 settings may set transaction fees according to a patron type. For example, a "premium" or "preferred" bank or store patron might not be charged any fees for use of the device. A known bank or store patron lacking a "premium" or "preferred" status may be charged a reduced fee or a nominal flat fee, such as 2%-3%. An infrequent client or patron may be charged a higher fee of 5%-6%. An unknown patron may be charged a full fee of 8%-10%. With a network connection, the self-service coin exchange machine 10 is able to access available databases to make these decisions if the bank or store so chose to utilize this option. Without such a network connection, the self-service coin exchange machine 10 would be able to make such decisions only upon information resident in the self-service coin exchange machine memory or upon information provided to the self-service coin exchange machine by the patron such as by input of a patron card bearing indicia of a "preferred" status.

There are many ways that the self-service coin exchange machine 10 (or associated network system) could "recognize" a patron, many of which, but certainly not all, are particularly suited to a networked configuration. In one rudimentary approach whereby the self-service coin exchange machine 10 is enabled to recognize a patron, a patron is required to go to a service desk or a teller to obtain a randomly issued number in order to utilize a device. This randomly issued number would then be transmitted to the self-service coin exchange machine 10, via a network or directly via a wireless transmission from the service desk or teller, to enable the self-service coin exchange machine to process a transaction upon entry of such number in a user interface device. After receiving the randomly issued number, the patron would go to the self-service coin exchange machine 10 and enter the randomly issued number to enable the self-service coin exchange machine, which would then complete the transaction including payment and cash. In other aspects, the service desk or teller issues to a patron a personal PIN or user ID number, which is optionally associated with the patron's presented identification. Where patron identification is not required, the fee structure for use of the self-service coin exchange machine 10 may optionally be influenced by a patron's volunteering such identification for association with the personal PIN or user ID number, such as by reducing or eliminating a standard transaction fee. For example, a typical 9% fee may be reduced by 5%.

In other aspects, the self-service coin exchange machine 10 (or associated network system) could "recognize" a patron, through a patron's card or other identification (e.g., government issued identification). For example, the patron would have to swipe a credit card such as a VISA, or a store card, or bank card, or the like, to provide proof of identity. Utilizing know verification methods and systems, the credit card information stored on the magnetic strip (or other data storage medium) thereof may be decoded or decrypted and information borne thereby relayed to a database able to confirm the identity associated with the patron presenting such card or, alternatively, patron identification information stored directly on a data medium of the presented card itself is decoded or decrypted and passed to the self-service coin exchange machine 10 controller. Thus, in some aspects, a patron may swipe or enter a card bearing a patron's identity or being associated with a patron's identity before beginning a transaction. Following such entry of the identification information, the self-service coin exchange machine 10 would determine the status of the patron enable and/or assign a status to the patron (e.g., known (preferred), known, unknown, etc.) and conduct transactions (if at all) in view of such status.

In still other aspects, the patrons identification may comprise a cell phone ID number or a portable electronic device ID number. In such aspects, the self-service coin exchange machine 10 or network associated therewith would read or otherwise receive the cell phone ID number or a portable electronic device ID number and associated it to the patron ID and account numbers.

Yet other aspects of the present concepts envision the use of a camera (e.g., a CCD device) disposed on, in, or in the vicinity of the self-service coin exchange machine 10 to obtain an image of the patron. As described in U.S. patent application Ser. No. 11/726,828, entitled "System, Apparatus, And Methods For Currency Processing Control And Redemption" and being assigned to the present assignee, which is incorporated herein by reference in its entirety, the image of the patron would be matched to a stored image of authorized patrons in a database of such images of authorized patrons. A match of the patron's image would, if successfully matched with one of the stored images of authorized patrons, permit use of the self-service coin exchange machine 10.

Another way in which the self-service coin exchange machine 10 could "recognize" a patron, is through bio-identification or biometrics. Under this approach, a patron would pre-register at a designated location, such as a help desk in a store or a teller at a bank, by providing a biometric characteristic by which the patron may later be identified, such biometric characteristic comprising, for example, a fingerprint scan for one or more than one finger, a nail bed scan, an eye scan, a voice print for a selected utterance, or other biometric characteristic. Once the patron's biometric characteristic is registered, the patron may then utilize any coin exchange machine 10 located anywhere in network, such as at an location of a bank or store having multiple locations, or only at a single designated location, depending on the parameters set by the store or bank. Thus, the patron's biometric characteristic registration serves as a pre-condition to use of the self-service coin exchange machine 10.

In certain aspects, the preconditioning of the use of the self-service coin exchange machine 10 on the patron's biometric characteristic registration may, instead, merely precondition the fee structure to be imposed on the transaction. For example, a patron engaging in a transaction on the self-service coin exchange machine 10 would not be charged a fee if the patron uses his or her biometric characteristic to enable the transaction, whereas a patron not using a biometric characteristic to identify himself or herself to the self-service coin exchange machine 10 is charged a transaction fee (e.g., a 5%-10% fee). Such a transaction fee may optionally be offset or eliminated by various other incentives for use or other fee-reducing potentials (e.g., "preferred" card, etc.) available to the patron.

In at least some aspects, the self-service coin exchange machine 10 is itself outfitted with the necessary biometric characteristic reading hardware, software, and/or firmware necessary to appropriately instruct a patron in how to ensure a proper reading of the biometric characteristic, to read and process the biometric characteristic, and to store the biometric characteristic locally and/or remotely.

Various aspects of fee arrangements encompassed by any of the disclosed concepts include, but are not limited to, tracking of the personal PIN or user ID number (or biometric characteristic or any other tracking device) and varying the fee charged for transactions based upon patron-specific information. For example, such tracking may include the tracking of and the frequency and/or total value of the transactions associated with that particular personal PIN or user ID number are stored locally (e.g., a stand alone coin exchange machine) or remotely (i.e., a networked coin exchange machine 10). As the patron's transaction frequency and/or total value increase over time, the transaction fee charged to that patron optionally decreases. Thus, in one example, for each $200 of coins processed in association with a patron number, the standard transaction fee is reduced by 1%, which reduction may stop at a predetermined point or may be permitted to eventually be reduced to zero. The reduction may also be graduated, rather than constant. For example, the first $100 of coins processed may produce an initial 1% drop in transaction fee for subsequent transactions, but to move to the next level and drop the transaction fee an additional 1% would require the processing of an additional $200 and still another reduction in the transaction fee by 1% would require the processing of an additional $250, or the like.

Networking of the self-service coin exchange machine 10 in the manner disclosed confers still additional advantages. In some aspects, larger stores and banks may easily network hundreds of coin exchange machines 10 together throughout a plurality of branch or store locations over the country and the transaction data for each machine, for selected groupings of machines, or for the entire population of machines may be tracked in real-time or trended. The self-service coin exchange machines 10 are managed over the network in groups, or even individually. For example, a first group of coin exchange machines 10, however such groups are defined by the owner or operator of the self-service coin exchange machines, are configured with one or more similar or dissimilar features, operating parameters, software, or the like, so as to be at least substantially the same (e.g., a first set of fees, a first set of restrictions on use, a first set of advertisements and/or attract screens, etc.). Likewise, a second group of coin exchange machines 10 are configured with a second set of fees, a second set of restrictions on use, a second set of advertisements and/or attract screens, etcetera. Similarly, even across the first and second group, an individual patron having a known or preferred status within the self-service coin exchange machine 10 network is permitted, by virtue of registration and patronage, to bypass the standard first or second configuration of the self-service coin exchange machine 10, to benefit from a third configuration that is commonly available to each of the self-service coin exchange machines in both the first group and the second group.

The networking of the self-service coin exchange machines 10 would still further permit remote management of widely dispersed coin exchange machines. Such remote management features may include, but are not limited to, machine parameter monitoring (e.g., trending) and service minder monitoring. Management software allows for local monitoring of one or more coin exchange machines 10 via a network (e.g., LAN or WAN) through a networked computer or through a web browser. For example, an Intranet may be provided wherein access is provided to a central computer or manager enabled terminal through a network gateway with a firewall, with appropriate provisions for user authentication and virtual private network (VPN) connectivity for off-site employees to access coin exchange machine information. In some aspects, the management software facilitates the creation of management reports from data obtained from one or more of the self-service coin exchange machines 10. A user of the management software may thus query directly the database of a coin exchange machine 10 via the management software for real-time management reports that reflect the machine's totals from the current day, specifics for an identified transaction, information for specified ranges of transaction numbers, statistics for a specified time period, maintenance or performance related data, or the like. Alternatively, such user of the management software may so query a network database containing data from one or more coin exchange machines. Additionally, the management software supports, further to information gathering, remote configuration of one or more of the self-service coin exchange machines 10, either over a network or directly through an internet connection.

Any component and/or system of the coin processing module which is amenable to monitoring (e.g., monitoring a voltage, current, position, pressure, temperature, response, and/or changes thereof over time) may be monitored and the monitored data transmitted to a local computer and/or a remote computer through a communication device employing a wireless or hardwired communication pathway and/or stored in a storage device such as a floppy disk, a flexible disk, hard disk, magnetic tape, any other magnetic medium, a CD-RW, DVD, optical medium, a RAM, and EPROM, a FLASH-EPROM, any other memory chip or cartridge. The storage device may include any conventional non-volatile media (e.g., optical or magnetic disks), volatile media (e.g. dynamic memory). The monitored data may also be transmitted from the self-service coin exchange machine 10 via a transmission media including, but not limited to, coaxial cables, copper wire and fiber optics, or carrier waves, such as acoustic or light waves generated during radio frequency (RF) or near field communication and infrared (IR) data communications. The transmission media may be thus be utilized not only to output data from the self-service coin exchange machine 10, but may be utilized for local or off-site communication to the self-service coin exchange machine 10. For example, the controller instruction set may be updated through the transmission media communications interface (e.g., I/O port, modem, LAN card, WAN card, 10b-t connector, etc.). As another example, certain coin processing module variables and set-points may be configured to be changed remotely.

The monitored data may be stored in a data storage medium (not shown) resident in or near the self-service coin exchange machine 10, or may be transmitted off-site to a remote location, such as the manufacturer of the self-service coin exchange machine or designated representative. The transmissions may be substantially continuous, intermittent, or on a schedule (e.g., daily or weekly transmission at a designated interval). The monitored data transmitted by the self-service coin exchange machine 10 controller may then be analyzed by designated personnel and/or diagnostic applications. The data may be processed to yield statistical data useful in trending analyses and may be used, for example, to predict failures before they happen or to trend non-obvious degradation in performance so that appropriate corrective actions can be taken prior to such predicted failure. As one example of non-obvious degradation, the monitored data may indicate a high level of discrimination counts in the self-service coin exchange machine 10, even though the transaction was ultimately successful.

In accord with some aspects of remote management, an owner or operator of the self-service coin exchange machine 10 is provided access to a server, either a patron-specific server or a network server accessible by patrons of the manufacturer or service provider, and all coin exchange machines maintained by the patron may call into the server, or be polled thereby, via the transmission media communications interface. Once the link has been established between the self-service coin exchange machine 10 and the server, or the like, the controller and resident memory of the self-service coin exchange machine may be updated (e.g., software updates, set-point updates) and monitored data and coin processing data (e.g., totals, counts, non-counts, etc.) uploaded/downloaded. The remote processing significantly provides the ability to perform unattended software updates. Such activities are advantageously performed during the night when the use of the coin processing modules is typically minimal.

The management software is, in some aspects, programmed so as to allow the management software to be accessed and utilized via a standard web browser. As such, according to some embodiments, the management software is designed to be utilized by a user using a browser, such as Microsoft's Internet Explorer browser. The server may include an Active Server Page (ASP) providing device independent functionality. Utilizing a standard browser, a user, having the appropriate privileges, can direct the browser to either the server's ASP or the coin processing module's ASP, which processes a user request, accesses one or more of the coin processing module's databases, and formats and presents the content to the user via the user's web browser. The ASP uses input received as the result of the user's request to access data from the self-service coin exchange machine's 10 databases and then builds or customizes the page on-the-fly before sending it to the user in a form that can be presented by the user's web browser. In this manner, the ASP is able to provide both the proper data and operational controls to the user in a device transparent mode.

Thus, the controller can transfer a portion of the contents of the local memory to the server for storage in a database associated therewith. In addition, diagnostics or management software located on the server may prompt the controller for specific information or may cause the controller to run a specific routine. In at least some aspects, the data transmitted by the self-service coin exchange machines 10 are transmitted and stored utilizing a proprietary encryption/decryption scheme. The management software may provide, for example, the ability to monitor the self-service coin exchange machine 10 current operational status, query system reports, allow for asynchronous system fault reporting, enable and disable the various transaction types supported by the self-service coin exchange machine, and perform maintenance from an external device, such as a remote or local computer.

The networking of the self-service coin exchange machine 10 therefore enables an owner or operator, such as a store or bank, to automatically update their accounting system and patron accounts on a real-time basis, if desired. Alternately, the network might call or poll the self-service coin exchange machine 10 periodically throughout the day (e.g., once or twice a day, every hour, etc.), or vice versa, to obtain all transaction data since the last time the self-service coin exchange machine was polled, or the data transmitted, and update records accordingly.

In at least some aspects of the present concepts, the self-service coin exchange machine 10 may be alternatively configured to dispense only tickets, rather than cash or cash and coin. Such a configuration would be particularly suited for casino or arcade applications, transportation applications, or at schools or universities. As discussed above, the self-service coin exchange machine 10 would accept input coins and optionally other value inputs and, in the presently described configuration, the self-service coin exchange machine would then dispense to the patron a restricted-use ticket. The restricted-use ticket bears a data storage medium, such as a magnetic strip, bar code or equivalent, or the like, singly or in combination, and preferably securely encrypted or encoded, by which the value associated with the restricted-use ticket may be identified and exchanged. In some aspects, the restricted-use ticket may bear a plurality of bar codes and/or magnetic strips, each of the bar codes and/or magnetic strips each bearing a different encryption and/or coding to further ensure the security of the restricted-use ticket. Approved exchange locations (e.g., slot machine) would, correspondingly, be configured with software necessary to decrypt and read the underlying information on the restricted-use ticket or would be networked with a central server or service configured with software necessary to decrypt and read the underlying information on the restricted-use ticket. The bar codes and/or magnetic strips discussed above may include the same information, so that the data borne thereby may be compared directly to one another upon decryption or decoding, or may include different information, which is assimilated at the exchange location (e.g., at a slot machine).

While security protections (e.g., encryption) resident on the restricted-use tickets may be sufficient to largely or entirely eliminate fraud of the restricted-use tickets, additional security may optionally be provided by transmitting data relating to each ticket issued (e.g., amount, code number(s), encryption protocol(s), key(s), restrictions, etc.) from the self-service coin exchange machine 10 to a central location. Not only would this configuration provide for tracking of tickets and alternative means for validation at the exchange location (e.g., a slot machine), but this would also permit use of rotating encryption techniques. In other words, a coin exchange machine 10 may be configured to generate tickets using any random or pre-determined combination of a plurality of available encryption or coding techniques (e.g., selected from a group of 10, 20, etc.).

The restricted-use ticket also preferably bears a visual indication of value as well as exchange information or instructions for the restricted-use ticket and also preferably includes security features (e.g., watermarks, thermochromic ink, pressure sensitive ink, holograms, etc.) to discourage and prevent counterfeiting.

The restricted-use ticket would bear a value relating to a total value of the processed coins, plus any optional additional input value, but would be limited exchange limited in scope. The patron could only exchange the ticket for the value associated therewith at specified locations. In a casino environment, the ticket may be valid only for use with approved slot machines, wagering games, third party vendors within the casino, or services offered by the casino or third party vendors therein. In an arcade application, the ticket may be valid only on games in the arcade. In a university environment, the ticket may be valid only for use for payment of university fees or for payment to approved vendors (e.g., bookstore, dining hall, on-campus fast food vendors, etc.). Alternatively, the restricted-use ticket could be exchanged in any entity affiliated with the issuing location, such as sister casinos in the example of a casino ticket. Therefore, the self-service coin exchange machine 10 comprises, in some aspects, a machine that just accepts bulk coins and issues a restricted use exchangeable ticket, as noted above. Alternately, the self-service coin exchange machine 10 is, in other aspects, a machine that accepts coin and currency, either one note at a time or in bulk, and issues a restricted use exchangeable ticket. In still further aspects of the present concepts, the self-service coin exchange machine 10 is configured to accept bulk coin and, optionally, currency, and to dispense any combination of coin, currency, and restricted use exchangeable ticket.

In any of the above described aspects of the present concepts, the coin processing machine 10 is optionally configurable to issue a receipt, either automatically or upon the request of a patron. Further, in lieu of a printed receipt, the coin processing machine 10 in any of the above described aspects may be configured to provide an electronic receipt and email the receipt to the patron or electronically transfer the receipt or like information relating to the transaction to a portable electronic device.

The aforementioned concepts provide various aspects wherein a patron is able to input a batch of loose mixed or single denomination coins, of one or more currency types, and the self-service coin exchange machine is able to total the input coins and substantially immediately dispense to the customer bills, coins, and/or other stored value media having a combined value relating to the total. Alternatively, the patron may be presented by the self-service coin exchange machine with one or more prompts for a user input that would delay the dispensing of the bills, coins, and/or other stored value media such as, for example, where the patron desires a particular allocation of the funds due between different options.

Figure 3:
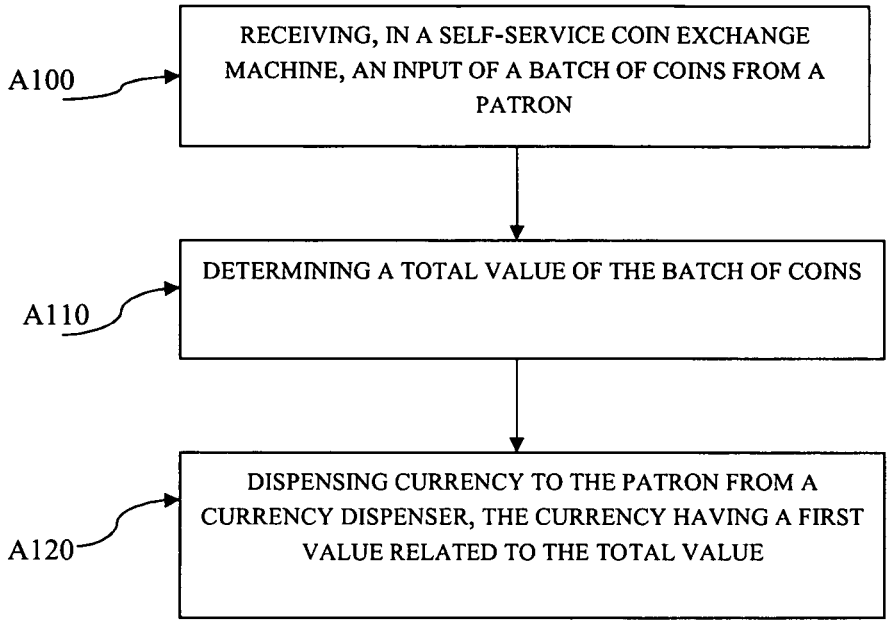
FIG. 3 shows aspects of one method in accord with at least some aspects of the present concepts.

In accord with various methods of the present concepts, FIG. 3 shows one method comprising the acts of receiving, in a self-service coin exchange machine, an input of a batch of coins from a patron (act A100), determining a total value of the batch of coins (act A110), and dispensing currency to the patron from a currency dispenser, the currency having a first value related to the total value (act A120).

Figure 4:
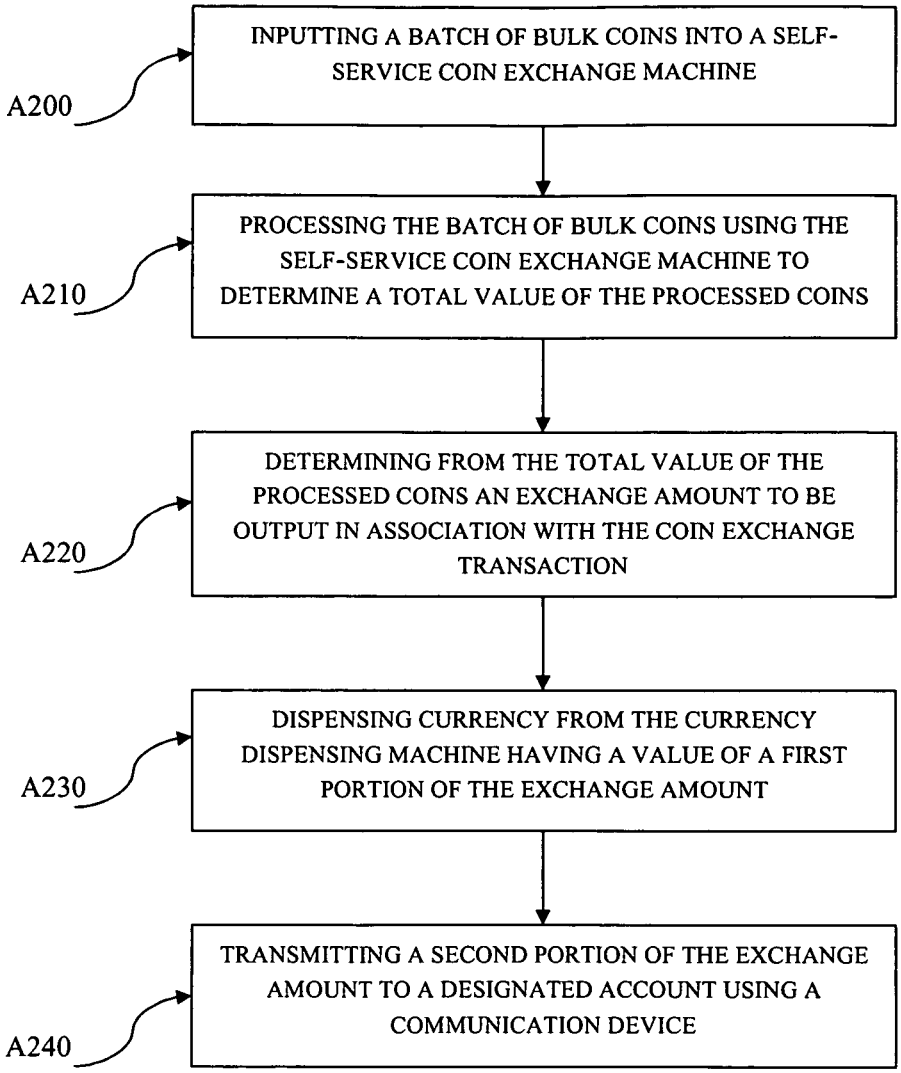
FIG. 4 shows aspects of one method in accord with at least some aspects of the present concepts.

FIG. 4 shows yet another method in accord with aspects of the present concepts, including the acts of inputting a batch of bulk coins into a self-service coin exchange machine 10 (act A200), processing the batch of bulk coins using the self-service coin exchange machine 10 to determine a total value of the processed coins (act A210), determining from the total value of the processed coins an exchange amount to be output in association with the coin exchange transaction (act A220), dispensing currency from the currency dispensing machine (e.g., currency dispensing module 110) having a value of a first portion of the exchange amount (act A230), and transmitting a second portion of the exchange amount to a designated account using a communication device (e.g., 102) (act A240).

Figure 5:
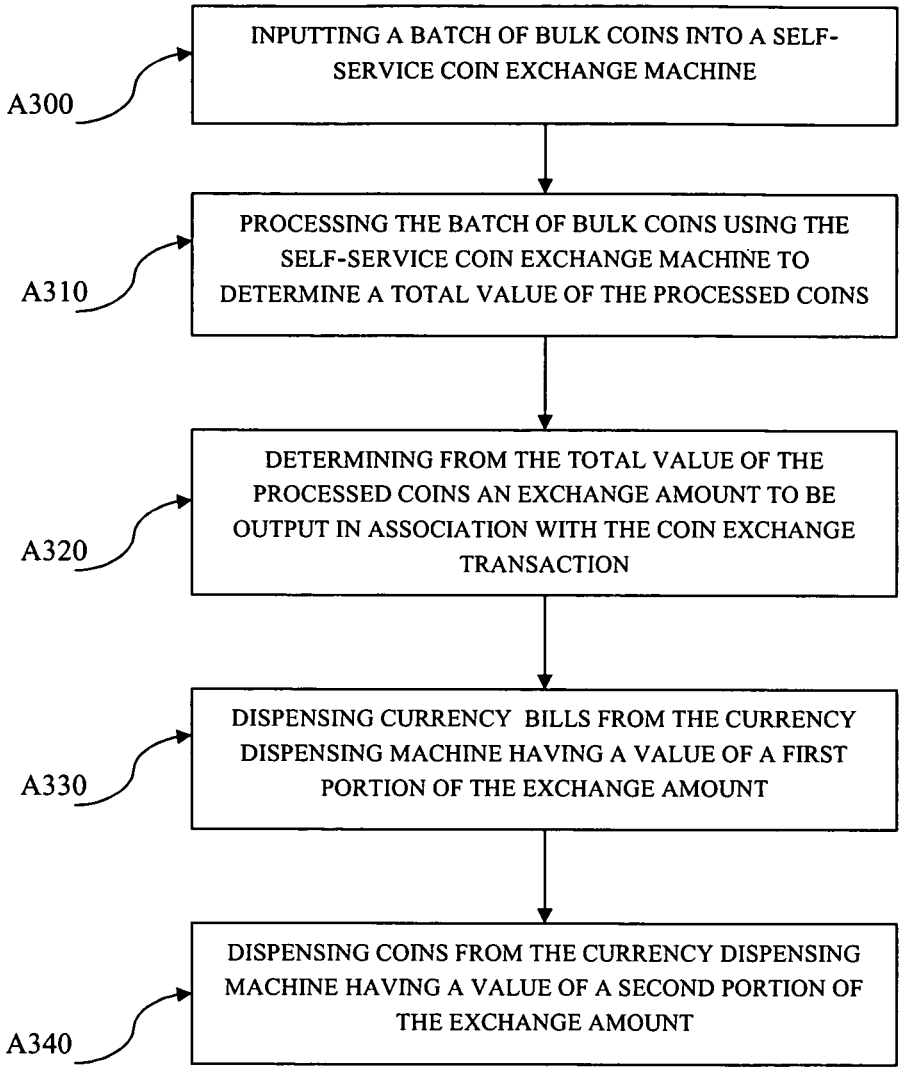
FIG. 5 shows aspects of one method in accord with at least some aspects of the present concepts.

FIG. 5 shows another method in accord with aspects of the present concepts, including the acts of inputting a batch of bulk coins into a self-service coin exchange machine 10 (act A300), processing the batch of bulk coins using the self-service coin exchange machine 10 to determine a total value of the processed coins (act A310), determining from the total value of the processed coins an exchange amount to be output in association with the coin exchange transaction (act A320), dispensing currency bills from the currency dispensing machine 110 having a value of a first portion of the exchange amount (act A330), and dispensing coins from the currency dispensing machine 110 (i.e., from a coin dispenser 111) having a value of a second portion of the exchange amount (act A340).

Figure 6:
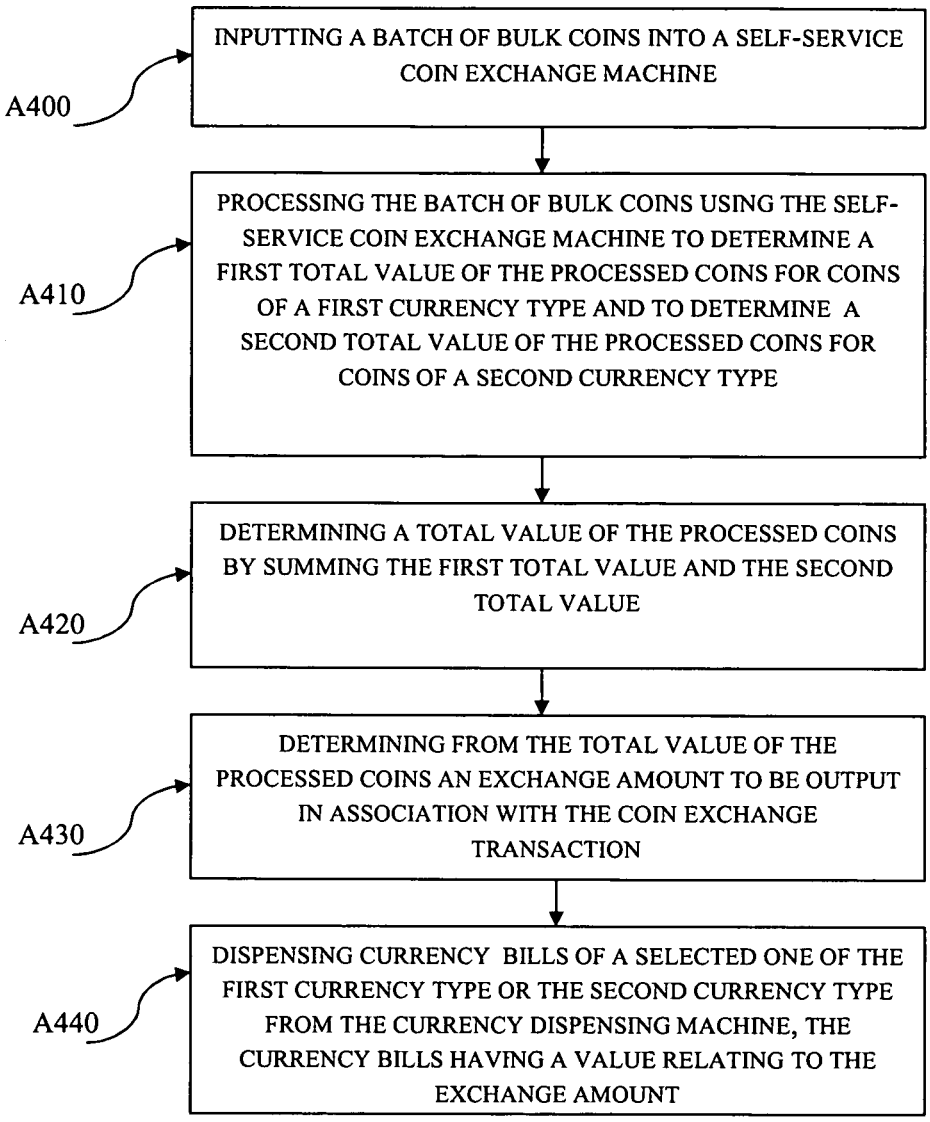
FIG. 6 shows aspects of one method in accord with at least some aspects of the present concepts.

FIG. 6 shows still another method in accord with aspects of the present concepts, including the acts of inputting a batch of bulk coins into a self-service coin exchange machine 10 (act A400), processing the batch of bulk coins using the self-service coin exchange machine 10 to determine a first total value of the processed coins for coins of a first currency type and to determine a second total value of the processed coins for coins of a second currency type (act A410), determining a total value of the processed coins by summing the first total value and the second total value (act A420), determining from the total value of the processed coins an exchange amount to be output in association with the coin exchange transaction (act A430), and dispensing currency bills of a selected one of the first currency type or the second currency type from the currency dispensing machine 110, the currency bills having a value relating to the exchange amount (act A440).

The foregoing disclosure has been presented for purposes of illustration and description. The foregoing description is not intended to limit the present concepts to the forms, features, configurations, modules, or applications described herein by way of example. Other non-enumerated configurations, combinations, and/or sub-combinations of such forms, features, configurations, modules, and/or applications are considered to lie within the scope of the disclosed concepts.

What is claimed is:

1. A method for exchanging coins, the method comprising:
- authorizing, using a controller, a user to conduct a coin exchange transaction at a self-service coin exchange machine;
- receiving in a bulk coin input area of a self-service coin exchange machine, subsequent to the act of authorizing, bulk coins comprising a plurality of coins of a first currency type;
- processing the plurality of coins to determine a total value of the plurality of coins; and
- responsive to the determination of the total value of the plurality of coins, substantially immediately dispensing bills of the first currency type from a currency dispensing module of the self-service coin exchange machine, the dispensed bills having an amount relating to the total value of the plurality of coins.

2. The method of claim 1, further comprising:
- assessing a fee for the coin exchange transaction;
- subtracting the fee from the total value to determine an amount due to the user.

3. The method of claim 1, further comprising:
- transmitting a portion of the total value to a designated account.

4. The method of claim 1, further comprising:
- dispensing coins in another amount relating to the total value from a coin dispensing module of the self-service coin exchange machine.

5. The method of claim 3, further comprising:
- accepting an input from a biometric characteristic reader associated with the self-service coin exchange machine.

6. The method of claim 1, wherein the act of authorizing comprises accepting a user input.

7. The method of claim 6, wherein user input comprises one of a biometric input, code, or identification.

8. The method of claim 1, wherein the act of authorizing comprises:
- requesting an access code to use the self-service coin exchange machine prior to the transaction;
- responsive to said act of requesting, transmitting an access code to the self-service coin exchange machine using a hardwired communication device or a wireless communication device to enable the self-service coin exchange machine to process a transaction associated with the access code;
- providing the access code to the user; and
- entering the access code by the user into an input device of the self-service coin exchange machine.

9. The method of claim 8, wherein the access code is a randomly generated code.

10. The method of claim 3, further comprising:
- accepting an input from a stored value media reader associated with the self-service coin exchange machine.

11. The method of claim 1, further comprising:
- maintaining, in a physical memory associated with the self-service coin exchange machine, a history of the coin numbers and denominations deposited in the self-service coin exchange machine per transaction;
- trending, using a controller, the mix of coins and amounts of coins deposited in the machine;
- estimating, using the controller, if the coin receptacles have sufficient capacity to accept a transaction; and
- disabling the self-service coin exchange machine if it is estimated by the controller that the coin receptacles do not have sufficient capacity to accept a transaction.

12. A method for exchanging coins at a stand-alone self-service coin exchange machine, the method comprising:
- receiving in a bulk coin input area of a stand-alone self-service coin exchange machine a plurality of coins of a first currency type;
- processing the plurality of coins to determine a total value of the plurality of coins; and
- substantially immediately dispensing bills of the first currency type from the currency dispensing module, the dispensed bills having a value relating to the total value.

13. The method for exchanging coins at a stand-alone self-service coin exchange machine according to claim 12, further comprising:
- substantially immediately dispensing coin from the coin dispensing module having a value relating to a difference between the total value and the value of the bills dispensed from the currency dispensing module.

14. A method for exchanging coins at a stand-alone self-service coin exchange machine, the method comprising:

receiving in a bulk coin input area of a stand-alone self-service coin exchange machine a plurality of coins of a first currency type input by a user;

processing the plurality of coins to determine a total value of the plurality of coins;

providing to the user of the stand-alone self-service coin exchange machine an option to, in exchange for the input plurality of coins, receive bills of the first currency type from a currency dispensing module of the stand-alone self-service coin exchange machine having a value relating to the total value or to receive a combination of bills and coins of the first currency type from the currency dispensing module of the stand-alone self-service coin exchange machine having a value relating to the total value; and providing to the user of the stand-alone self-service coin exchange machine an option to output a value relating to the total value in a form other than bills or coins, the value being in the form of the first currency type.

15. The method for exchanging coins at a stand-alone self-service coin exchange machine according to claim 14, wherein the option to output a value relating to the total value in a form other than bills or coins includes an option for transmitting at least a portion of the value relating to the total value to a user's personal electronic device.

16. The method for exchanging coins at a stand-alone self-service coin exchange machine according to claim 14, wherein the option to output a value relating to the total value in a form other than bills or coins includes an option for transmitting at least a portion of the value relating to the total value to a stored value card.

17. The method for exchanging coins at a stand-alone self-service coin exchange machine according to claim 14, wherein the option to output a value relating to the total value in a form other than bills or coins includes an option for transmitting at least a portion of the value relating to the total value to a user's electronic storage device, a user's magnetic storage device, a user's solid state storage device, or a user's optical storage device.

18. The method for exchanging coins at a stand-alone self-service coin exchange machine according to claim 14, wherein the option to output a value relating to the total value in a form other than bills or coins includes an option for transmitting at least a portion of the value relating to the total value to a user's magnetic storage device.

19. The method for exchanging coins at a stand-alone self-service coin exchange machine according to claim 14, wherein the option to output a value relating to the total value in a form other than bills or coins includes an option for transmitting at least a portion of the value relating to the total value to a user's solid state storage device.

20. The method for exchanging coins at a stand-alone self-service coin exchange machine according to claim 14, wherein the option to output a value relating to the total value in a form other than bills or coins includes an option for transmitting at least a portion of the value relating to the total value to a user's optical storage device.

21. A method for exchanging loose coins of a plurality of currency types at a self-service coin exchange machine, the method comprising:

receiving, in a bulk coin input area of the self-service coin exchange machine, bulk mixed loose coins of a plurality of currency types;

processing the plurality of coins to determine a number of and a denomination of a first plurality of coins of a first currency type and to determine a number of and a denomination of a second plurality of coins of a second currency type;

determining a value of the first plurality of coins of the first currency type;

determining a value of the second plurality of coins of the second currency type; determining a total value of the input loose coins; and dispensing bills of the first currency type from a currency dispensing module associated with the self-service coin exchange machine, the dispensed bills having a value relating to the total value.

22. The method for exchanging coins at a self-service coin exchange machine according to claim 21, wherein the value relating to the total value comprises the value of the first plurality of coins of the first currency type summed together with the value of the second plurality of coins of the second currency type.

23. The method for exchanging coins at a self-service coin exchange machine according to claim 21, wherein the value relating to the total value comprises the value of the first plurality of coins of the first currency type summed together with the value of the second plurality of coins of the second currency type minus a transaction fee.

24. The method for exchanging coins at a self-service coin exchange machine according to claim 21, wherein the act of determining a value of the second plurality of the coins of the second currency type comprises comparing the number of and denomination of the coins of the second currency type to a prevailing exchange rate for the second currency type.

25. The method for exchanging coins at a self-service coin exchange machine according to claim 21, further comprising:

disposing the self-service coin exchange machine in an airport, a train station, or in the vicinity of a border crossing.

26. The method for exchanging coins at a self-service coin exchange machine according to claim 21, further comprising:

discharging the first plurality of coins to a plurality of separate coin receptacles, each coin receptacle receiving coins of a single denomination of the first currency type; and discharging the second plurality of coins to common coin receptacle for the second currency type.

27. The method for exchanging coins at a self-service coin exchange machine according to claim 21, further comprising:

transmitting to a local computer, a remote computer, or both a local computer and a remote computer transaction information or statistical transaction information.

28. The method for exchanging coins at a self-service coin exchange machine according to claim 21, further comprising:

transmitting to a local computer, a remote computer, or both a local computer and a remote computer status information relating to the self-service coin exchange apparatus.

29. The method for exchanging coins at a self-service coin exchange machine according to claim 21, transmitting to a local computer, a remote computer, or both a local computer and a remote computer status information relating to a status of a coin receptacle, a coin dispenser, or a currency dispenser.

30. The method for exchanging coins at a self-service coin exchange machine according to claim 21, transmitting to a local computer, a remote computer, or both a local computer and a remote computer status information relating to a status of the coin processing device.

31. A method for exchanging coins, the method comprising:

receiving, in a bulk coin input area of a self-service coin exchange machine, bulk coins comprising a plurality of coins of a first currency type;

processing the plurality of coins to determine a total value of the plurality of coins; receiving an input from a user indicating a user status;

verifying, using at least one controller, the user status;

assessing, responsive to the user input, a transaction fee associated with the user status, the transaction fee being different for different ones of a plurality of user statuses; and dispensing bills of the first currency type from the currency dispensing module having an amount relating to the total value of the coins input into the self-service coin exchange machine by the user, less the transaction fee associated with the user's status.

32. The method of claim 31, wherein the act of receiving an input from the user indicating a user status comprises reading information from a card bearing data on a magnetic strip.

33. The method of claim 31, wherein the act of receiving an input from the user indicating a user status comprises accepting a code or other identifying information input by the user.

34. The method of claim 33, wherein the identifying information input by the user comprises biometric data.

35. The method of claim 33, wherein the self-service coin exchange machine is disposed in a grocery store and wherein the user status comprises a membership in a grocery store preferred card program.

* * * * *